US008111115B2

(12) United States Patent
Mansour et al.

(10) Patent No.: US 8,111,115 B2
(45) Date of Patent: Feb. 7, 2012

(54) METHOD OF OPERATION AND CONSTRUCTION OF DUAL-MODE FILTERS, DUAL BAND FILTERS, AND DIPLEXER/MULTIPLEXER DEVICES USING HALF CUT DIELECTRIC RESONATORS

(75) Inventors: Raafat R. Mansour, Waterloo (CA); Mohammad Memarian, North York (CA)

(73) Assignee: Com Dev International Ltd., Cambridge (CA)

( * ) Notice: Subject to any disclaimer, the term of this patent is extended or adjusted under 35 U.S.C. 154(b) by 188 days.

(21) Appl. No.: 12/479,263

(22) Filed: Jun. 5, 2009

(65) Prior Publication Data

US 2010/0013578 A1 Jan. 21, 2010

Related U.S. Application Data

(60) Provisional application No. 61/135,289, filed on Jul. 21, 2008.

(51) Int. Cl.
*H01P 7/10* (2006.01)
*H01P 11/00* (2006.01)

(52) U.S. Cl. ..... 333/202; 333/134; 333/219.1

(58) Field of Classification Search ..... 333/202, 333/212, 219.1, 134
See application file for complete search history.

(56) References Cited

U.S. PATENT DOCUMENTS 4,121,181 A 10/1978 Nishikawa et al.

(Continued)

FOREIGN PATENT DOCUMENTS

EP 0 736 923 A1 10/1996

OTHER PUBLICATIONS

Mansour, "Novel Configurations for Dielectric Loaded and Conductor Loaded Cavity Resonators with Improved Spurious Performance", Microwave Conf. 2001, APMC 2001, Dec. 2001, pp. 741-746.*

(Continued)

*Primary Examiner* — Seungsook Ham
(74) *Attorney, Agent, or Firm* — Bereskin & Parr LLP; Isis E. Caulder

(57) ABSTRACT

Novel quadruple-mode, dual-mode, and dual-band filters as well multiplexers are presented. A cylindrical dielectric resonator sized appropriately in terms of its diameter D and length L will operate as a quadruple-mode resonator, offering significant size reduction for dielectric resonator filter applications. This is achieved by having two mode pairs of the structure resonate at the same frequency. Single-cavity, quad-mode filters and higher order 4n-pole filters are realizable using this quad-mode cylindrical resonator. The structure of the quad-mode cylinder can be simplified by cutting lengthwise along its central axis to produce a half-cut cylinder suitable for operation in either a dual-mode or a dual-band. Dual-mode, 2n-pole filters are realizable using this half-cut cylinder. Dual-band filters and diplexers are further realizable using the half-cut structure and full cylinder by carrying separate frequency bands on different resonant modes of the structure. These diplexers greatly reduce size and mass of many-channel multiplexers at the system level, as each two channels are overloaded in one physical branch. Full control of center frequencies of resonances, and input and inter-resonator couplings are achievable, allowing realization of microwave filters with different bandwidth, frequency, and Return Loss specifications, as well as advanced filtering functions with prescribed transmission zeros. Spurious performance of the half-cut cylinder can also be improved by cutting one or more through-way slots between opposite surfaces. Size and mass reduction achieved by using the full and half-cut resonators described, provide various levels of size reduction in microwave systems, both filter level, and multiplexer level.

26 Claims, 36 Drawing Sheets

U.S. PATENT DOCUMENTS

| | | | | |
|---|---|---|---|---|
| 4,423,397 | A | 12/1983 | Nishikawa et al. | |
| 4,489,293 | A * | 12/1984 | Fiedziuszko | 333/202 |
| 4,881,051 | A | 11/1989 | Tang et al. | |
| 5,057,804 | A * | 10/1991 | Sogo et al. | 333/219.1 |
| 5,083,102 | A | 1/1992 | Zaki | |
| 5,200,721 | A | 4/1993 | Mansour | |
| 5,220,300 | A * | 6/1993 | Snyder | 333/210 |
| 5,311,160 | A * | 5/1994 | Higuchi et al. | 333/219.1 |
| 6,484,043 | B1 * | 11/2002 | Klein et al. | 505/210 |
| 6,549,102 | B2 * | 4/2003 | Mansour et al. | 333/219.1 |
| 6,873,222 | B2 | 3/2005 | Mansour | |
| 2002/0149449 | A1 | 10/2002 | Mansour et al. | |
| 2004/0130412 | A1 * | 7/2004 | Yamakawa et al. | 333/134 |

OTHER PUBLICATIONS

European Search Report for Application No. 09251833.1-2220 / 2151885 dated Mar. 24, 2010.

K.A. Zaki and C. Chen, "New Results in Dielectric-Loaded Resonator, IEEE Transactions on Microwave Theory and Techniques", Jul. 1, 1986, pp. 815-824, vol. MTT34, USA.

R. R. Mansour, "Dual-Mode Dielectric Resonator Filters with Improved Spurious Performance", Microwave Symposium Digest, Jun. 14, 1993, pp. 439-442, New York, USA.

Hiroshi Kubo et al., "Improvement of Unloaded Q of Image Dielectric Resonator Due to Shift of Electro . . . ", European Microwave Conference, 2003, pp. 195-198, Piscataway, USA.

* cited by examiner

METHOD OF OPERATION AND CONSTRUCTION OF DUAL-MODE FILTERS, DUAL BAND FILTERS, AND DIPLEXER/MULTIPLEXER DEVICES USING HALF CUT DIELECTRIC RESONATORS

CROSS-REFERENCE TO RELATED APPLICATION

This application is related to and claims the benefit of U.S. Provisional Application 61/135,289, filed Jul. 21, 2008 and entitled "Method of operation and construction of dual mode filters, dual band filters, and diplexer/multiplexer devices using full or half cut dielectric resonators," the entirety of which is hereby incorporated by reference.

FIELD

The embodiments described herein relate to microwave filters, and more particularly to dielectric resonator filters and multiplexers realized using full cylindrical or half-cut dielectric resonators.

BACKGROUND

Microwave bandpass filters are commonly realized using one or more resonators. Broadly speaking, a resonator is any physical element that stores both magnetic and electric energy in a frequency-dependent way. The resonant frequency of a resonator is defined as any frequency at which the stored electric and magnetic energies in the resonator are equal, and at that frequency the resonator is said to be in resonance.

Realizations of microwave resonators, however, are not so limited. At microwave frequencies, potentially any three-dimensional structure can be used to realize a resonator, in which internal electric and magnetic field distributions are generally determined by the shape and size of the overall structure. Some classes of microwave resonators include lumped element, microstrip, coaxial, waveguide, and dielectric resonators. Each class has application specific advantages and disadvantages.

In general, a dielectric resonator (DR) cavity comprises a dielectric resonator formed in a high-permittivity substrate mounted inside a metallic housing using a mounting support formed in a low-permittivity substrate. Compared to lumped element and microstrip resonators, dielectric resonators (as well as coaxial and waveguide resonators) tend to be bulkier in size and more complex in design, but offer superior Q values. In present microwave technologies, dielectric resonators offer Q values in the range of 3,000 to 40,000 at 1 GHz. For this reason, dielectric resonator filters are often favoured for use in satellite/space communication and wireless base station applications, where low loss and high power can be overriding design considerations. In addition to the Q values, resonator size and spurious performance (the frequency separation between an operating mode of the resonator and adjacent resonant modes) can also be important design considerations Dielectric resonators are also commonly operated as single-mode resonators, and dual-mode resonators, and less commonly as triple-mode and quadruple-mode resonators. A single-mode resonator supports only a single field distribution at the resonator's center frequency. Correspondingly, a dual-mode resonator supports two different field distributions and a triple-mode resonator supports three different field distributions. The intention for using a higher number of modes is mainly size reduction, as one physical resonator is overloaded with more than one electrical resonator, and each electrical resonator is supported by a mode distribution. Resonance modes, such as dual and triple-modes, which support a plurality of field distributions at the center frequency, are referred to as degenerate modes. In the usual case, the different field distributions in a degenerate mode are orthogonal modes of a similar field distribution and are created due to symmetries in the resonator. Thus, dual modes have been mainly realized with resonators having 90-degree radial symmetry (cylindrical and rectangular waveguide cavities and resonators), while triple modes are supported for example in cubic waveguide cavities and cubic dielectric resonators.

Quadruple-mode dielectric resonators have also been realized, but mainly due to complications in fabrication and tuning, comparatively less interest has been generated in this area. In order to realize a quadruple-mode dielectric resonator, independent or near independent control over the coupling and tuning of each of the four modes is required, which generally results in a complex overall coupling scheme involving a large number of tuning and/or coupling screws. Although tuning and coupling schemes necessary for single-mode and dual-mode dielectric resonators add some design complexity as well, the added design complexities are more pronounced in triple-mode dielectric resonators, and even more pronounced in presently known realizations of quadruple-mode dielectric resonators. Dual-mode, triple-mode, and quadruple-mode resonators remain attractive alternatives to single-mode dielectric resonators, however, because of their associated size reduction, especially considering that dielectric resonators already tend to be bulky. For the applications in which dielectric resonator filters are preferred, e.g. satellite/space systems, size and mass reduction are highly desirable.

SUMMARY

The embodiments described herein provide in one aspect a dielectric resonator assembly for use in one of a dielectric resonator filter and a dielectric resonator multiplexer, the dielectric resonator assembly comprising: a) a dielectric resonator; b) the dielectric resonator formed in a unitary piece of high-permittivity dielectric substrate into a half-cut cylinder of a selected height and a selected diameter, the half-cut cylinder defined by a parallel pair of semi-circular surfaces, a curved surface extending along respective curved edges of the pair of semi-circular surfaces, and a rectangular surface subtending the curved surface, wherein a first dimension of the rectangular surface corresponds to the selected height and a second dimension of the rectangular surface corresponds to the selected diameter; wherein the dielectric resonator resonates in a plurality of resonance modes comprising a ½HEH11 mode and a ½HEE11 mode and, at the selected height and the selected diameter, the ½HEH11 mode and the ½HEE11 are mode are operating modes of the dielectric resonator assembly.

The embodiments described herein provide in another aspect a dielectric resonator assembly for use in one of a dielectric resonator filter and a dielectric resonator multiplexer, the dielectric resonator assembly comprising: a) a dielectric resonator; b) the dielectric resonator formed in a unitary piece of high-permittivity dielectric substrate into a cylinder of a selected height and a selected diameter;

wherein the dielectric resonator resonates in a plurality of resonance modes comprising an HEH11 dual mode and an HEE11 dual mode and, at the selected height and the selected diameter, the HEH11 dual mode and the HEE11 dual mode are operating modes of the dielectric resonator assembly.

The embodiments described herein provide in another aspect a dielectric resonator filter comprising: a) at least one dielectric resonator assembly comprising a dielectric resonator formed in a unitary piece of high-permittivity dielectric substrate into one of: (i) a half-cut cylinder of a selected height and a selected diameter, the half-cut cylinder defined by a parallel pair of semi-circular surfaces, a curved surface extending along respective curved edges of the pair of semi-circular surfaces, and a rectangular surface subtending the curved surface, wherein a first dimension of the rectangular surface corresponds to the selected height and a second dimension of the rectangular surface corresponds to the selected diameter; and (ii) a cylinder of the selected height and the selected diameter; wherein the dielectric resonator resonates in a plurality of resonance modes comprising operating modes of the dielectric resonator assembly and, at the selected height and the selected diameter, the half-cut cylinder resonates in a ½HEH11 mode and a ½HEE11 mode, and the cylinder resonates in an HEH11 dual mode and an HEE11 dual mode.

The embodiments described herein provide in another aspect a dielectric resonator multiplexer comprising: a) at least one dielectric resonator assembly comprising a dielectric resonator formed in a unitary piece of high-permittivity dielectric substrate into one of: (i) a half-cut cylinder of a selected height and a selected diameter, the half-cut cylinder defined by a parallel pair of semi-circular surfaces, a curved surface extending along respective curved edges of the pair of semi-circular surfaces, and a rectangular surface subtending the curved surface, wherein a first dimension of the rectangular surface corresponds to the selected height and a second dimension of the rectangular surface corresponds to the selected diameter; and (ii) a cylinder of the selected height and the selected diameter; wherein the dielectric resonator resonates in a plurality of resonance modes comprising operating modes of the dielectric resonator assembly and, at the selected height and the selected diameter, the half-cut cylinder resonates in a ½HEH11 mode and a ½HEE11 mode, and the cylinder resonates in an HEH11 mode and an HEE11 mode.

The embodiments described herein provide in another aspect a method of manufacturing a unitary resonator assembly for use in one of a dielectric resonator filter and a dielectric resonator multiplexer, said method comprising: a) providing a dielectric material; b) forming the dielectric material into full cylinder of a selected height and a selected diameter; wherein the dielectric resonator resonates in a plurality of resonance modes comprising an HEH11 mode and an HEE11 mode and, at the selected height and the selected diameter, the HEH11 mode and the HEE11 mode are operating modes of the dielectric resonator assembly.

Further aspects and advantages of the embodiments described herein will appear from the following description taken together with the accompanying drawings.

DRAWINGS

For a better understanding of the embodiments described herein and to show more clearly how they may be carried into effect, reference will now be made, by way of example only, to the accompanying drawings which show at least one exemplary embodiment, and in which.

Figure 1A:
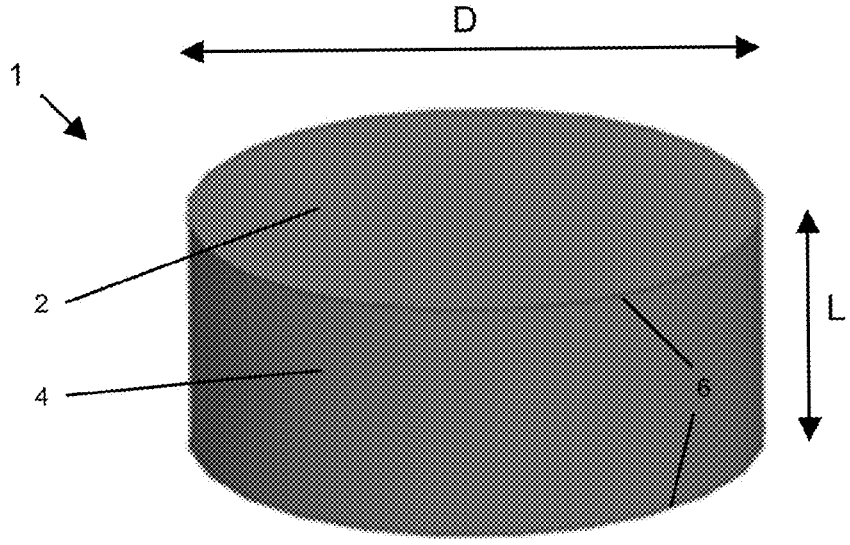
FIG. 1A is a perspective view of an exemplary full cylindrical dielectric resonator.

It will be appreciated that for simplicity and clarity of illustration, elements shown in the figures have not necessary been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

One of the more popular dielectric resonator topologies is the cylindrical resonator, which may be operated in a single TEH resonant mode, as well as in dual degenerate $HEH_{11}$ or dual degenerate $HEE_{11}$ resonant modes. By sizing its diameter D and length L to have a particular D/L ratio, however, the dual $HEH_{11}$ and $HEE_{11}$ modes of the cylindrical resonator can be made to resonate at a common resonant frequency, thereby converting the full cylinder dielectric resonator into a relatively simple and compact quadruple-mode resonator. Single cavity, four-pole filters (and more generally N-cavity, 4N-pole filters) can then be realized using the full cylinder operated in a quad-mode, wherein the centre frequency of the filter is given by the common resonant frequency of the quad-mode.

The structure of the quad-mode cylinder can be simplified by cutting lengthwise along its central axis to produce a new class of half-cut cylindrical resonators. Similar to the quad-mode cylinder, by appropriate sizing of its diameter and length, the half-cut dielectric resonator can be operated as a dual-mode resonator, the two modes in the half-cut cylinder corresponding respectively to half of a single component of the degenerate $HEH_{11}$ and $HEE_{11}$ modes (hereinafter referred to as the "½$HEH_{11}$ mode" and the "½$HEE_{11}$ mode"). This realization of a half-cut cylindrical resonator is totally different from the image-type realization that uses metals in contact with the resonator along cut lines to simulate an ideal electric wall boundary condition. By exploiting a naturally occurring magnetic wall boundary condition in the $HEH_{11}$ and $HEE_{11}$ modes, no metals are required for the half-cut dielectric resonator and all losses and design constraints incurred by inclusion of the metals can be saved. Considerable size reductions are achieved, and complex tuning and/or coupling arrangements are largely avoided. The half-cut dielectric resonator can be used to realize a general class of N-cavity, 2N-pole dual-mode filters, as well as other non-fully dual-mode filters.

Both the full cylindrical and the half-cut cylindrical resonator have further application in dual-band filters. If the diameter and length of the cylinder are sized differently, the dual $HEH_{11}$ and $HEE_{11}$ modes (or alternatively the ½$HEH_{11}$ and ½$HEE_{11}$ modes) will resonate at separate resonant frequencies. The two frequency bands of the dual-band filter can then be carried by a corresponding resonant mode, wherein the center frequencies of the two bands will be given by the different resonant frequencies of the $HEH_{11}$ and $HEE_{11}$ modes (or alternatively by the ½$HEH_{11}$ and ½$HEE_{11}$ modes). The full cylindrical resonator can be used to realize N-cavity, dual-band filters with 2N poles in each band, while the half-cut resonator can be used to realize N-cavity, dual-band filters with N poles in each band. As bases for dual-band filters, the full and half-cut cylindrical resonators are versatile in providing full or near full control over the centre frequencies and fractional bandwidths of the two frequency bands, as well as their frequency band separation. Prior dual-band filters that carry the dual-band on physically separate resonators within a single cavity are bulky. Carrying the dual-band instead on orthogonal resonant modes of a single physical resonator offers significant size reductions over prior filter realizations, and also greatly simplifies filter design by permitting essentially independent control of each band.

Suitable modification of the basic dual-band filter will also realize a dielectric resonator diplexer. Rather than coupling both bands of the dual-band to a common output channel, each band can be isolated and independently coupled to different output channels. Components of mixed frequency signals failing somewhere within the dual-band can then be separated. Improved output channel isolation can also be achieved by coupling the different channel outputs to resonators enclosed in separate resonator cavities. The basic diplexer concept is extendible to higher order multiplexers.

Spurious performance of the half-cut cylinder can also be improved by cutting one or more through-way slots between opposite surfaces. The first spurious mode of the half-cut dielectric resonator is the third eigenmode of the structure, and its E field lines circulate orthogonal to the E field lines in both the ½$HEH_{11}$ and ½$HEE_{11}$ modes. Cutting a through-way slot generally parallel to the E field lines of the ½$HEH_{11}$ and ½$HEE_{11}$ modes, but orthogonal to the E field lines in the first spurious mode, therefore, creates a selective barrier terminating the E field lines of the latter, while leaving the former largely undisturbed. The spurious free window of the half-cut dielectric resonator is thereby greatly increased. Cutting a second through-way slot orthogonal to the first will likewise terminate the E field lines of the fourth eigenmode of the structure (the second spurious mode), and thereby provide an even wider spurious free window.

These and other aspects of embodiments of the present invention are discussed in greater detail below.

Figure 1B:
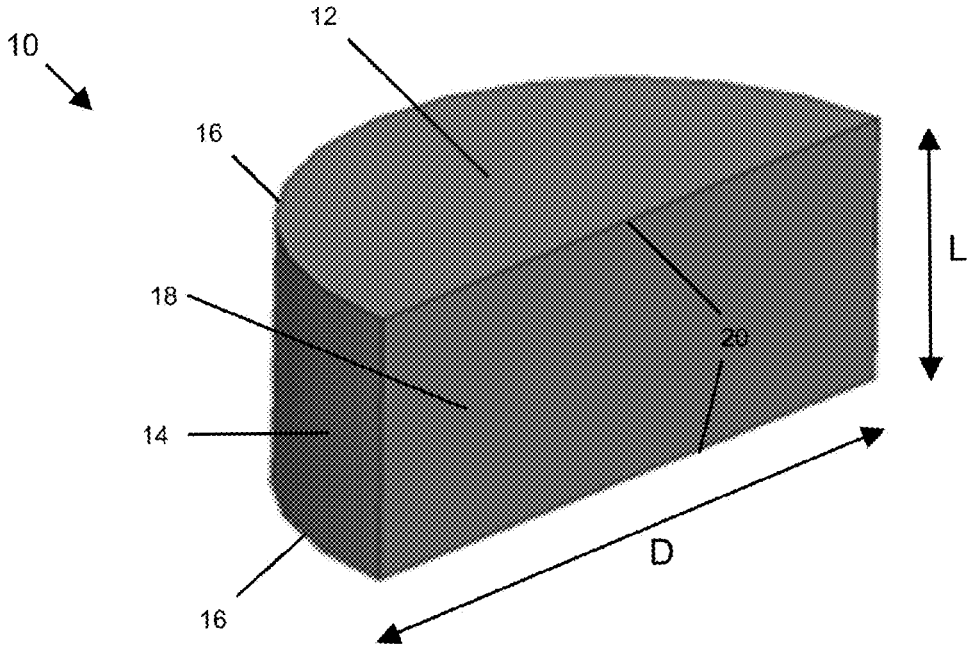
FIG. 1B is a perspective view of an exemplary half-cut dielectric resonator.

Reference is first made to FIGS. 1A and 1B, which are perspective views of an exemplary full and half-cut cylindrical dielectric resonator, respectively, according to aspects of embodiments of the present invention. The full cylindrical dielectric resonator 1 shown in FIG. 1A comprises a generally cylindrical shape of diameter D and length L formed in a unitary piece of suitable high-permittivity dielectric substrate. Accordingly, the full cylindrical dielectric resonator 1 is defined by a parallel pair of circular surfaces 2 connected by circumferential surface 4 at circular edges 6. The dielectric constant $\in_r$ of the high-permittivity material falls in the range 20-100, but preferably in the range 30-50. For example, the full cylindrical dielectric resonator 1 may be formed out of ceramic, but other dielectric substrates may be suitable as well.

The half-cut dielectric resonator 10 is formed by cutting the full cylindrical dielectric resonator 1 along its cylindrical axis to produce the half-cylindrical form shown in FIG. 1B. Ideally the cut will align precisely with the cylindrical axis resulting in a perfect half-cut cylinder. As will be described in greater detail below, however, some margin of error with respect to the location of the cut is tolerable. This half-cylindrical form is defined by a parallel pair of semi-circular surfaces 12, a curved surface 14 extending along and connected to the pair of semi-circular surfaces 12 at respective curved edges 16, and a rectangular surface 18 subtending the curved surface 14 and connected to the pair of semi-circular surfaces 12 at diametric edges 20. The rectangular surface 18 therefore has dimensions of D and L and, in the ideal case, defines a plane that intersects with the cylindrical axis of the full-cylinder. The half-cut dielectric resonator 10 is formed in the same high-permittivity substrate as the full cylindrical dielectric resonator 1.

Figure 2A:
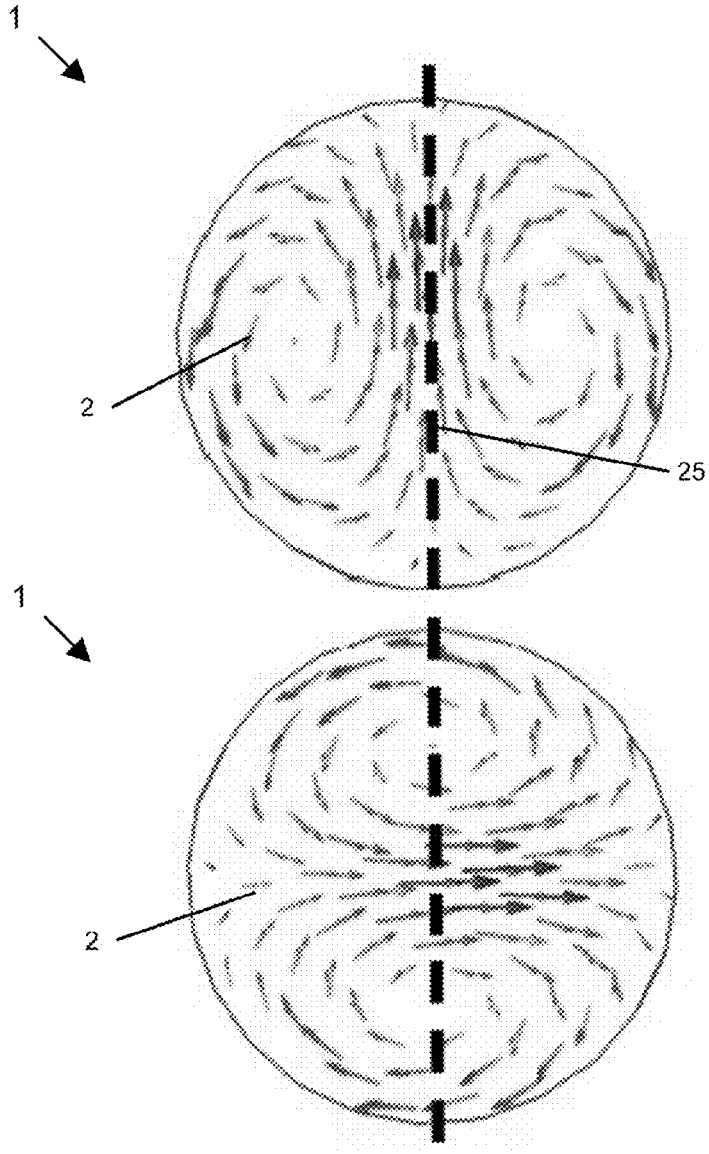
FIG. 2A is a top view of the E field lines in the full cylindrical dielectric resonator of FIG. 1A for the $HEH_{11}$ resonant mode.
Figure 2B:
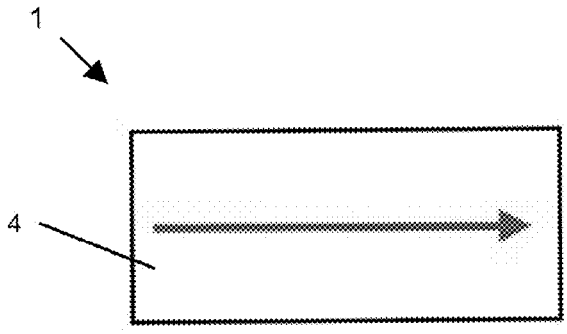
FIG. 2B is a side view showing the concentration of E field lines in the full cylindrical dielectric resonator of FIG. 1A for the $HEH_{11}$ resonant mode.

Reference is now made to FIGS. 2A-2D, which illustrate top and side views of the E fields in the full cylindrical dielectric resonator 1 for the $HEH_{11}$ and $HEE_{11}$ resonant modes, according to aspects of embodiments of the present invention. Both components of the dual $HEH_{11}$ mode of the full cylinder are illustrated in FIG. 2A. As can be seen, the two mode components are provided by E field distributions of the same polarization, rotated 90-degrees relative to one another. Thus the two mode components of the dual $HEH_{11}$ mode are orthogonal. As shown in FIG. 2B, the horizontally circulating E fields in the dual $HEH_{11}$ mode, though present throughout the full cylinder, are concentrated at the axial midpoint.

Figure 2C:
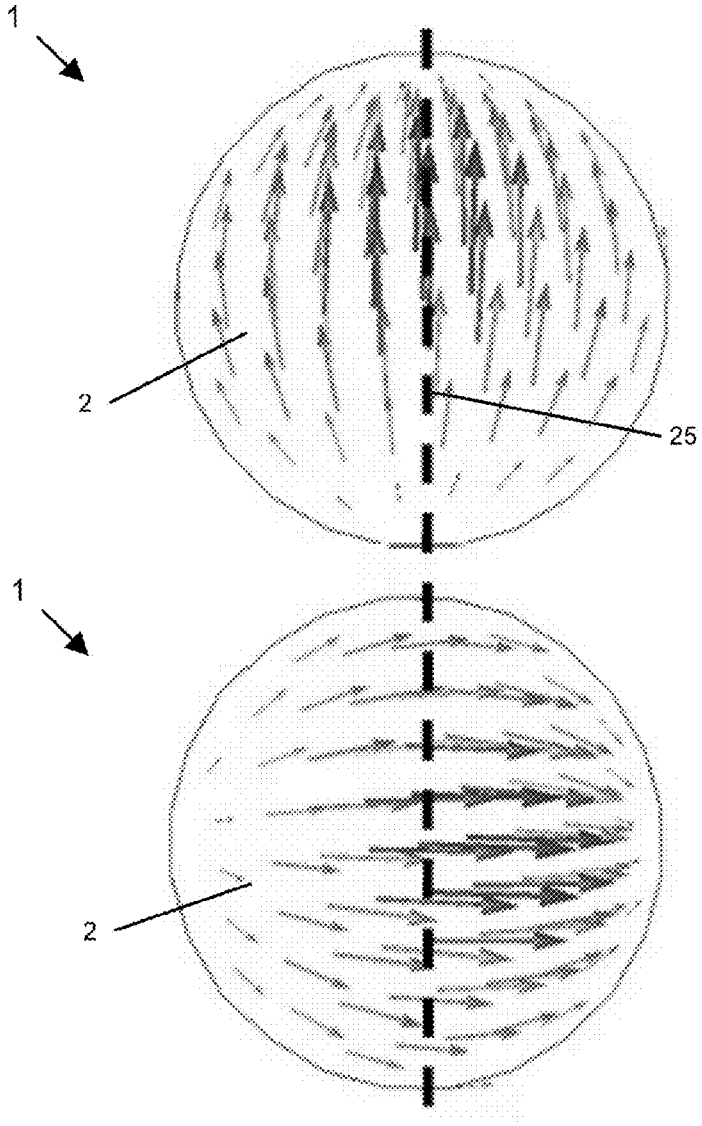
FIG. 2C is a top view of the E field lines in the full cylindrical dielectric resonator of FIG. 1A for the $HEE_{11}$ resonant mode.
Figure 2D:
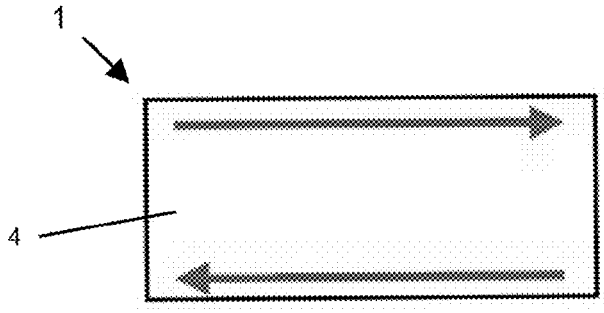
FIG. 2D is a side view showing the concentration of E field lines in the full cylindrical dielectric resonator of FIG. 1A for the $HEH_{11}$ resonant mode.
Figure 3A:
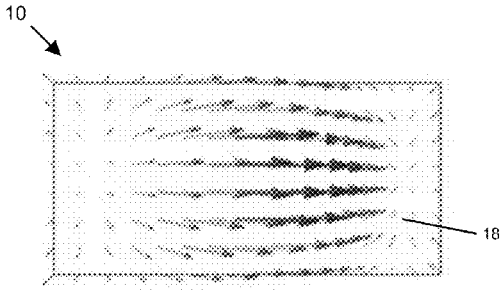
FIG. 3A is a side view of the E field lines in the half-cut dielectric resonator of FIG. 1B for the ½$HEH_{11}$ resonant mode.
Figure 3C:
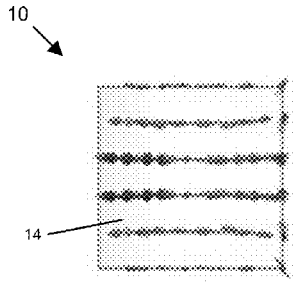
FIG. 3C is a front view of the E field lines in the half-cut dielectric resonator of FIG. 1B for the ½$HEH_{11}$ resonant mode.
Figure 3B:
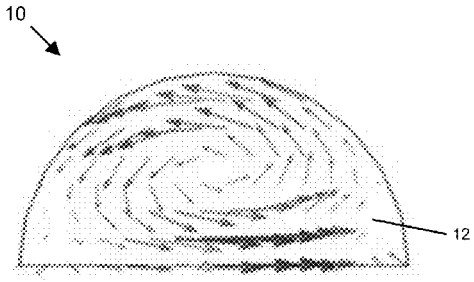
FIG. 3B is a top view of the E field lines in the half-cut dielectric resonator of FIG. 1B for the ½$HEH_{11}$ resonant mode.
Figure 3D:
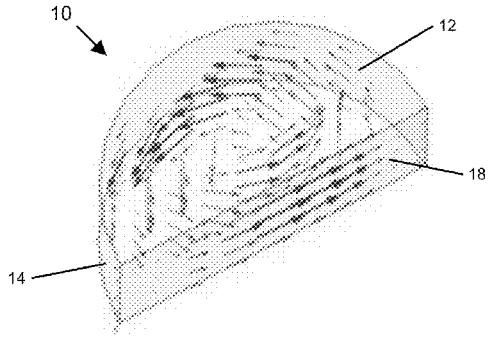
FIG. 3D is a perspective view of the E field lines in the half-cut dielectric resonator of FIG. 1B for the ½$HEH_{11}$ resonant mode.
Figure 3E:
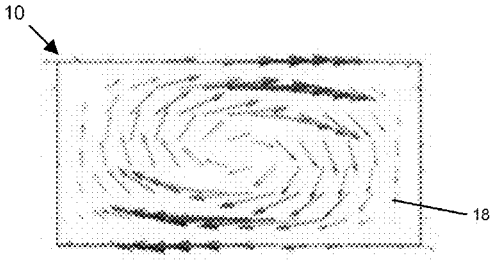
FIG. 3E is a side view of the E field lines in the half-cut dielectric resonator of FIG. 1B for the ½$HEE_{11}$ resonant mode.
Figure 3G:
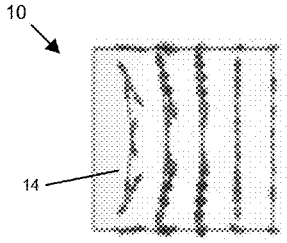
FIG. 3G is a front view of the E field lines in the half-cut dielectric resonator of FIG. 1B for the ½$HEE_{11}$ resonant mode.
Figure 3F:
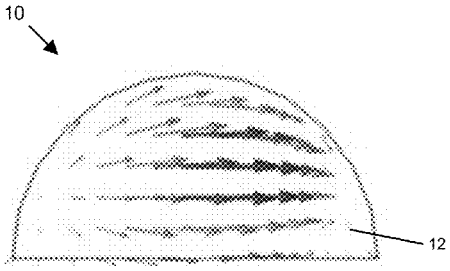
FIG. 3F is a top view of the E field lines in the half-cut dielectric resonator of FIG. 1B for the ½$HEE_{11}$ resonant mode.
Figure 3H:
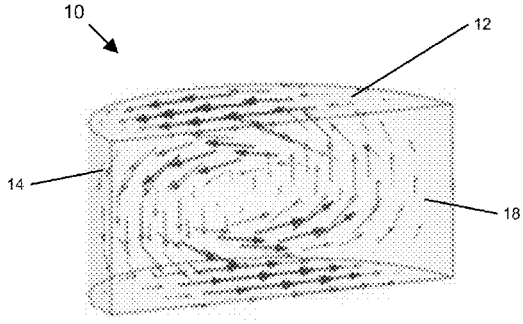
FIG. 3H is a perspective view of the E field lines in the half-cut dielectric resonator of FIG. 1B for the ½$HEE_{11}$ resonant mode.

Similarly, FIG. 2C illustrates both components of the dual $HEE_{11}$ mode of the full cylindrical dielectric resonator 1. Again the two mode components are provided by E field distributions of the same polarization, rotated 90-degrees relative to one another. The two mode components of the dual $HEE_{11}$ mode are thus also orthogonal. As shown in FIG. 2D, the vertically circulating E fields in the dual $HEH_{11}$ mode are concentrated at the periphery of the cylinder including the axial ends of the full cylinder.

As eigenmodes of the full cylinder, the dual $HEH_{11}$ and $HEE_{11}$ modes are substantially non-interactive. Neither the two components of the dual $HEH_{11}$ mode nor the two components of the dual $HEE_{11}$ mode couple, as they are all orthogonal to one another. The dual $HEH_{11}$ and $HEE_{11}$ modes also do not couple each other. The full cylindrical dielectric resonator 1 has a plurality of resonant modes of which the dual $HEH_{11}$ and $HEE_{11}$ modes represent only two pairs. The single TEH and single TME modes, which are also substantially non-interactive, are two other examples of resonant modes of the full cylinder.

It is evident in FIGS. 2A-2D that the E field lines in the full cylinder circulate horizontally (parallel to the plane of the page) for the $HEH_{11}$ mode and vertically (perpendicular to the plane of the page) for the $HEE_{11}$ mode. For one component of each mode (the top views in FIGS. 2A and 2C), however, the E field lines circulate tangential to the symmetry plane 25, which is oriented perpendicular to the plane of page. For the other components (the bottom views in FIGS. 2A and 2C), the E fields circulate orthogonal to the symmetry plane 25. Owing to this symmetry, an ideal magnetic wall boundary condition coincident with the plane 25 would not disturb the tangentially circulating field distributions within the full cylindrical dielectric resonator 1. In other words, a half-cut cylindrical dielectric resonator 10 with an ideal magnetic wall coincident with the rectangular surface 18 would perfectly simulate the resonance modes of the full cylindrical dielectric resonator 1 that are tangential to the plane, only with half the stored electric and magnetic field energies. These resonant modes can be denoted ideal $\frac{1}{2}HEH_{11}$ and $\frac{1}{2}HEE_{11}$ modes.

Reference is now made to FIGS. 3A-3H, which illustrate various views of the E fields in the half-cut dielectric resonator 10 for the $\frac{1}{2}HEH_{11}$ and $\frac{1}{2}HEE_{11}$ resonant modes, according to aspects of embodiments of the present invention. The E field distributions shown in FIGS. 3A-3D (side, top, front, perspective) correspond to the $\frac{1}{2}HEH_{11}$ mode, while those in FIGS. 3E-3H (side, top, front, perspective) correspond to the $\frac{1}{2}HEE_{11}$ mode. In the case of half-cut dielectric resonator 10, the rectangular surface 18 does act as a magnetic wall boundary condition. But because the dielectric constant in real dielectric resonators is finite, the magnetic wall boundary condition will not be a perfect one. Some energy will leak across the rectangular surface 18. Consequently, the $\frac{1}{2}HEH_{11}$ and $\frac{1}{2}HEE_{11}$ modes of the half-cut dielectric resonator 10 do not exactly replicate the ideal $\frac{1}{2}HEH_{11}$ and $\frac{1}{2}HEE_{11}$ modes, resulting in slightly higher resonant frequencies than in the ideal case. On the whole, however, the $\frac{1}{2}HEH_{11}$ and $\frac{1}{2}HEE_{11}$ modes of the non-ideal half-cut cylinder provide good approximations of the ideal modes, so long as the cut aligns generally with the cylindrical axis of the full cylinder. If the cut is misaligned by too great an extent, the resulting shape will no longer have a surface coincident with the symmetry plane 25 that provides the magnetic wall necessary for the $\frac{1}{2}HEH_{11}$ and $\frac{1}{2}HEE_{11}$ modes to be expressed.

As described above, both the $HEH_{11}$ and $HEE_{11}$ modes of the full cylindrical dielectric resonator 1 are dual modes on account of radial symmetry in the cylinder, each comprising two identical mode components. It is evident in FIGS. 3A-3H, however, that cutting the full cylinder along its cylindrical axis removes its radial symmetry. By removing half of the dielectric material of the full cylinder, the components from each of the $HEH_{11}$ and $HEE_{11}$ modes that are orthogonal to the symmetry plane 25 (or alternatively that are orthogonal to the rectangular surface 18) are deformed to meet the new boundary conditions of the half-cut cylinder, and are thereby lost as higher order resonant modes. These lost components become the spurious mode resonances of the half-cut cylinder. The mode components of the $HEH_{11}$ and $HEE_{11}$ modes that remain after the cut become the $\frac{1}{2}HEH_{11}$ and $\frac{1}{2}HEE_{11}$ modes and are single modes.

Figure 4A:
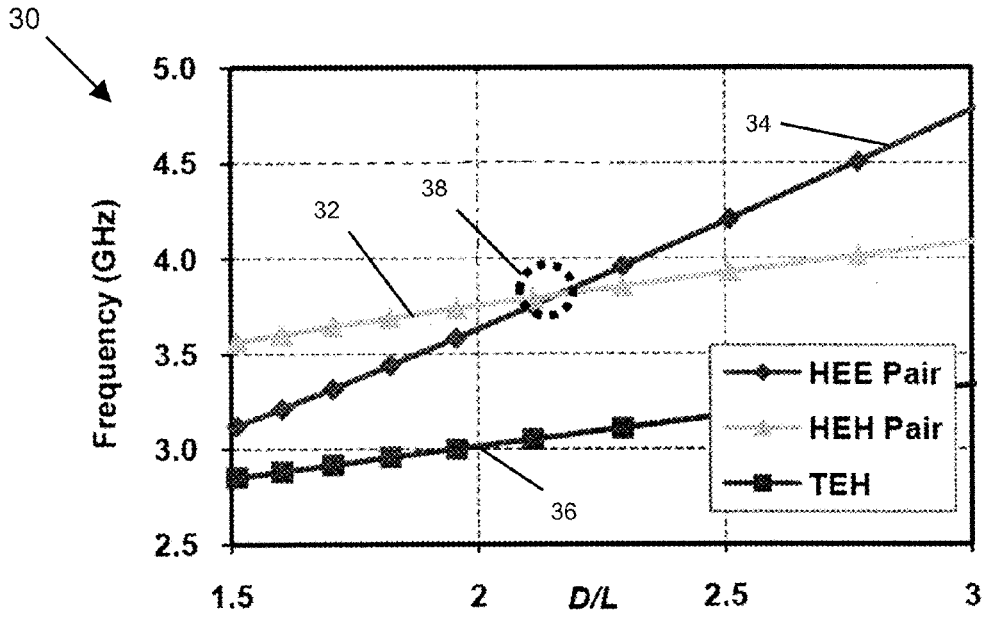
FIG. 4A is a mode chart for the full cylindrical dielectric resonator of FIG. 1A as a function of diameter-to-length (D/L) ratio.

Reference is now made to FIG. 4A, which is a mode chart for the full cylindrical dielectric resonator of FIG. 1A as a function of diameter-to-length (D/L) ratio. The mode chart 30 plots frequency (GHz) against diameter-to-length (D/L) ratio and corresponds to a cylindrical resonator ($D=0.7$, $\epsilon_r=38$) located in a $1\times1\times1$ $in^3$ cavity. The length L of the cylinder is the free variable. Curve 32 represents the resonant frequencies of the $HEH_{11}$ mode at corresponding D/L ratios, while curve 34 represents the same for the $HEE_{11}$ mode. Curve 36 represents the resonant frequencies of the TEH mode at corresponding D/L ratios. It is observed in the mode chart 30 that curves 32 and 34 intersect at point 38, representing a particular D/L ratio of the full cylindrical dielectric resonator 1 for which the respective resonant frequencies of the dual $HEH_{11}$ and $HEE_{11}$ modes are equal. In other words, the intersection point 38 represents a D/L ratio for which the dual $HEH_{11}$ and $HEE_{11}$ modes resonate at a common resonant frequency. The exact D/L ratio for which this relationship holds will vary depending on the selected dimensions of the resonator and cavity. But in general, for a full cylindrical dielectric resonator of a given diameter in free space, there will exist only one unique D/L ratio for which the two dual modes will resonate at a common resonant frequency.

Qualitatively, the resonant frequency of a mode can be inversely related to the length of the circulating E field for that mode. Shorter circulation paths correlate with higher resonant frequencies. As the E field in the $HEH_{11}$ mode circulates horizontally parallel to the circular surfaces 2, its path length is strongly dependent on the diameter D, but largely independent of the length L. In contrast, the E field in the orthogonal $HEE_{11}$ mode circulates vertically, and thus its path length has a strong dependency on both the diameter D and the length L of the cylinder. Sizing of the length L therefore has an appreciable affect only on the resonant frequency of the $HEE_{11}$ mode, while sizing of the diameter D, though some effect will be seen in the resonant frequency of $HEE_{11}$ mode, has a proportionately greater effect on the resonant frequency of the $HEH_{11}$ mode. These relative dependencies on the dimensions of the cylinder are reflected in the different slopes of curves 32 and 34, and thus also account for intersection point 38. Analytic models and mode charts, refined with full wave solvers, may be used for precise determination of the D/L ratio, and corresponding common resonant frequency, at intersection point 38. It will be appreciated however that setting $D/L\sim2$ provides a good starting estimate for the computation, and that the exact D/L ratio will typically be slighter greater than 2.

By solving the D/L ratio at which the two dual modes of the full cylinder resonate at a common frequency, the full cylindrical dielectric resonator 1 can be sized for operation as a quadruple-mode resonator. Of course, it should be appreciated that only the D/L ratio is fixed for quad-mode operation and that the absolute values of D and L remain to be selected (so long as their ratio is preserved) in the design process based on a selected operating frequency. The four modes of the cylindrical quad-mode resonator then correspond to the dual $HEH_{11}$ and $HEE_{11}$ resonant modes. As these modes are eigenmodes of the structure, and thus orthogonal, the field distributions of the four modes theoretically do not interact or couple. Independent or near independent control over the four modes (coupling, tuning, etc.) is therefore possible. But unlike prior realizations of quad-mode filters, one constructed using a full cylinder dielectric resonator 1 sized for operation in a quad-mode will offer considerable size reductions and have comparatively less complex coupling and tuning mechanisms. Fabrication is simplified as well because cylindrical dielectric resonators with custom height and diameter are widely available commercially. Size reductions are seen equally in single-cavity, 4-pole filters, as in higher order, 4n-pole filters. Size reductions can be achieved for dual-mode filters by extending the quad-mode concept of the full cylinder to the half-cut cylinder.

Figure 4B:
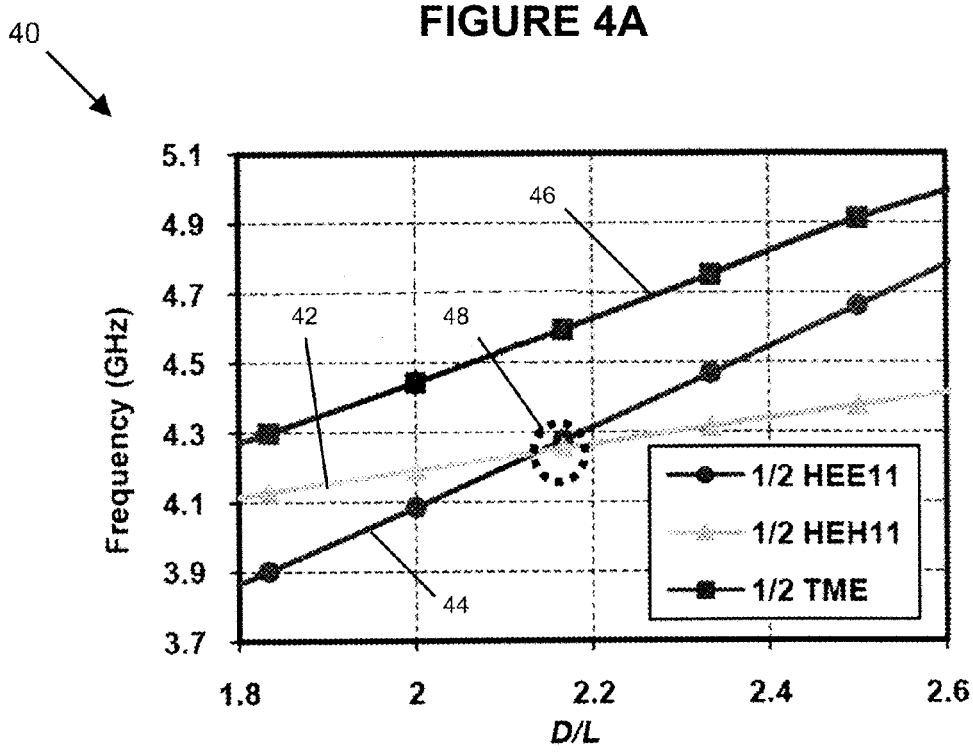
FIG. 4B is a mode chart for the half-cut dielectric resonator of FIG. 1B as a function of diameter-to-length (D/L) ratio.

Reference is now made to FIG. 4B, which is a mode chart for the half-cut dielectric resonator of FIG. 1B as a function of diameter-to-length (D/L) ratio. The mode chart 40 also plots frequency (GHz) against diameter-to-length (D/L) ratio, and is generated for a half-cut cylinder (D=0.9 in, $\in_r$=45) located in a 1×1×1 $in^3$ cavity. The length L of the cylinder is again the free variable. Curve 42 represents the resonant frequency of the ½$HEH_{11}$ mode for corresponding D/L ratios, while curve 44 represents the same for the ½$HEE_{11}$ mode. Curve 46 represents the resonant frequency of a ½TME mode of the half-cut dielectric resonator 10 for corresponding D/L ratios. It is similarly observed in the mode chart 40 that curves 42 and 44 intersect at point 48, representing a particular D/L ratio of the half-cut dielectric resonator 10 for which the ½$HEH_{11}$ and ½$HEE_{11}$ modes resonate at a common resonant frequency. The exact D/L ratio for which this relationship holds will again vary depending on selected dimensions of the resonator and cavity, though again there will in general exist only one unique D/L ratio for which the two modes will resonate at a common frequency.

It can also be observed that curves 42 and 44 trace out lower order modes than curve 46. In other words, over the whole range of D/L ratios, the ½$HEH_{11}$ and ½$HEE_{11}$ resonate at a lower frequency than the ½TME mode, which confirms that the former are the first two eigenmodes of the half-cut cylindrical structure. Of course, the relative ordering of the ½$HEH_{11}$ and ½$HEE_{11}$ modes depends on the selected D/L ratio of the half-cut cylinder. Each of the ½$HEH_{11}$ and ½$HEE_{11}$ modes can constitute either the first or the second eigenmode. Similar trends are observed in the mode chart 30, except that the $HEH_{11}$ and $HEE_{11}$ modes constitute second and third eigenmodes of the structure. The TEH mode that does not appear in the half-cut cylinder (because its E fields circulate in an azimuthal plane) constitutes the first eigenmode of the full cylinder.

As with the full cylinder, resonant frequency is qualitatively related to the length of the circulating E field in a particular mode. Like the $HEH_{11}$ and $HEE_{11}$ modes, the ½$HEH_{11}$ and ½$HEE_{11}$ modes of the half-cut cylinder have relative dependencies on the diameter D and length L. The horizontally circulating E field in the ½$HEH_{11}$ remains strongly dependent on the diameter D and largely independent of the length L, while the E field in the orthogonal ½$HEE_{11}$ mode retains its strong dependency on both these dimensions. Sizing the length L therefore again predominantly influences the resonant frequency of the ½$HEE_{11}$ mode, while sizing of the diameter D predominantly influences the resonant frequency of the ½$HEH_{11}$ mode, and thus account for the intersection point 48. Analytic models and mode charts, refined with full wave solvers, again may be used to determine intersection point 48 exactly. But because the rectangular surface 18 provides a relatively good magnetic wall boundary, as with the full cylinder, setting D/L~2 still provides a good starting estimate for the computation and the exact D/L ratio will still typically be greater than 2.

When the diameter D and length L are appropriately selected so that the ½$HEH_{11}$ and ½$HEE_{11}$ modes resonate at a common resonant frequency, the half-cut cylindrical dielectric resonator can be operated as a dual-mode resonator in a dual-mode filter. Since the two modes are eigenmodes of the structure, their E field distributions are orthogonal and can coexist within the structure without appreciable interaction or coupling. The center frequency of the dual-mode filter will be set by the common resonant frequency of the ½$HEH_{11}$ and ½$HEE_{11}$ modes. A dual-mode filter realized in this way using an appropriately sized half-cut cylindrical resonator is unlike other realizations of dual-mode filters insofar as the two resonant modes are provided by a single physical resonator and have completely different field distributions. Other realizations of dual-mode filters involve two physically separate resonators resonating in the same mode (i.e. two parallel coupled resonators) or else one physical resonator operating in a degenerate mode. A good example of the latter is the dual $HEH_{11}$ or dual $HEE_{11}$ modes of the full cylindrical dielectric resonator 1. Considerable size reductions can be achieved by using the half-cut dielectric resonator 10 operating in a dual-mode instead. Simplified coupling schemes are also made possible by the relative orthogonality of the dual-mode.

Although the half-cut dielectric resonator 10 can be made to operate as a dual-mode resonator through appropriate sizing of its D/L ratio, it is possible also to select other D/L ratios in order to synthesize other classes of microwave filters. Accordingly, in some embodiments, the D/L ratio of the half-cut dielectric resonator 10 is selected so that the ½$HEH_{11}$ resonates at a first resonant frequency (hereinafter "$f_H$"), while the ½$HEE_{11}$ mode resonates at a second resonant frequency (hereinafter "$f_E$") different from the first resonant frequency. By this selection of D/L ratio, the half-cut dielectric resonator 10 can operate as a dual-band resonator for use in a dual-band filter. The two bands of the dual band filter will be carried by the corresponding different resonant modes of the half-cut dielectric resonator 10. One of the dual bands is thus supported by the ½$HEH_{11}$ mode and has center frequency $f_H$, while the other of the two bands is supported by the ½$HEE_{11}$ mode and has center frequency $f_E$. Accordingly, the centre frequencies of the dual bands will correspond to the separate resonant frequencies of the ½$HEH_{11}$ and ½$HEE_{11}$ modes.

It is evident from FIG. 4B that the resonant frequencies of the ½$HEH_{11}$ and ½$HEE_{11}$ mode switch relative magnitudes at the intersection point 48. For the range of D/L ratios below intersection point 48, $f_H$ is greater than $f_E$, while for the range of D/L ratios above intersection point 48, $f_H$ is less than $f_E$. Qualitatively, starting from intersection point 48, where $f_H=f_E$, reducing the length L (for a given diameter D) tends to produce a sharp increase in $f_E$, but only a slight increase in $f_H$, thereby creating frequency separation. The same effect will be achieved alternatively by reducing the diameter D (for a fixed length L), which tends to decrease both $f_H$ and $f_E$, but at a faster rate with respect to $f_E$. Accordingly, by appropriate selection of the D/L ratio of the half-cut dielectric resonator, either $f_H$ or $f_E$ can be set larger than the other. Either of the two bands in the realized dual band filter can therefore be carried by either the ½$HEH_{11}$ or ½$HEE_{11}$ resonant modes.

A dual band filter may generally be defined, among other parameters, by the center frequencies of its two bands, $f_H$ and $f_E$, and their frequency separation, $\Delta f=|f_H-f_E|$. By appropriate selection of the diameter D and length L of the half-cut dielectric resonator 10, the filter parameters $f_H$, $f_E$, $\Delta f$ can be designed according to meet specification. It should again be appreciated that the diameter D and length L are independent variables. Consequently, $f_H$, $f_E$ and $\Delta f$ will generally depend, not just on the D/L ratio, but also on their absolute values. Full sweeps of both variables may therefore be required when designing a dual-band filter using half-cut dielectric resonators to meet specifications. As above, analytic models and mode charts, refined with full wave solvers, if necessary, may be used to solve values for D and L that will realize the desired filter specifications (e.g. $f_H$, $f_E$, $\Delta f$).

When designing and synthesizing microwave filters, such as dual-mode, quad-mode or dual-band filters, it is generally desirable to be provided with independent, or near independent, control over each resonant mode. Many filter synthesis techniques require independent control over resonant mode coupling and tuning for proper placement of the filter's transmission zeros as a separate step once the resonators have been designed for proper placement of the filter's poles. Filter synthesis is greatly complicated where independent control over the resonant modes is lacking. The full cylindrical or half-cut dielectric resonators discussed herein largely avoid this complication because each operating resonant mode of these structures is also an eigenmode and thus orthogonal. That property of the full and half-cut dielectric resonators is exploited to realize controllable, effective and relatively straightforward coupling mechanisms for microwave filters, including inter-cavity mode coupling, intra-cavity mode coupling, and input-output mode coupling. Each of these coupling mechanisms, it should be appreciated, is necessary for advanced microwave filter synthesis. In the discussion to follow, these and other aspects of dielectric resonator filters and multiplexers realized using full cylindrical or half-cut dielectric resonators are explained in greater detail.

Reference is now made to FIGS. 5A-5D, which illustrate perspective views of exemplary inter-cavity couplings of two half-cut dielectric resonator assemblies, according to aspects of embodiments of the present invention. As seen, for example, in FIGS. 5A and 5B, resonator cavity 50*a* encloses half-cut dielectric resonator 10*a*. Preferably, resonator cavity 50*a* comprises a metallic housing and provides electromagnetic shielding. The half-cut dielectric resonator 10*a* is of a selected D/L ratio, as described above, for operation as either a dual-mode or dual-band resonator, and is planar mounted on mounting support 52*a* formed from a unitary piece of suitable low-permittivity dielectric substrate (e.g. $\in_r \leqq 10$). For example, the mounting support 52*a* is formed of Teflon. Resonator cavity 50*b* is located adjacent to resonator cavity 50*a* and encloses half-cut dielectric resonator 10*b* planar mounted on mounting support 52*b* formed in a unitary piece of the same low-permittivity dielectric substrate. In some embodiments, half-cut dielectric resonators 10*a*, 10*b* have the same selected dimensions. In other embodiments, however, these dimensions may differ. Resonator cavities 50*a*, 50*b* also have the same dimensions in some embodiments, and different dimensions in some embodiments.

A suitable aperture or iris defined in the common wall between resonator cavities 50*a*, 50*b* is used to couple either or both resonant modes of half-cut dielectric resonator 10*a* to corresponding resonant modes of the half-cut dielectric resonator 10*b*. The general shape of the aperture determines the resonant mode or modes that are coupled, and its size determines the amount of coupling. This result is intuitive by considering that the aperture behaves like a waveguide subject to cutoff, which consequently passes only one field polarization. The polarization of a resonant mode is therefore a relevant factor in selecting the shape and size of the aperture, and polarization-discriminant apertures can be designed for each resonant mode of the half-cut dielectric resonator 10.

Figure 5A:
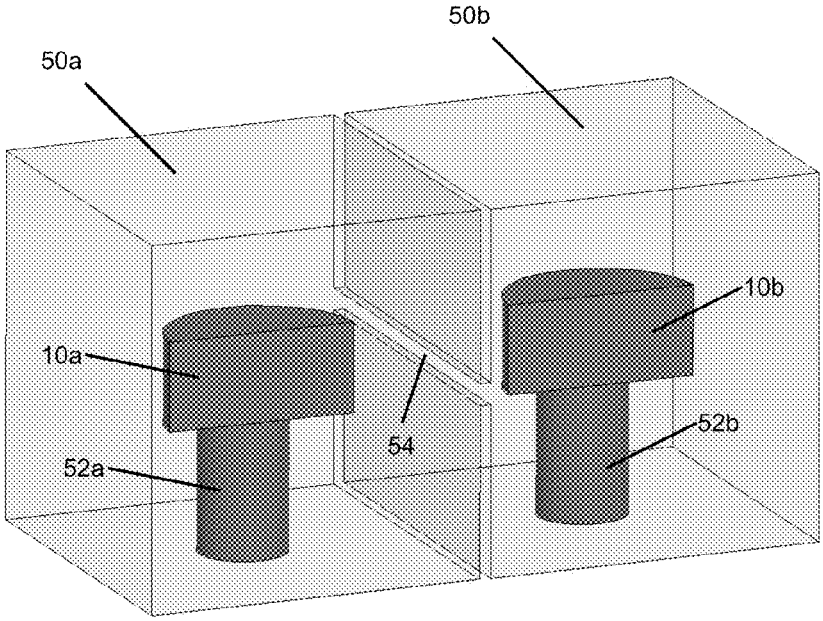
FIG. 5A is a perspective view of an exemplary inter-cavity coupling of two half-cut dielectric resonator assemblies.
Figure 5B:
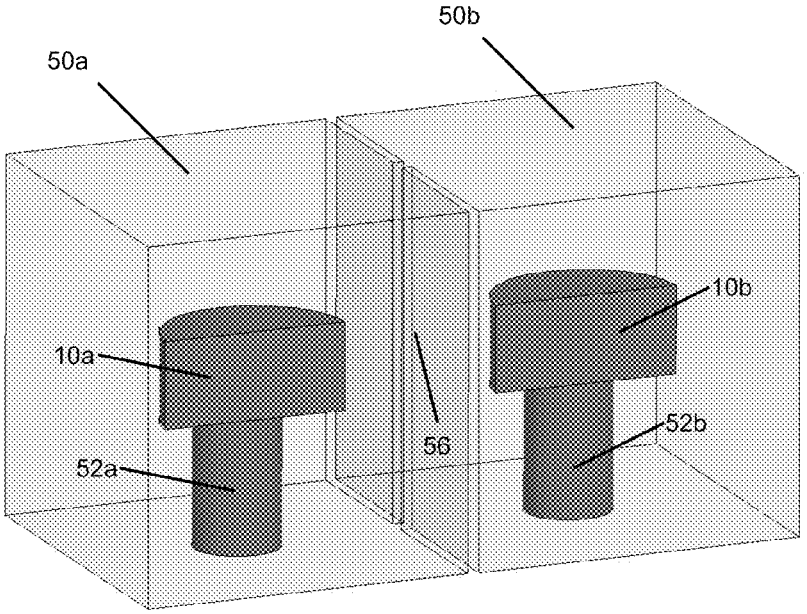
FIG. 5B is a perspective view of another exemplary inter-cavity coupling of two half-cut dielectric resonator assemblies.
Figure 5C:
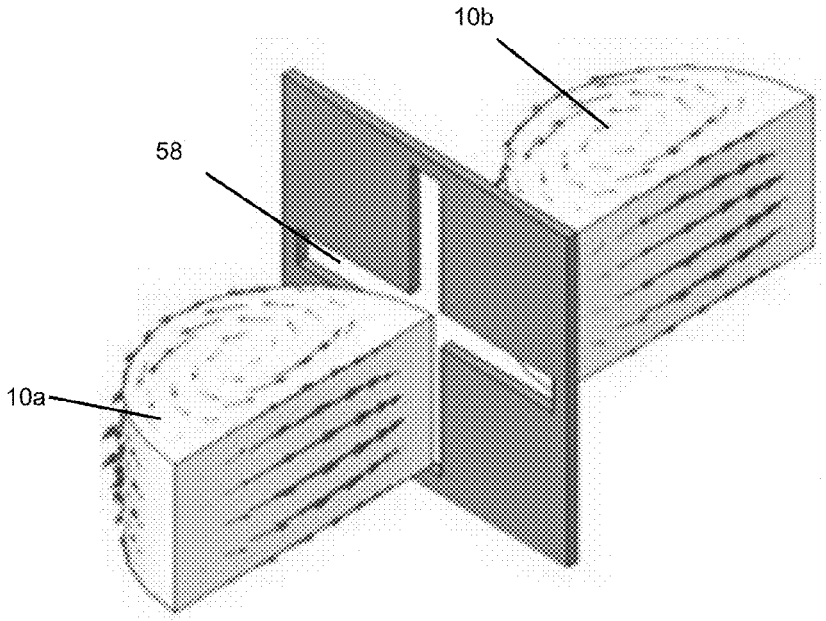
FIG. 5C is a perspective view of another exemplary inter-cavity coupling of two half-cut dielectric resonator assemblies for the ½$HEH_{11}$ resonant mode.
Figure 5D:
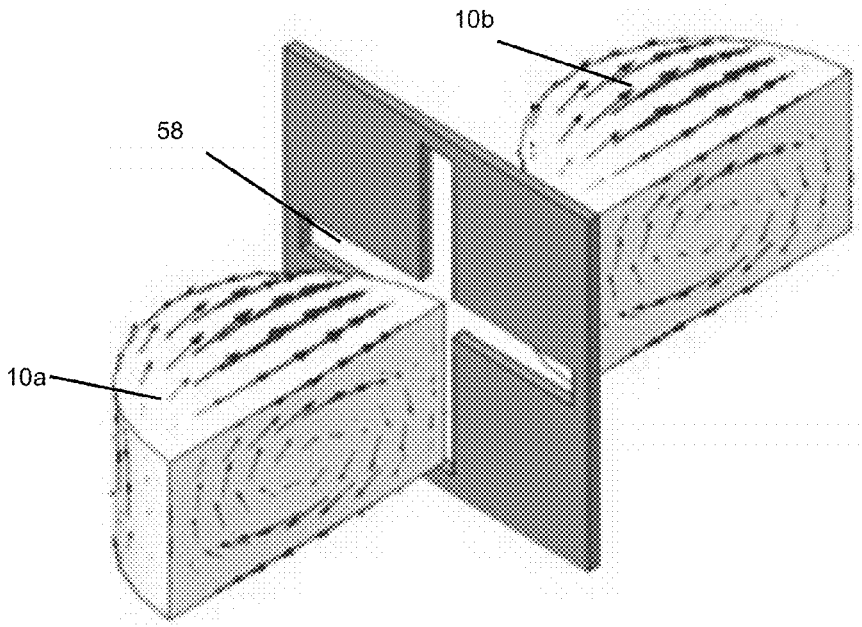
FIG. 5D is a perspective view of the exemplary inter-cavity coupling of two half-cut dielectric resonators of FIG. 5C for the ½$HEE_{11}$ resonant mode.

The horizontal iris 54 shown in FIG. 5A couples the $\frac{1}{2}HEE_{11}$ mode, while substantially rejecting the $\frac{1}{2}HEH_{11}$ mode. Opposite to this action, the vertical iris 56 shown in FIG. 5B couples the $\frac{1}{2}HEH_{11}$ mode, while substantially rejecting the $\frac{1}{2}HEE_{11}$ mode. Alternatively, the cross-shaped iris 58 shown in FIGS. 5C and 5D, which includes both a horizontal and a vertical iris component, couples and provides largely independent control over both the $\frac{1}{2}HEH_{11}$ and $\frac{1}{2}HEE_{11}$ resonant modes. The vertical component of cross-shaped iris 58 couples the $\frac{1}{2}HEH_{11}$ mode (FIG. 5C), while the horizontal component couples the $\frac{1}{2}HEE_{11}$ mode (FIG. 5D). The dimensions of each component of cross-shaped iris 58 can be independently varied to provide essentially independent control over the amount of coupling of each respective resonant mode. For greater clarity, the vertical component of cross-shaped iris 58 can be sized to provide a desired amount of coupling of the $\frac{1}{2}HEH_{11}$ mode, and the horizontal component of cross-shaped iris 58 can be sized to provide a desired amount of coupling to the $\frac{1}{2}HEE_{11}$ mode. The respective dimensions of the vertical and horizontal components do not necessary have to be same. One mode can therefore be coupled by a greater amount than the other, if desired. As an alternative to cross-shaped iris 58, one diagonally slanted iris (not shown) may be used to couple both resonant modes simultaneously. In general, any suitably shaped inter-cavity aperture may be used to couple resonant modes of adjacent half-cut dielectric resonators.

The coupling coefficient of two adjacent resonators can be determined according to different approaches. One approach is to solve the frequencies of the first two eigenmodes of the full-coupled structure. The coupling coefficient is then given by $$k \approx \frac{f_2 - f_1}{f_2}, \tag{1}$$

where $f_1$ and $f_2$ are the first and second resonant frequencies of the full-coupled structure. This approach can be extended for the case of a dual-band filter by solving the frequencies of the first four eigenmodes of the full-coupled structure. The coupling coefficient of the lower band is given by Eq. 1, and the coupling coefficient of the upper band is similarly given by $$k' \approx \frac{f_4 - f_3}{f_4}, \tag{2}$$

where $f_3$ and $f_4$ are the resonant frequencies of the third and fourth eigenmodes of the full-coupled structure.

In an alternative approach, computational complexity can be reduced by exploiting symmetry in the full-coupled structure and employing even-odd mode analysis. A symmetry plane is placed half way between the two resonators through the middle of the cross-shaped iris 58. The symmetry plane simulates an ideal magnetic wall in even-mode analysis and an ideal electric wall in odd-mode analysis. The coupling coefficient, k, is then given by $$k = \frac{f_e^2 - f_m^2}{f_e^2 + f_m^2}, \tag{3}$$

where $f_m$ and $f_e$ are the even-mode and odd-mode resonant frequencies of the full-coupled structure, respectively. The same calculation can be performed to determine the coupling coefficient, k', for the upper band of a dual-band.

Yet another approach to determining coupling coefficients is the S-parameter approach (e.g. described in R. Cameron, C. Kudsia & R. Mansour, *Microwave Filters for Communication Systems*. Hoboken, N.J.: John Wiley & Sons, Inc., 2007). The inter-cavity aperture is modeled as a discontinuity between two transmission lines (corresponding to the two resonator cavities). The coupling coefficient, k, can then be determined by transforming the solved S-parameters of the waveguide discontinuity into an equivalent T-network comprising a shunt impedance inverter. The coupling coefficient is then derived from the inverter impedance.

Once the coupling coefficient, k, has been determined, for example using one of the above-described approaches, dimensions for the inter-cavity aperture (width, height, thickness) can be swept in order to design a suitable iris 54, 56, 58 that provides the desired amount of inter-cavity coupling of adjacent resonators. Clearly this procedure can be repeated for a plurality of adjacent resonator cavities inter-connected by apertures. The coupling-matrix approach to filter synthesis (described in *Microwave Filters*) would then involve designing each iris in the synthesized filter to provide the required amount of coupling as specified in M matrix derived under that approach. Advanced filter synthesis is greatly simplified by the largely independent control over inter-cavity coupling provided by the half-cut dielectric resonator 10.

Figure 6A:
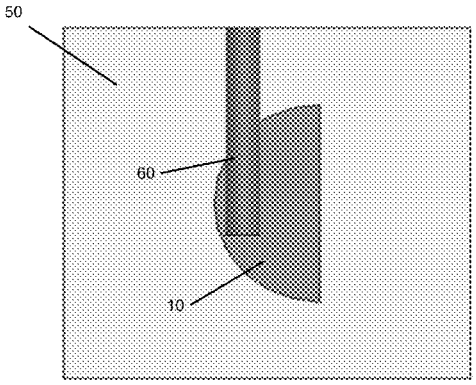
FIG. 6A is a top view of an exemplary half-cut dielectric resonator assembly with intra-cavity mode coupling.
Figure 6B:
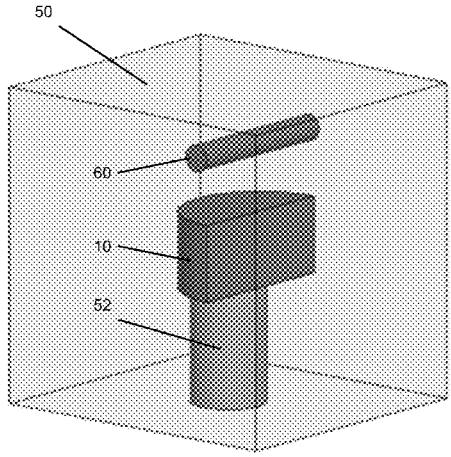
FIG. 6B is a perspective view of the exemplary half-cut dielectric resonator assembly of FIG. 6A with intra-cavity mode coupling.

Reference is now made to FIGS. 6A-6B, which illustrate top and perspective views of an exemplary half-cut dielectric resonator assembly with intra-cavity mode coupling, according to aspects of embodiments of the present invention. Similar to before, half-cut cylindrical dielectric resonator 10 is mounted on mounting support 52 inside resonator cavity 50 so as to not directly contact the inner walls of resonator cavity 50, which comprises a metallic housing and provides electromagnetic shielding. The mounting support 52 is again formed from a unitary piece suitable low-permittivity dielectric substrate.

Screw 60 is fastened to an inner wall of the resonator cavity 50 and projects interiorly into the cavity. In the presence of electromagnetic fields, and depending on its location, screw 60 attracts fields of one resonant mode and causes them to leak over into other resonant modes, thereby providing a mechanism for intra-cavity coupling of resonant modes. It should be appreciated that screw 60 is formed out of metal in some embodiments, but that other materials may be substituted in other embodiments. When fastened directly to the inner walls of the resonator cavity 50, metals screws can sometimes give rise to unwanted propagation of a coaxial mode within the resonator cavity 50. To suppress this spurious resonance mode, therefore, a dielectric-metal screw can be used instead of a metal screw so that direct metal-to-metal contact with the inner wall of the resonator cavity 50 is avoided. It should also be appreciated that the shape of screw 60 is variable, and that rods, poles and other general forms of projections of varying lengths and widths may be substituted.

Screw 60 offers a convenient and controllable mechanism for coupling the orthogonal $\frac{1}{2}HEH_{11}$ and $\frac{1}{2}HEE_{11}$ modes of the half-cut dielectric resonator 10. As eigenmodes of the structure, the natural field distributions of $\frac{1}{2}HEH_{11}$ and $\frac{1}{2}HEE_{11}$ modes do not appreciably interact or couple. However, a screw 60 located appropriately within the resonator cavity 50 will disturb the natural field distributions of $\frac{1}{2}HEH_{11}$ and $\frac{1}{2}HEE_{11}$ modes simultaneously, and thereby couple these two orthogonal and otherwise non-interactive modes. Areas within resonator cavity 50 in which the E fields of both the $\frac{1}{2}HEH_{11}$ and $\frac{1}{2}HEE_{11}$ mode are concentrated provide suitable locations for the screw 60. At these locations, corresponding interactive E fields will be created in the screw 60, the effect of which is to couple the two resonant modes. However, as will be described in more detail below, the amount of coupling is variable depending on the dimensions, as well as the location and orientation, of the screw 60.

Screw 60 can also be located within the resonator 50 so that only the field distributions of one resonant mode of the half-cut dielectric resonator 10 are substantially perturbed. To the field distributions of the other resonant mode, the screw 60 will appear non-existent. Screw 60 can therefore be located so as to perturb the field distributions of the $\frac{1}{2}HEH_{11}$ mode only, while the $\frac{1}{2}HEE_{11}$ mode largely unaffected; and likewise, so as to perturb the field distributions of the $\frac{1}{2}HEE_{11}$ mode only, while leaving the $\frac{1}{2}HEH_{11}$ mode largely unaffected. Perturbing the field distributions of a resonant mode will cause a small shift in the resonant frequency of that mode, either up or down, which may be useful to tune the resonant frequency of that mode. Often tuning screws are required to tune the resonant frequency of a cavity to its designed centre frequency. Exactly sized resonators are normally hard to achieve and some tolerance in the resonator's dielectric constant should be expected. Thus a practical resonator will often not realize its designed centre frequency without the aid of tuning screws. It should be appreciated, however, that the centre frequency is still predominantly determined by the dimensions of the resonator and cavity, and that tuning screws only provide a mechanism for making slight corrections in order to re-align the resonator's centre frequency with its designed value.

Figure 6C:
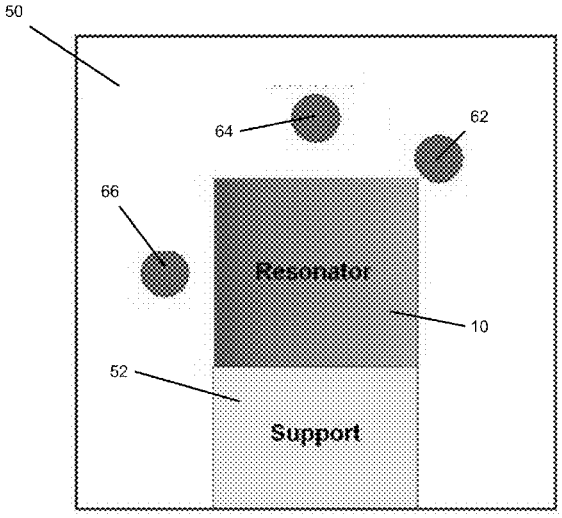
FIG. 6C is a front view of an exemplary half-cut dielectric resonator assembly with tuning and intra-cavity mode coupling.
Figure 6D:
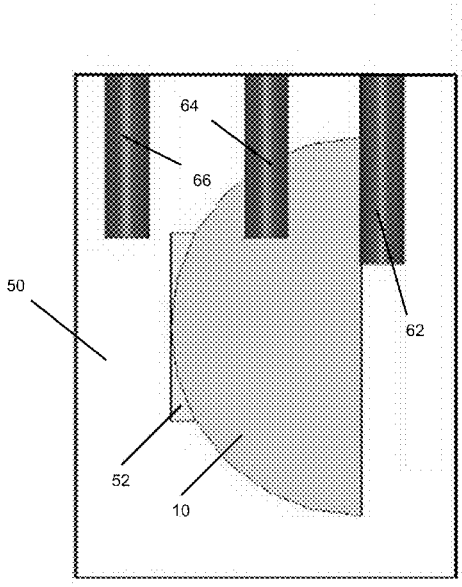
FIG. 6D is a top view of the exemplary half-cut dielectric resonator assembly of FIG. 6C with tuning and intra-cavity mode coupling.

Reference is now made to FIGS. 6C and 6D, which illustrate front and top views of an exemplary half-cut dielectric resonator assembly with intra-cavity coupling and tuning, according to aspects of embodiments of the present invention. Resonator cavity 50 encloses half-cut dielectric resonator 10, which is again planar mounted on mounting support 52. Fastened to the inner walls of resonator cavity 50 are coupling screw 62 and tuning screws 64, 66. Coupling screw 62 is located diagonally offset and adjacent to the upper straight edge 20 of half-cut dielectric resonator 10. In this location, coupling screw 62 couples the $\frac{1}{2}HEH_{11}$ and $\frac{1}{2}HEE_{11}$ resonant modes.

The amount of intra-cavity resonant mode coupling provided by coupling screw 62 is variable depending its dimensions and location. For example, the distance and angle of the coupling screw 62 relative to the upper straight edge 20 affect the amount of coupling provided. Moving the coupling screw 62 diagonally further away from the half-cut resonator 10 will tend to decrease the amount of coupling provided, and vice versa. Moving the coupling screw 62 horizontally toward the centre of semi-circular surface 12 or vertically toward the centre of rectangular surface 18 will also tend to decrease the amount of coupling provide as the field distributions in these locations tend to be concentrated in one or the other resonant mode only. Accordingly, field mode interaction decreases in both directions. Good coupling of the $\frac{1}{2}HEH_{11}$ and $\frac{1}{2}HEE_{11}$ resonant modes is achieved by locating the coupling screw 62, as shown in FIG. 6C, just diagonally offset from and adjacent to the half-cut resonator 10, where the field distributions of these two resonant modes are more than just weakly interactive.

In addition to its location and orientation within the resonator cavity 50, the dimensions of coupling screw 62 also affect the amount of intra-cavity resonant mode coupling provided by coupling screw 62. Coupling can generally be increased by providing longer and thicker couplings screws.

Tuning screw 64 is positioned above the centre of semi-circular surface 12 and tuning screw 66 is positioned adjacent the centre of curved surface 14. As there is no more than weak interaction between the $\frac{1}{2}HEH_{11}$ and $\frac{1}{2}HEE_{11}$ modes in these locations, tuning screws 64, 66, unlike coupling screw 62, do not provide an appreciable amount of intra-cavity mode coupling. Instead tuning screws 64, 66 provide largely independent tuning of the ½$HEE_{11}$ and ½$HEH_{11}$ modes, respectively. The field distribution of the ½$HEE_{11}$ mode is concentrated above the centre of semi-circular surface 12 where tuning screw 64 is located. Accordingly, tuning screw 64 is used to tune the resonant frequency of the ½$HEE_{11}$ mode. Likewise, tuning screw 66 is located adjacent the centre of curved surface 14, where the field distribution of the ½$HEH_{11}$ mode is concentrated, and serves the same purpose for the ½$HEH_{11}$ mode. Independent or near independent resonant mode tuning is possible because the orthogonal field mode distributions of the two resonant modes are relatively non-interactive in the vicinity of each tuning screw 64, 66.

Figure 6E:
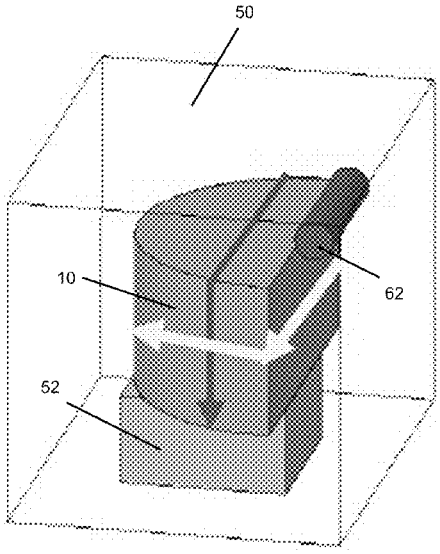
FIG. 6E is a perspective view of an exemplary half-cut dielectric resonator assembly with positive mode intra-cavity mode coupling.
Figure 6F:
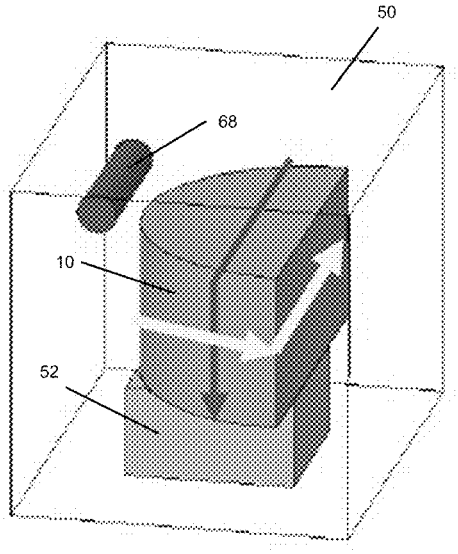
FIG. 6F is a perspective view of an exemplary half-cut dielectric resonator assembly with negative mode intra-cavity coupling.

Reference is now made to FIGS. 6E and 6F, which illustrate perspective views of exemplary half-cut dielectric resonator assemblies with intra-cavity coupling, according to aspects of embodiments of the present invention. Coupling screw 62 (shown again FIG. 6E) is located as before diagonally offset from the upper straight edge 20 of the half-cut dielectric resonator 10. Coupling screw 68 however has been shifted laterally across the semi-circular surface 12 to the other side of the half-cut dielectric resonator 10, where it is positioned diagonally offset from the curved edge 16. Shifting the location of the coupling screw from one side of the half-cut dielectric resonator 10 to the other reverses the polarity of the coupling. As indicated by the directions of the white and grey arrows, leakage from the ½$HEE_{11}$ mode (grey arrow) into the ½$HEH_{11}$ mode (white arrow) circulates in one direction for coupling screw 62 and the opposite direction for coupling screw 68. It should be appreciated that moving the coupling screw 62 down toward the lower straight edge 20 of the half-cut dielectric resonator 10 will also reverse the polarity of the coupling relative to that reference location. Both positive and negative mode coupling of the half-cut dielectric resonator 10 are thus possible, when two of such cavities are coupled via an appropriate iris. Having control over the polarity of the cross-coupling can be important for the proper placement of transmission zeros in the realized filter, as discussed in greater detail below.

The same process followed for determining the coupling coefficient with respect to inter-cavity mode coupling can be followed as well for intra-cavity mode coupling. Joint simulation of the half-cut dielectric resonator 10, resonator cavity 50 and coupling screw 62 using an eigenmode solver can be used to solve the first two resonant frequencies of the coupled structure. Tuning screws 64, 66 may be omitted from the simulation as they compensate for non-ideal effects in real resonators. The coupling coefficient, k, is then given again by Eq. 1. If desired, the coupling coefficient, k', can also be solved according to Eq. 2. It should be appreciated that even-odd mode analysis may not be available here due to lack of symmetry in the resonator cavity 50. S-parameter analysis may be performed but with added complexity as coupling here is between two resonant modes of a single physical resonator. Once the coupling coefficient, k, has been determined, parameters of the coupling screw 62 (length, diameter, etc.) can be swept using an appropriate solver (and, if necessary, interpolated) in order to design a coupling screw that provides the desired amount of intra-cavity coupling. This procedure can be repeated as required in the coupling matrix approach to filter synthesis.

Figure 7A:
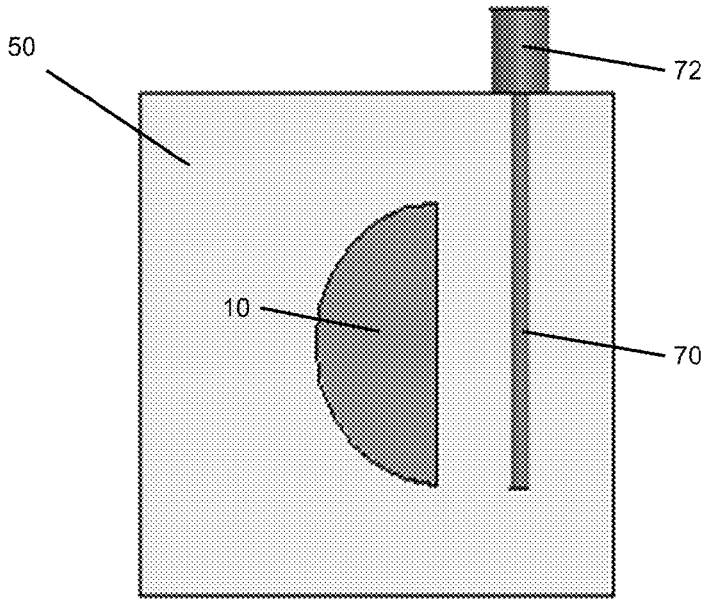
FIG. 7A is a top view of an exemplary half-cut dielectric resonator assembly with input-output coupling.
Figure 7B:
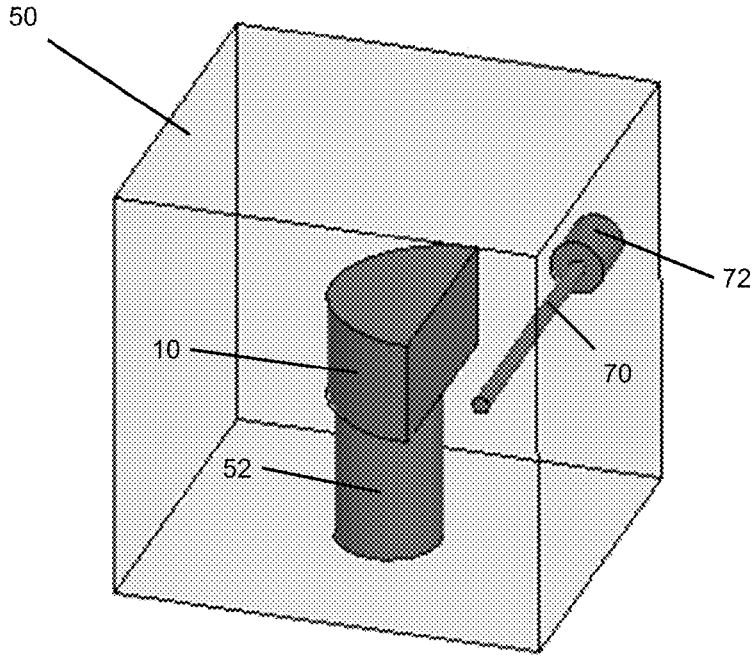
FIG. 7B is a perspective view of the half-cut dielectric resonator assembly of FIG. 7A with input-output coupling.

Reference is now made to FIGS. 7A and 7B, which illustrate top and perspective views of an exemplary half-cut dielectric resonator filter assembly with input-output coupling, according to aspects of embodiments of the present invention. Input and output mode coupling can be provided using a similar arrangement as the coupling screw 62 used to provide intra-cavity mode coupling. An electromagnetic probe 70 is fed through a small opening in one of the walls of resonator cavity 50 to project interiorly into resonator cavity 50 in like fashion to coupling screw 62. External connector 72 is in electrical contact with electromagnetic probe 70 and is used to make a connection with an external coaxial cable or other transmission medium for microwave and RF signals. The half-cut dielectric resonator 10 is again planar mounted on mounting support 52 inside resonator cavity 50 so that half-cut dielectric resonator 10 is not in direct contact with the inner walls of resonator cavity 50.

Depending on the location and orientation of electromagnetic probe 70, one of the ½$HEH_{11}$ and ½$HEE_{11}$ modes can be coupled to the external connector 72 independently of the other mode. Alternatively both the ½$HEH_{11}$ and ½$HEE_{11}$ modes can be coupled simultaneously to the external connector 72. The location and orientation of electromagnetic probe 70 within the resonator cavity 50 affects the amount of coupling of each resonant mode. In general, the electromagnetic probe 70 will couple a resonant mode of the half-cut dielectric resonator 10 when the field distribution of that resonant mode is concentrated in the immediate vicinity. Simultaneous coupling of both the ½$HEH_{11}$ and ½$HEE_{11}$ modes is achieved by locating the electromagnetic probe 70 diagonally away from the upper straight edge 20 of the half-cut dielectric resonator 10. As with the coupling screw 62, the field distributions of both resonant modes are concentrated in this area. Moving the electromagnetic probe 70 diagonally closer to or away from the straight edge 20 again will increase or decrease the amount coupling of the ½$HEH_{11}$ and ½$HEE_{11}$ modes.

The orthogonality of the ½$HEH_{11}$ and ½$HEE_{11}$ resonant modes permits electromagnetic probe 70 to be located so as to selectively couple only one resonant mode independently of the other. As illustrated in FIG. 7B, for example, electromagnetic probe 70 is parallel to and adjacent to the centre of the rectangular surface 18 where the field distribution of the ½$HEH_{11}$ mode is concentrated. In that location, electromagnetic probe 70 couples the ½$HEH_{11}$ mode, while isolating the ½$HEE_{11}$ mode. A similar result is achieved by locating the electromagnetic probe 70 adjacent the centre of the curved surface 14 on the other side of the half-cut dielectric resonator 10 (where tuning screw 66 is shown in FIG. 6C), but subject to polarity reversal. On the other hand, by locating the electromagnetic probe 70 parallel to and above the centre of the semi-circular surface 12 (where tuning screw 64 is shown if FIG. 6C), the ½$HEE_{11}$ mode will be coupled, while the ½$HEH_{11}$ mode will be isolated. Only the field distribution of the ½$HEE_{11}$ mode is concentrated in that area of the cavity 50. Locating the electromagnetic probe 70 in intermediate positions is also possible and will achieve some unbalanced coupling of each resonant mode.

Figure 7C:
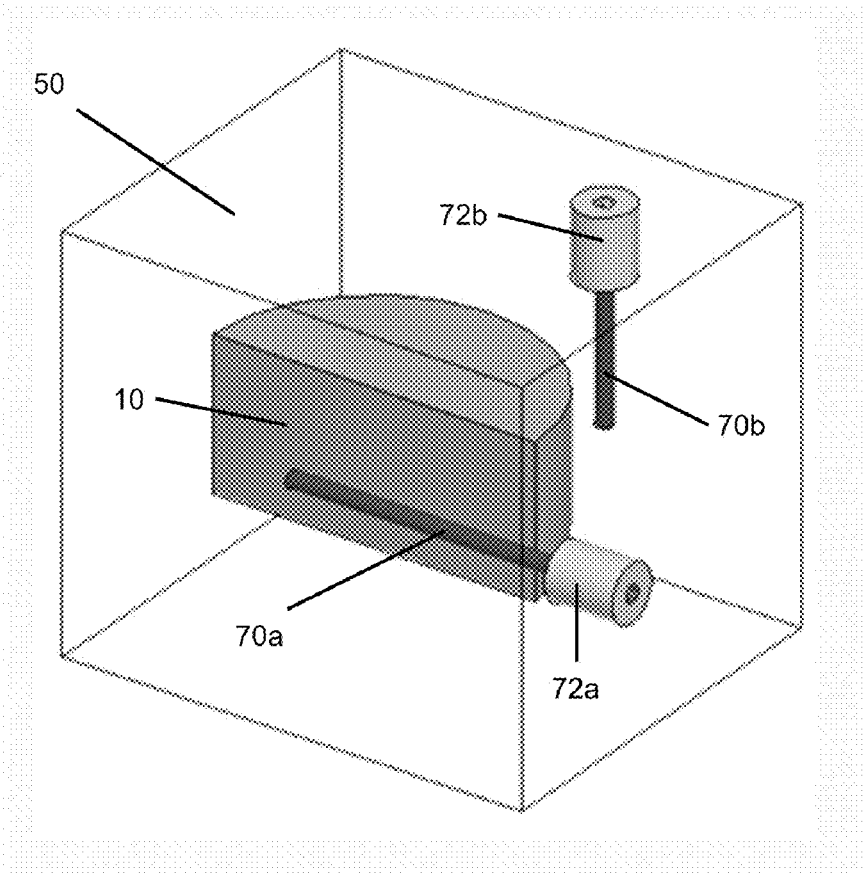
FIG. 7C is a perspective view of another exemplary half-cut dielectric resonator assembly with input-output coupling.

Reference is now made to FIG. 7C, which illustrates a perspective view of another exemplary half-cut dielectric resonator filter assembly with input-output coupling, according to aspects of embodiments of the present invention. Different orientations of the electromagnetic probe 70, relative to the half-cut dielectric resonator 10, can also be used to provide increased mode isolation. Electromagnetic probe 70*a* is oriented horizontally, similar to electromagnetic probe 70 in FIGS. 7A and 7B, for coupling the ½$HEH_{11}$ mode to external connector 72*a*. However, the electromagnetic probe 70*b* is oriented vertically, as opposed to horizontally, for coupling the ½$HEE_{11}$ mode to external connector 72*b*. When coupling the ½$HEE_{11}$ mode to the external connector 72*b*, orienting the electromagnetic probe 70*b* vertically adjacent to the curved surface 14, as opposed to horizontally above the semi-circular surface 12, better isolates of the ½$HEH_{11}$ mode. For that particular orientation, the field distributions of the $\frac{1}{2}HEH_{11}$ mode are even less interactive. Output mode isolation is a potentially relevant design consideration in single cavity resonator filters (where input and output channels are located in the same physical cavity) as well as diplexers and higher order multiplexers (where multiple output channels may be located in the same physical cavity).

In addition to its location and orientation with resonator cavity 50, similar to the coupling screw 62, the dimensions (length, thickness) of electromagnetic probe 70, 70*a*, 70*b* affect the amount of input-output coupling of half-cut dielectric resonator 10. Longer and thicker tend to achieve greater mode coupling. Full wave solvers, may be used to solve dimensions and an orientation for the electromagnetic probe 70, 70*a*, 70*b* to achieve a desired amount of input/output coupling according to design specifications.

Figure 8A:
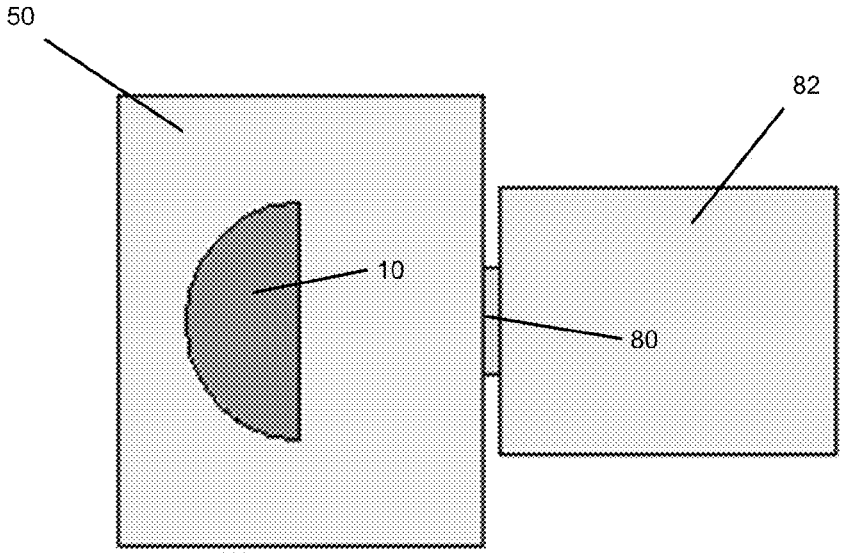
FIG. 8A is a top view of another exemplary half-cut cylindrical dielectric resonator assembly with input-output coupling.
Figure 8B:
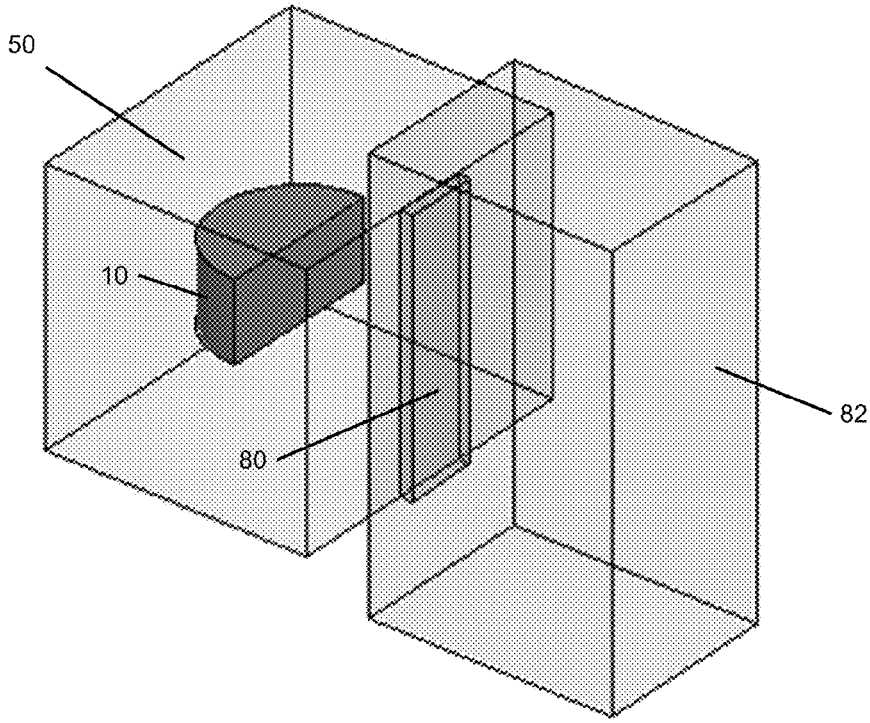
FIG. 8B is a perspective view of the half-cut cylindrical dielectric resonator assembly of FIG. 8A with input-output coupling.

Reference is now made to FIGS. 8A and 8B, which illustrate top and perspective views of another exemplary half-cut dielectric resonator assembly with input-output coupling, according to aspects of embodiments of the present invention. As an alternative to the electromagnetic probe 70, shown in FIGS. 7A and 7B, input and output mode coupling can be provided instead by a waveguide aperture 80 connecting resonator cavity 50 to input waveguide 82. Previous discussion in the context of polarization discriminant irises for providing inter-cavity coupling applies also to waveguide aperture 80, and thus will not be repeated in detail. To reiterate, by including a predominantly vertical component (as shown) in the waveguide aperture 80, the $\frac{1}{2}HEH_{11}$ mode will be coupled, while substantially isolating the $\frac{1}{2}HEE_{11}$ mode. Alternatively, by including a predominantly horizontal component, the $\frac{1}{2}HEE_{11}$ mode will be coupled, while substantially isolating the $\frac{1}{2}HEH_{11}$ mode. Alternatively, where the waveguide aperture 80 includes both a substantial horizontal component and a substantial vertical component, such as when waveguide aperture 80 is approximately square-shaped, both the $\frac{1}{2}HEH_{11}$ and $\frac{1}{2}HEE_{11}$ modes will be coupled to the input waveguide 82. Other configurations and shapes for the waveguide aperture 80 are possible as well. The amount of input-output coupling is determined by the dimensions (height, width, thickness, etc.) and orientation of the waveguide aperture 80. Analytic models and mode charts, refined with full wave solvers, may be used to solve its dimensions to meet design specifications.

Figure 9A:
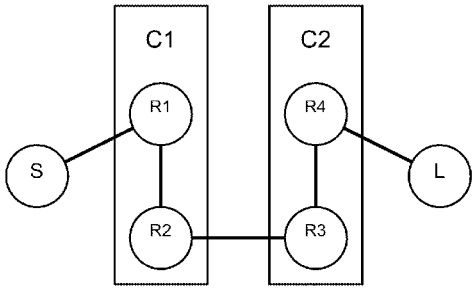
FIG. 9A is a schematic illustration of an exemplary coupling scheme for a dielectric resonator filter.
Figure 9C:
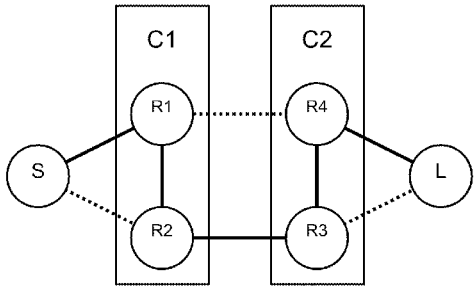
FIG. 9C is a schematic illustration of another exemplary coupling scheme for a dielectric resonator filter.
Figure 9B:
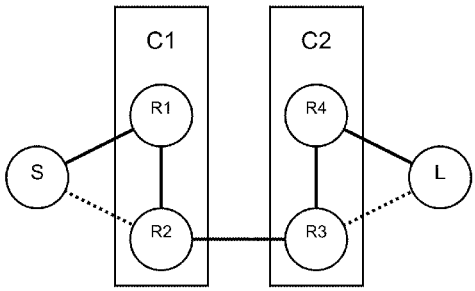
FIG. 9B is a schematic illustration of another exemplary coupling scheme for a dielectric resonator filter.

Reference is now made to FIGS. 9A-9D, which schematically illustrate exemplary coupling schemes for a 4-pole dielectric resonator filter, according to aspects of embodiments of the present invention. The above-described inter-cavity, intra-cavity and input-output mode coupling mechanisms provide the necessary elements for synthesizing advanced coupling schemes for dielectric resonator filters. Coupling schemes for both straight and folded resonator configurations are achievable. FIGS. 9A-9C illustrate some exemplary coupling schemes for a 4-pole dielectric resonator filter, in which: S designates the source, L designates the load, and R1-R4 designate four resonators located in cavities C1 and C2. More specifically, cavity C1 encloses a first half-cut dielectric resonator whose $\frac{1}{2}HEH_{11}$ and $\frac{1}{2}HEE_{11}$ modes respectively provide resonators R1 and R2, while cavity C2 encloses a second half-cut dielectric resonator whose $\frac{1}{2}HEE_{11}$ and $\frac{1}{2}HEH_{11}$ modes respectively provide resonators R3 and R4. Accordingly, resonators R1 and R4 resonate in the same mode, as do resonators R2 and R3. Cavities C1, C2 are also located in close physical proximity to allow for inter-cavity coupling using an appropriate inter-cavity aperture.

The coupling scheme illustrated in FIG. 9A corresponds to a folded 4-pole dielectric resonator filter. Input coupling (S-R1) and output coupling (R4-L) are realized using appropriately positioned electromagnetic probes 70 that couple the $\frac{1}{2}HEH_{11}$ mode of resonators R1 and R4, respectively, while isolating the $\frac{1}{2}HEE_{11}$ modes. For example, electromagnetic probes 70 can be aligned horizontally adjacent to the centre of rectangular surface 18 of the half-cut dielectric resonator 10. Intra-cavity mode coupling (R1-R2 and R3-R4) is realized using appropriately positioned coupling screws 62, for exampled aligned diagonally adjacent to the upper straight edge 20 of each half-cut dielectric resonator 10. Inter-cavity mode coupling (R2-R3) is achieved using a suitably shaped iris that couples the $\frac{1}{2}HEE_{11}$ mode of R2 and R3, while rejecting the $\frac{1}{2}HEH_{11}$ mode. A horizontal iris 54 of selected dimensions for example would be appropriate. According to this exemplary coupling scheme, resonators R1-R4 are coupled as in a folded 4-pole dielectric resonator.

As the resonators R1-R4 are arranged in C1, C2 in folded formation, additional mode cross-couplings (dotted lines) can be introduced in order to realize more advanced filters. These additional available cross-couplings may be useful, for example, to control placement of transmission zeros. The exemplary coupling scheme shown in FIG. 9B corresponds to the folded 4-pole coupling scheme of FIG. 9A, but with additional input cross-coupling (S-R2) and output cross-coupling (R3-L). By adjusting the location of the electromagnetic probe 70 in cavity C1, the source S can couple both the $\frac{1}{2}HEH_{11}$ and $\frac{1}{2}HEE_{11}$ modes of the first half-cut dielectric resonator 10 used to realize R1 and R2. Likewise by adjusting the location of the electromagnetic probe 70 in cavity C2, the load L can couple both the $\frac{1}{2}HEE_{11}$ and $\frac{1}{2}HEH_{11}$ modes of the second half-cut dielectric resonator 10 used to realize R3 and R4. For example, the electromagnetic probes may be moved closer to the respective upper straight edges 20 of the first and second half-cut dielectric resonator.

Inter-cavity cross-coupling of adjacent resonators is possible as well. The exemplary scheme shown in FIG. 9C corresponds to the coupling scheme of FIG. 9B, but with additional inter-cavity mode cross-coupling (R1-R4). By using a suitable cross-shaped iris 58, rather than a horizontal iris 54, in between cavities C1 and C2, each of the $\frac{1}{2}HEH_{11}$ and $\frac{1}{2}HEE_{11}$ modes of the first and second half-cut dielectric resonators 10 can be coupled, thereby realizing the exemplary scheme shown in FIG. 9C. Sizing the vertical and horizontal components of the cross-shaped iris 58 can achieve different amounts of couplings of each resonant mode. It should be appreciated that changing the location of an electromagnetic probe or coupling screw or the shape of an inter-cavity aperture are independently controllable and independently affect the amount of cross-coupling that is achievable in the exemplary coupling schemes. These different coupling mechanisms are essentially non-interactive.

Figure 9D:
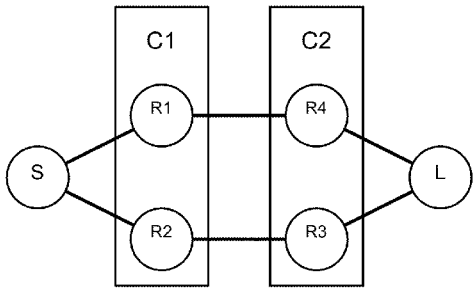
FIG. 9D is a schematic illustration of another exemplary coupling scheme for a dielectric resonator filter.

Alternatively, FIG. 9D illustrates a dual-branch coupling scheme that is also realizable by the inter-cavity, intra-cavity and input-output coupling mechanisms for the half-cut dielectric resonator filter 10. Such a dual-branch coupling scheme provides for effective, controllable and relatively straightforward synthesis of a dual-band filter, wherein the two bands in the dual band are carried by different resonance modes. As in FIGS. 9A-9C, resonators R1 and R4 resonate in the $\frac{1}{2}HEH_{11}$ mode, while resonators R2 and R3 resonate in the $\frac{1}{2}HEE_{11}$ mode, or vice versa. Cavities C1, C2 are also located in close physical proximity to allow for inter-cavity coupling using an appropriate inter-cavity aperture.

Input coupling (S-R, S-R2) is realized using an electromagnetic probe 70 in cavity C1 that couples both the $\frac{1}{2}HEH_{11}$ and $\frac{1}{2}HEE_{11}$ modes simultaneously. Similarly output coupling (R3-L, R4-L) is realized using an electromagnetic probe 70 in cavity C2 that couples both the ½$HEH_{11}$ and ½$HEE_{11}$ modes simultaneously. For example, the electromagnetic probes 70 may be located diagonally adjacent the upper straight edge 20 of each respective half-cut dielectric resonator 10. As each band is carried by a resonator pair resonating in different resonant modes, inter-cavity mode coupling (R1-R4, R2-R3) is provided by a suitable aperture that couples both the ½$HEH_{11}$ and ½$HEE_{11}$ modes simultaneously, e.g. cross-shaped aperture 58 of selected dimensions. No coupling screws 62 are included in this scheme because no intra-cavity cross-coupling of resonant modes (R1-R2 and R3-R4) is needed in the dual-branch scheme. Any number of tuning screws 64, 66 could also be included if desired.

Figure 9E:
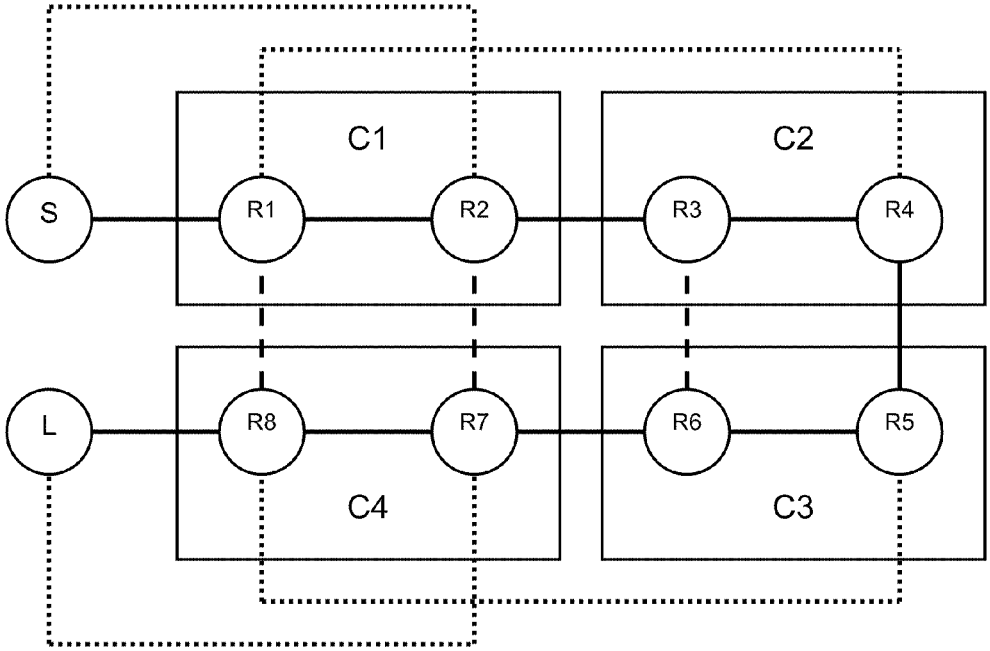
FIG. 9E is a schematic illustration of an exemplary coupling scheme for an 8-pole dielectric resonator filter realized using 4 half-cut dielectric resonators.

Reference is now made to FIG. 9E, which schematically illustrates exemplary coupling schemes for an 8-pole, dielectric resonator filter, according to aspects of embodiments of the present invention. It is evident that the possible coupling schemes for dielectric resonator filters realized using half-cut dielectric resonator 10 can be generalized for any straight or folded 2N-pole, dual-mode filter (or alternatively any straight or folder N-pole, dual-band filter). It should be appreciated that the order of a dual-mode filter constructed from half-cut dielectric resonators 10 will be twice the number of resonators in the realized filter as each operates in a dual-mode, just as the order of a dual-band filter constructed from half-cut dielectric resonators 10 will equal the number of resonators in the realized filter as each operates in a dual-band.

All possible couplings and cross-couplings that are achievable for an 8-pole dielectric resonator filter realized using half-cut dielectric resonators 10 are shown in FIG. 9E. Each cavity C1-C4 encloses a single physical resonator that realizes two resonators in different resonant modes. Specifically, resonators R1 and R2 are realized by a first half-cut dielectric resonator in cavity C1, resonators R3 and R4 by a second half-cut dielectric resonator in cavity C2, resonators R5 and R6 by a third half-cut dielectric resonator in cavity C3, and finally resonators R7 and R8 by a fourth half-cut dielectric resonator in cavity C4. The solid connection lines (S-R1, R1-R2, R3-R4, R4-R 5, R5-R6, R6-R7, R7-R8, R8-L) correspond to the direct couplings in a folded, 8-pole resonator, which also constitute all possible couplings in a straight, 8-pole resonator. The dashed connection lines (R1-R8, R2-R7, R3-R6) correspond to cross-couplings that are possible for the folded, 8-pole resonator. The dotted connection lines (S-R2, R1-R4, R5-R8, R7-L) correspond to additional cross-couplings that are possible by the half-cut dielectric resonator 10 operating in a dual-mode. This generalized coupling scheme for an 8-pole, dual-mode filter can be extended for higher order dual-mode or dual-band filters.

Of course, it should also be appreciated that not every resonator pair can be cross-coupled. For example, resonators R1, R7 although located in adjacent cavities C1, C4 cannot be cross-coupled because resonators R1, R7 are implemented by orthogonal resonant modes. Moreover, resonators R1, R5 although implemented by parallel resonator modes cannot be cross-coupled because resonators R1, R5 are not located in adjacent cavities. In general, orthogonal resonant modes located in the same cavity, as well parallel resonant modes located in adjacent cavities can be cross-coupled. All other resonator pairs cannot. The source and load can also be coupled to each orthogonal resonant mode in the first and last cavity, respectively.

As described herein, the full cylindrical and half-cut dielectric resonators, together with their associated coupling mechanisms, can be used to realize different classes of resonator filters. For example, the full cylindrical dielectric resonator can be used to realize quad-mode resonator filters, while the half-cut dielectric resonator can be used to realize dual-mode resonator filters. Each can also be used to realize dual-band resonator filters, as well as diplexers and higher-order multiplexers. Exemplary realizations of each of these classes of microwave filters will now be described. It should be appreciated, however, that the descriptions to follow are exemplary only and that other possible realizations are within the scope of the disclosure.

Reference is now made to FIGS. 10A-10D, which show various views of exemplary single-cavity, 4-pole resonator filters synthesized using a full cylindrical dielectric resonator operating in a quad-mode, according to aspects of embodiments of the present invention. Dielectric resonator filter 100 comprises full cylindrical dielectric resonator 101 planar mounted on a cylindrical mounting support 152 inside cylindrical cavity 150. The diameter D and length L of cylindrical dielectric resonator 101 are selected so that each component of the dual degenerate $HEH_{11}$ and $HEE_{11}$ modes resonates at a common resonant frequency, thereby providing quad-mode operation. The cylindrical cavity 150 has dimensions of diameter $D_c$ and length $L_c$. Mounting support 152 has diameter $D_s$ and height $L_s$ so that full cylindrical dielectric resonator 101 is axially centered within the cylindrical cavity 150 when mounted. It should be appreciated that full cylindrical dielectric resonator 101 is also mounted on mounting support 152 and is normally radially centered within cylindrical cavity 150.

Input and output coupling are provided using electromagnetic probes 170*a* and 170*b*, respectively, of length $H_p$ and located a distance $X_p$ away from the central axis of the cylindrical cavity 150. Electromagnetic probe 170*a* is in electrical contact with external connector 172*a* and electromagnetic probe 170*b* is in electrical contact with external connector 172*b*, and there is approximately 90 degrees of radial separation between the two electromagnetic probes 170*a*, 170*b*. With that configuration, one component from each of the dual $HEH_{11}$ and $HEE_{11}$ mode pairs aligns with electromagnetic probe 170*a* on the input channel, and is thereby coupled to the external connector 172*a*, while the other component from each of the two mode pairs aligns with electromagnetic probe 170*b* on the output channel, and is thereby coupled to the external connector 172*b*. The amount of input and output mode coupling provided by electromagnetic probes 170*a*, 170*b* is determined predominantly by the length $H_p$ and distance $X_p$, which can be varied to provide different amounts of couplings, as needed, to meet design specifications for the filter 100.

Figure 10A:
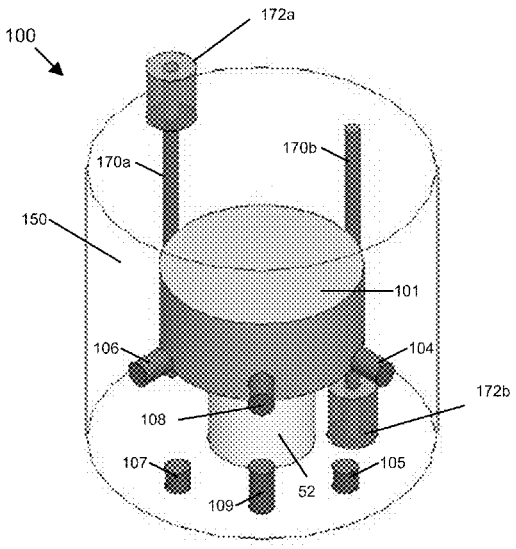
FIG. 10A is a perspective view of an exemplary single-cavity, 4-pole dielectric resonator filter synthesized using a full cylindrical dielectric resonator operating in a quad-mode.
Figure 10B:
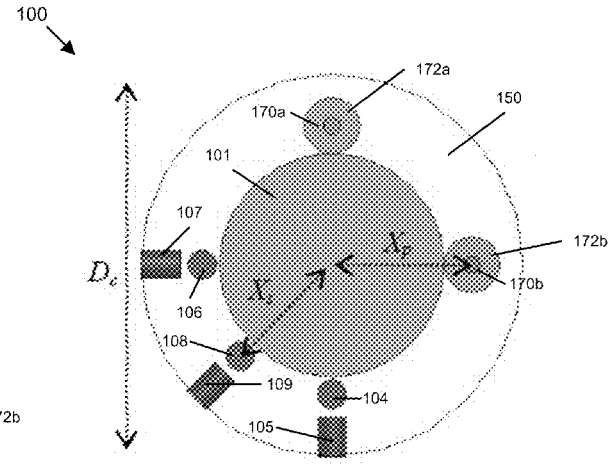
FIG. 10B is a top view of the exemplary single-cavity, 4-pole dielectric resonator filter of FIG. 10A.
Figure 10C:
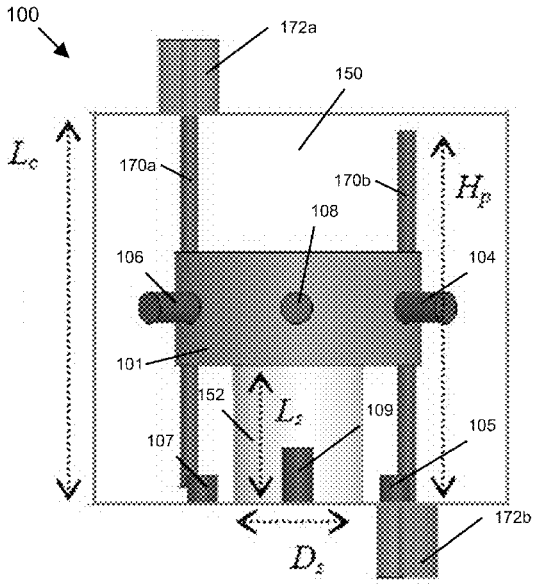
FIG. 10C is a front view of the exemplary single-cavity, 4-pole dielectric resonator filter of FIG. 10A.

As shown in FIG. 10A, electromagnetic probes 170*a*, 170*b* are inserted through small openings in the cylindrical cavity 150 from opposite ends, such that one projects upwardly and the other projects downwardly. In some embodiments, however, both electromagnetic probes 170*a*, 170*b* are located at the same end of the cylindrical cavity 150 to both project downwardly (or upwardly) into the interior of the cavity 150. The dielectric resonator filter 100' shown in FIG. 10D has this configuration of electromagnetic probes 170*a*, 170*b*. The relative orientation of the electromagnetic probes 170*a*, 170*b* affects the number and location of transmission zeros of the realized filter.

Resonant mode coupling and tuning is achieved by inclusion of several tuning and coupling screws in dielectric resonator filter 100. More specifically, screws 104 and 105 located opposite electromagnetic probe 170*a* couple the two mode components (one from each of the $HEH_{11}$ and $HEE_{11}$ mode pairs) that align with electromagnetic probe 170*b*, as well as tune the resonant frequencies of these modes to the center frequency of the quad-mode filter. Likewise, screws 106 and 107 located opposite electromagnetic probe 170*b* couple the two other components of the degenerate $HEH_{11}$ and $HEE_{11}$ mode pairs that align with electromagnetic probe 170*b*, as well as tune the resonant frequencies of these modes to center frequency of the quad-mode filter. Screws 108 and 109 located at 45 degrees from each electromagnetic probe 170*a*, 170*b* couple the two orthogonal mode components from each of the $HEH_{11}$ and $HEE_{11}$ degenerate mode pairs. This arrangement of coupling and tuning screws 104-109, it should be appreciated, provides coupling of the dual $HEH_{11}$ and $HEE_{11}$ mode pairs for operation in a quad-mode. Other screw arrangements are also possible to realize the different mode couplings in the filter.

Screws 104, 106, 108 extend horizontally and radially outward from the circumferential surface of full cylindrical dielectric resonator 1 and are axially centered within the cylindrical cavity 150, equidistant from the top and bottom walls of the cylindrical cavity 102. Screws 105, 107, 109 extend vertically from either the bottom (shown) or top (not shown) of the cylindrical cavity 150 at a radial distance $X_s$ away from the central axis of the cylindrical cavity 150. The amount of tuning and resonant mode coupling provided by screws 104-109 is determined by their respective dimensions and locations within the cylindrical cavity 150. Full wave solvers, may be used in the design and synthesis stages for the filter 100 in order to precisely determine the dimensions and locations of the screws 104-109 to meet design specifications.

Figure 10D:
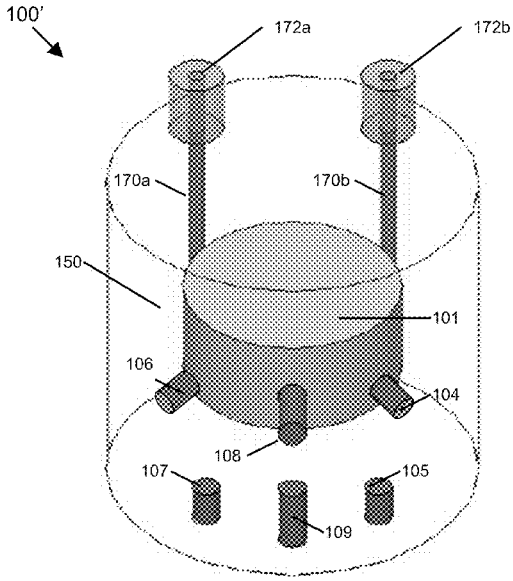
FIG. 10D is a perspective view of another exemplary single-cavity, 4-pole dielectric resonator filter synthesized using a full cylindrical dielectric resonator operating in a quad-mode.
Figure 11A:
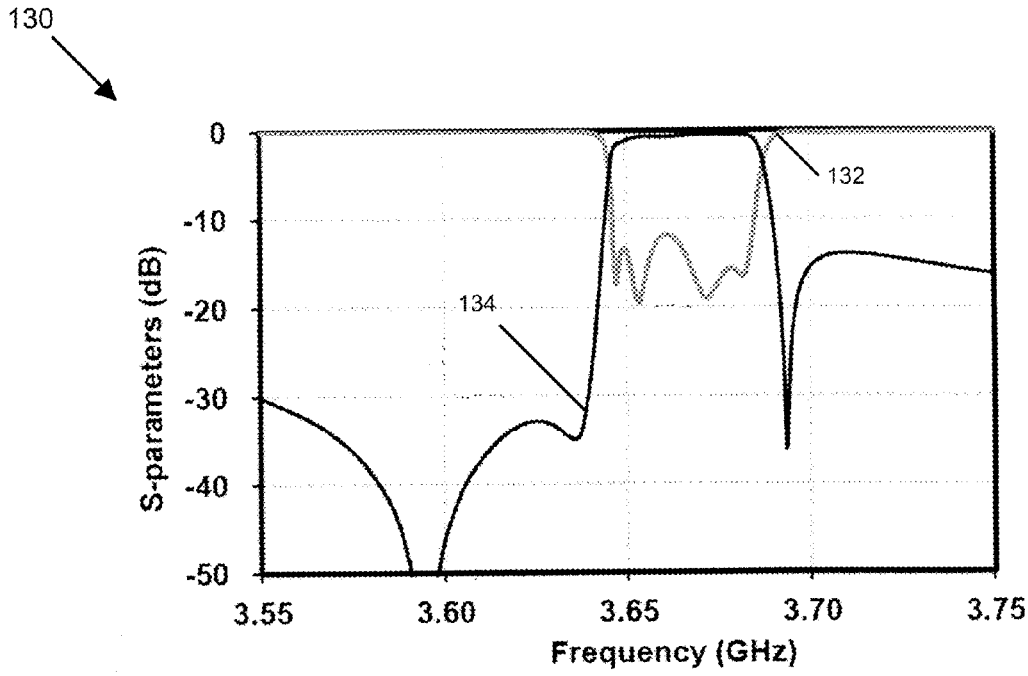
FIG. 11A is a plot of transmissions-parameter response versus frequency for the single-cavity, 4-pole dielectric resonator filter of FIG. 10A.
Figure 11B:
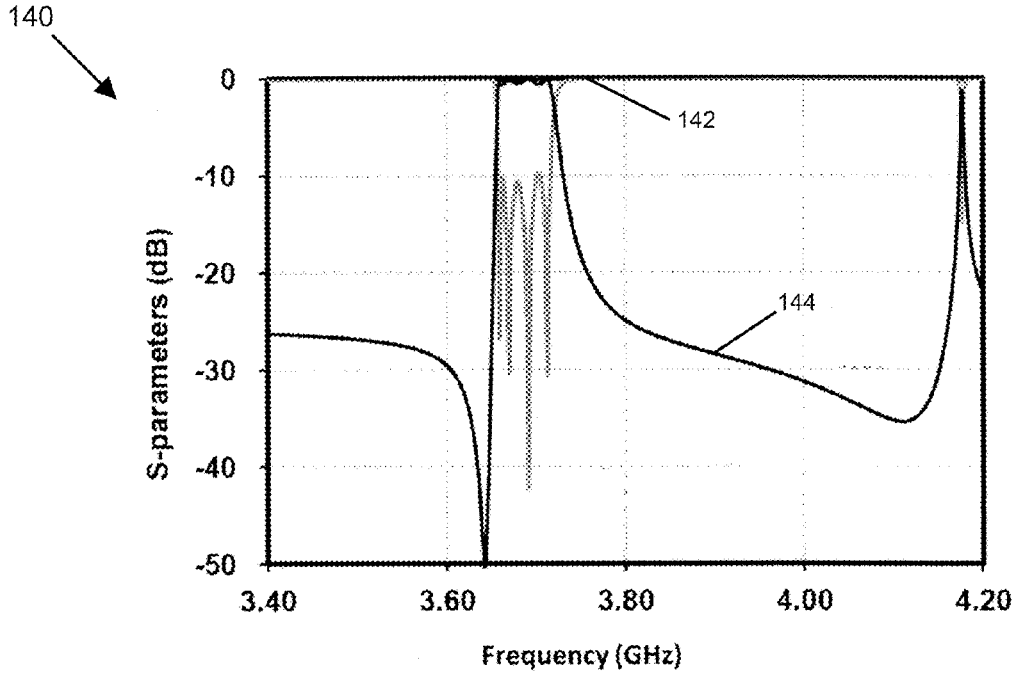
FIG. 11B is a plot of reflection and transmission versus frequency for the single-cavity, 4-pole dielectric resonator filter of FIG. 10D.

Reference is now made to FIGS. 11A and 11B, which show plots of reflection and transmission versus frequency for the single-cavity, 4-pole dielectric resonator filters of FIGS. 10A and 10D. Filter parameters of D=17.145 mm, L=7.747 mm, $D_c$=29.15 mm, $L_c$=27.2 mm, $X_p$=10.57 mm, $H_p$=25 mm, $D_s$=9 mm, and $L_s$=9.73 mm were simulated. Plot 130 corresponds to simulated results for filter 100 (shown in FIGS. 10A-10C), in which curve 132 represents reflection ($S_{11}$) and curve 134 represents transmission ($S_{21}$). Likewise plot 140 corresponds to simulated results for filter 100' (shown in FIG. 10D), in which curve 142 represents reflection ($S_{11}$) and curve 144 represents transmission ($S_{21}$).

It is evident in plot 140 that the passband of the filter 100' only has a steep out of band rejection on the low side, whereas the passband of the filter 100 in plot 130 has a steep out of band rejection on both sides. The improved performance is due to the fact that arranging electromagnetic probes 170*a*, 170*b* at opposite ends of the cylindrical cavity 150, as in filter 100, places transmission zeros on both sides of the passband. In contrast, arranging electromagnetic probes from the same end of cylindrical cavity 150, as in filter 100', only places a single transmission zero on the low side of the passband. The extra transmission zero can be explained the polarity reversal of the output coupling relative to the input coupling, which creates a 180° out of band phase shift that is subtractive, not additive, at the output.

The out of band rejection of the quad-mode filters 100, 100' is also affected by the input and output channels (i.e. electromagnetic probes 170*a*, 170*b*) being located in the same physical cavity (i.e. cylindrical cavity 150). Out of band rejection is normally improved in higher order filters, such as a dual-cavity, 8-pole filters, where the input and output channels are located in physically separate cavities. Another approach to improving out of band rejection is to design a 6-pole filter in which input and output coupling is made to single-mode cavities coupled to a quad-mode cavity, such as the ones illustrated in FIGS. 10A-10D. For example, the single-mode cavities can be operated in the TEH mode. The improvement in out of band rejection is traded off against filter size. Thus, overall the out of band rejection seen in the plots 130 and 140 is satisfactory given the extreme compactness of the filters 100 and 100'.

It should also be appreciated that with suitable modification the quad-mode filters 100, 100' can be converted into dual-mode, dual-band filters. It is recalled that a dual-band filter can be realized using the half-cut dielectric resonator 10 by carrying each band on a separate resonant mode, one on the ½$HEH_{11}$ mode and the other on the ½$HEE_{11}$ mode. The same general concept is applicable to the full cylinder resonating in the degenerate $HEH_{11}$ and $HEE_{11}$ modes. Thus the synthesized filter will additionally be dual-mode. In the filters 100, 110', electromagnetic probe 170*a* couples to one component from each of the $HEH_{11}$ and $HEE_{11}$ modes, while electromagnetic probe 170*b* couples to the other orthogonal component of these dual modes. Moreover, screws 108 and 109 located at 45 degrees from each electromagnetic probe 170*a*, 170*b* couple the two orthogonal mode components from each of the $HEH_{11}$ and $HEE_{11}$ degenerate mode pairs. This arrangement of electromagnetic probes and screws, without needed to include screws 104-107, therefore provides a dual-branch coupling scheme required in dual-mode filters. Removing screws 104-107 (or else reconfiguring them so as to tune, but not couple the two mode components, one from each of the $HEH_{11}$ and $HEE_{11}$ mode pairs, that align with a respective electromagnetic probe 170*a*, 170*b*) will thus convert quad-mode filters 100, 100' into corresponding dual-mode, dual-band filters. Higher order dual-mode and mixed quad-mode and dual-mode filters are possible as well using this arrangement of screws.

Figure 12A:
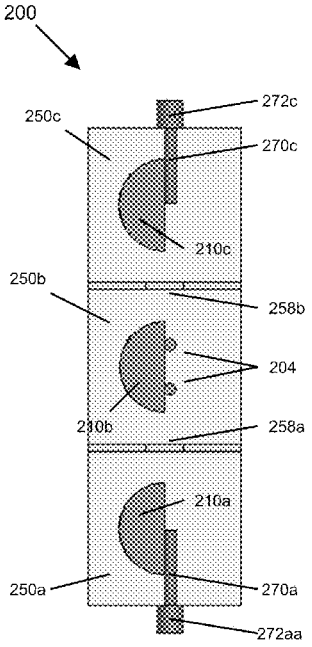
FIG. 12A is a perspective view of an exemplary 3-pole, dual band dielectric resonator filter synthesized using half-cut cylindrical dielectric resonators operating in a dual-band.
Figure 12B:
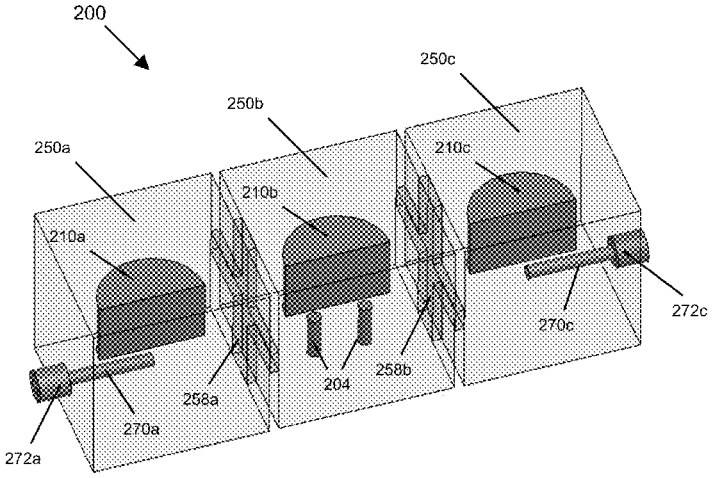
FIG. 12B is a top view of the 3-pole, dual band dielectric resonator filter of FIG. 12A.

Reference is now made to FIGS. 12A and 12B, which show different views of an exemplary 3-pole, dual-band dielectric resonator filter synthesized using half-cut cylindrical dielectric resonators operating in a dual-band, according to aspects of embodiments of the present invention. The dual-band dielectric resonator filter 200 comprises half-cut dielectric resonators 210*a*-210*c* enclosed in cavities 250*a*-250*c*, respectively. Electromagnetic probe 270*a* couples resonator 210*a* to external connector 272*a* on the input side, and electromagnetic probe 270*c* couples resonator 210*c* to external connector 272*c* on the output side. Cross-shaped iris 258*a* couples the respective operating modes of resonators 210*a* and 210*b*, and cross-shaped iris 258*b* couples the respective operating modes resonators 250*b* and 250*c*. Screws 204 may also be included in the filter, one of their functions being to provide resonant mode tuning for the half-cut dielectric resonator 10*b*. Although not expressly shown, resonators 210*a*-210*c* are planar mounted on mounting supports formed in unitary pieces on suitable low-permittivity dielectric substrate.

Appropriate sizing of the half-cut dielectric resonators 210*a*-210*c* and selection of a coupling scheme (analogous to the dual-branch scheme illustrated in FIG. 9D) will realize the 3-pole, dual-band dielectric resonator 200. The diameter D and length L of each resonator 210*a*-210*c* are selected so that the ½$HEH_{11}$ and ½$HEE_{11}$ modes resonate at different resonant frequencies, $f_H$ and $f_E$, respectively, corresponding to the centre frequencies of the two bands in the dual-band filter, and with a frequency band separation, Δf. The dimensions D and L may then be swept in order to meet design specifications imposed on $f_H$, $f_E$ and Δf. Each band in the dual-band filter 200 is carried by a corresponding different resonant mode of the resonators 210*a*-210*c*.

In conforming with the coupling scheme presented in FIG. 9D for a dual-band filter, input electromagnetic probe 270*a* is oriented to couple both the ½$HEH_{11}$ and ½$HEE_{11}$ modes of half-cut dielectric resonator 210*a*, just as output electromagnetic probe 270*c* is oriented to couple both the ½$HEH_{11}$ and ½$HEE_{11}$ modes of half-cut dielectric resonator 210*c*. Cross-shaped iris 258*a* simultaneously couples both the ½$HEH_{11}$ and ½$HEE_{11}$ modes of resonators 210*a* and 210*b*, wherein specifically the horizontal component couples the ½$HEH_{11}$ mode and the vertical component couples the ½$HEE_{11}$ mode. Similarly, cross-shaped iris 258*b* simultaneously couples both the ½$HEH_{11}$ and ½$HEE_{11}$ modes of resonators 210*b* and 210*c*, wherein specifically the horizontal component couples the ½$HEH_{11}$ mode and the vertical component couples the ½$HEE_{11}$ mode. Thus, the two frequency bands are carried independently within the dual-band filter 200. Generally intra-cavity coupling screws are not included in the dual-band filter, as the two bands are separate. However, screws 204 are included in resonator cavity 250*b*, in part, to adjust the resonant frequency of the ½$HEH_{11}$ modes of the resonators 210*b*. It will also be appreciated that additional screws (not shown) can be included in any or all of cavities 250*a*-250*c* for providing additional resonant mode tuning, if desired, and that the screws 204 can serve other functions in the filter 200, in addition to resonant mode tuning.

The basic topology of the dual-band filter 200 can also, after suitable modification, realize a 6-pole, dual-mode filter. The diameter D and length L of each resonator 210*a*-210*c* can be adjusted so that the ½$HEH_{11}$ and ½$HEE_{11}$ modes of each resonate at a common resonant frequency. Appropriate sizing and positioning of electromagnetic probes, screws and inter-cavity apertures can then realize a coupling scheme suitable for a 6-pole, dual-band filter (analogous to the scheme illustrated in FIG. 9A for a 4-pole filter). More specifically, coupling screws can be included in each of cavities 250*a*-*c* and oriented such as coupling screw 62 so that the ½$HEH_{11}$ and ½$HEE_{11}$ modes of each resonator 210*a*-210*c* are coupled. Next, electromagnetic probe 270*a* can be oriented horizontally adjacent to rectangular surface 218*a* of half-cut resonator 210*a* so as to couple only the ½$HEH_{11}$ mode, and electromagnetic probe 270*c* can be oriented vertically adjacent to curved surface 214*c* of resonator 210*c* so as to couple only the ½$HEH_{11}$ mode. Finally, cross-shaped iris 258*a* can be replaced with a suitable iris, such as horizontal iris 54, in order to couple the ½$HEE_{11}$ modes of resonators 210*a* and 210*b*, and cross-shaped iris 258*b* can be replaced with a suitable iris, such as vertical iris 56, in order to couple the ½$HEH_{11}$ modes of resonators 210*b* and 210*c*. This particular configuration of electromagnetic probes, coupling screws and inter-cavity apertures realizes a linear 6-pole dual-mode filter. The locations of electromagnetic probes 270*a*, 270*b* can also be varied to provide different combinations of positive and negative mode coupling for achieving different numbers and locations of transmission zeros in the filter 200.

Figure 13A:
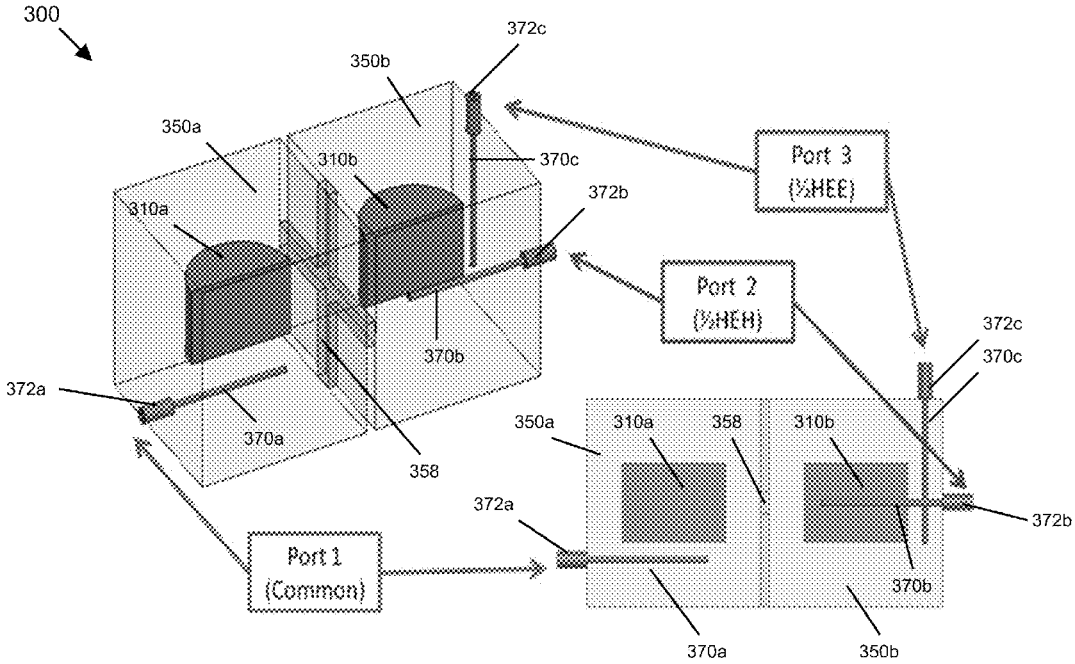
FIG. 13A is a perspective and top view of an exemplary 2-pole, dielectric resonator diplexer synthesized using half-cut cylindrical dielectric resonators operating in a dual-band.

Reference is now made to FIG. 13A, which shows perspective and top views of an exemplary 2-pole, dielectric resonator diplexer synthesized using half-cut cylindrical dielectric resonators operating in a dual-band, according to aspects of embodiments of the present invention. The 2-pole dielectric resonator diplexer 300 has a simple realization using two half-cut dielectric resonators 310*a*, 310*b* planar mounted on respective mounting supports (not shown) in cavities 350*a*, 350*b*. Electromagnetic probe 370*a* provides a common input channel for a mixed frequency component signal, and electromagnetic probes 370*b*, 370*c* provide isolated outputs channels, each channel corresponding to a different frequency band. Thus the diplexer 300 can be used to separate frequency components of the mixed-frequency input signal failing within the two respective frequency bands. It should be appreciated that the diplexer 300 is similar to a dual-band filter except that two isolated output channels are substituted for the common output channel.

Appropriate sizing of the half-cut dielectric resonators 310*a*, 310*b* and selection of a coupling scheme (analogous to the dual-branch scheme illustrated in FIG. 9D, but subject to the above-noted difference on the output side) will realize the 2-pole, dual-band dielectric resonator diplexer 300. As is the case for a dual-band filter, the diameter D and length L of resonators 310*a*, 310*b* are selected to provide a dual band defined by $f_E$, $f_H$ and $\Delta f$. Each output channel of the diplexer then corresponds to a different frequency band centered at one or the other of $f_E$ and $f_H$ (depending on which resonant mode carries which frequency band). Electromagnetic probe 370*a* is oriented to couple both the ½$HEH_{11}$ and ½$HEE_{11}$ modes of half-cut dielectric resonator 310*a* to the external connector 372*a*, and cross-shaped iris 58 couples both the ½$HEH_{11}$ and ½$HEE_{11}$ modes of resonator 350*a* to the corresponding modes of resonator 350*b*. Electromagnetic probe 370*b* is oriented horizontally adjacent to the rectangular surface 318*b* of half-cut dielectric resonator 310*b* to couple the ½$HEH_{11}$ mode to the external connector 372*b*, while substantially isolating the ½$HEE_{11}$ mode. On the other hand, electromagnetic probe 370*c* is oriented vertically adjacent to the proximal end of curved surface 314*b* of half-cut dielectric resonator 310*b* to couple the ½$HEE_{11}$ mode to the external connector 372*c*, while substantially isolating the ½$HEH_{11}$ mode. By carrying one frequency band on the ½$HEH_{11}$ mode and another frequency band on the ½$HEH_{11}$ mode, this exemplary arrangement of a common input channel and isolated output channels realizes a dielectric resonator diplexer. It should be appreciated that alternative realizations of a dielectric resonator diplexer are possible, and that one or more tuning screws may be included for providing resonant mode tuning. As before, the dimensions of the resonators, coupling screws, electromagnetic probes can be designed to realize design specifications for the diplexer.

Figure 13B:
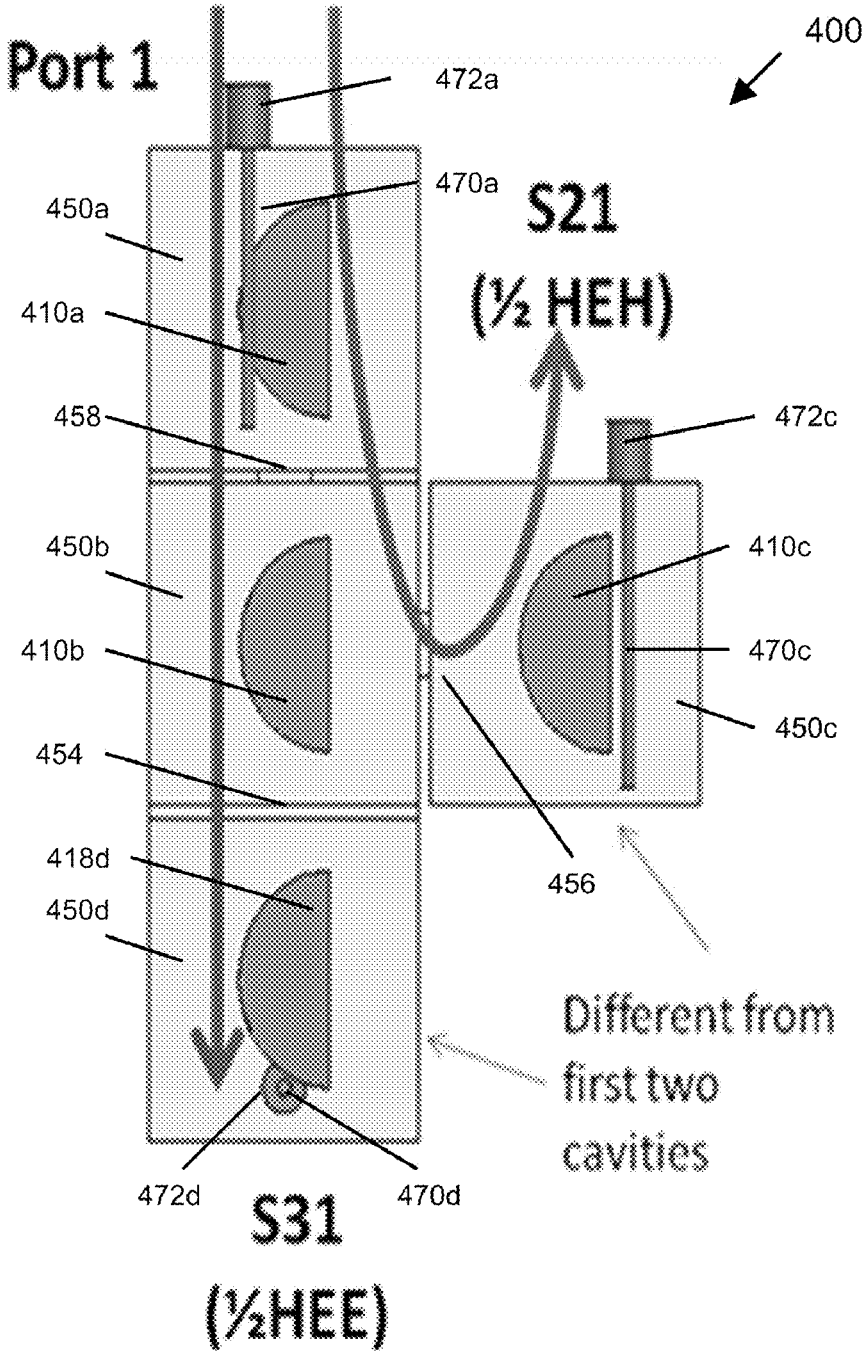
FIG. 13B is a top view of an exemplary 3-pole, dielectric resonator diplexer with improved output port isolation.

Reference is now made to FIG. 13B, which shows a top view of another exemplary dielectric resonator diplexer perspective and top views of an exemplary 3-pole, dielectric resonator diplexer synthesized using half-cut cylindrical dielectric resonators operating in a dual-band, according to aspects of embodiments of the present invention. The diplexer 400 is somewhat similar to the diplexer 300, but constitutes an improvement over diplexer 300. Superior output channel isolation is achieved in diplexer 400 by locating each respective output channel in a separate resonator cavity.

As in the diplexer 300, electromagnetic probe 470*a* couples both the ½$HEH_{11}$ and ½$HEE_{11}$ modes of resonator 410*a* to the external connector 472*a*, and cross-shaped iris 358 then couples the ½$HEH_{11}$ and ½$HEE_{11}$ modes of resonator 410*a* to the corresponding modes of resonator 410*b*. However, unlike the diplexer 300, diplexer 400 further comprises resonators 410*c*, 410*d* respectively enclosed in resonator cavities 450*c*, 450*d*. Horizontal iris 454 couples the ½$HEE_{11}$ modes of resonators 410*b* and 410*d*, while substantially isolating the ½$HEH_{11}$ modes, and vertical iris 456 couples the ½$HEH_{11}$ modes of resonators 410*b* and 410*c*, while substantially isolating the ½$HEE_{11}$ mode. Thus, the joint effect of horizontal iris 454 and vertical iris 456 is to guide the ½$HEH_{11}$ resonant mode into resonator cavity 450*c* and the ½$HEE_{11}$ resonant mode into resonator cavity 450*d*. Electromagnetic probe 470*c* then couples the ½$HEH_{11}$ mode of resonator 410*c* to the external connector 472*c*, and electromagnetic probe 470*d* couples the ½$HEE_{11}$ mode of resonator 410*d* to the external connector 472*d*. Alternatively, half-cut dielectric resonators 410*c*, 410*d* can be replaced with full cylinders operating in a single TEH mode, or other resonant mode, as discussed in greater detail below.

Figure 13C:
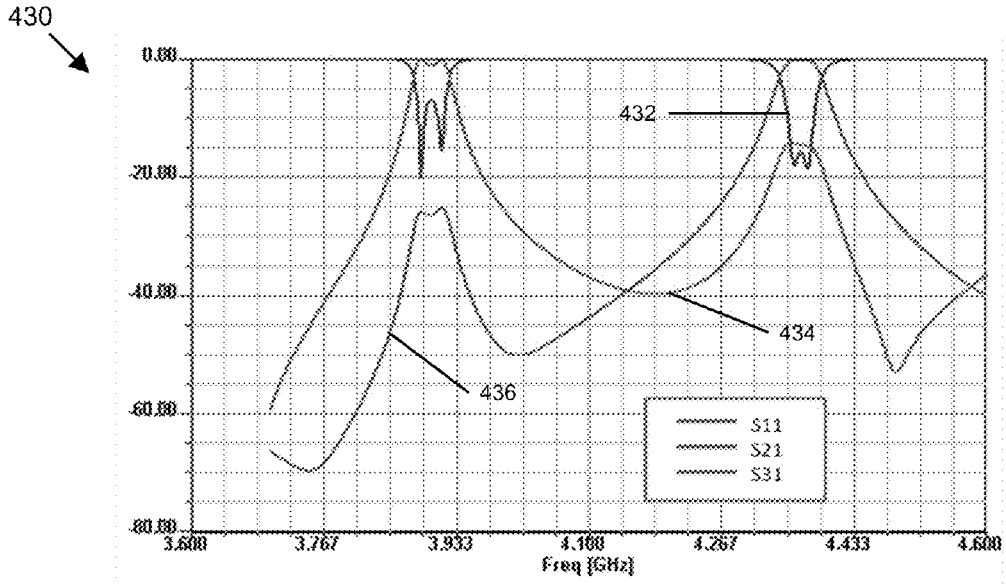
FIG. 13C is a plot of reflection and transmission versus frequency for the 2-pole dielectric resonator diplexer of FIG. 13A.
Figure 13D:
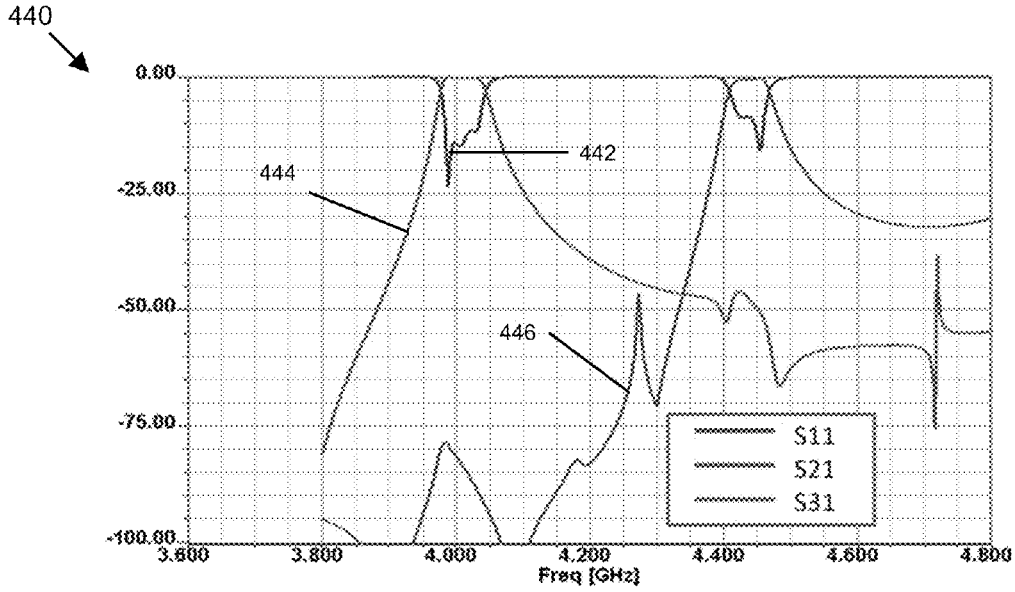
FIG. 13D is a plot of reflection and transmission versus frequency for the 3-pole dielectric resonator diplexer of FIG. 13B.

Reference is now made to FIGS. 13C and 13D, which show plots of reflection and transmission versus frequency for the dielectric resonator diplexers of FIGS. 13A and 13D. Plot 130 corresponds to simulated results for diplexer 300 (shown in FIG. 13A), in which curve 432 represents reflection ($S_{11}$), curve 434 represents transmission ($S_{21}$) of the ½$HEH_{11}$ mode to port 2, and 436 represents transmission ($S_{31}$) of the ½$HEE_{11}$ mode to port 3. Likewise plot 440 corresponds to simulated results for diplexer 400 (shown in FIG. 13B), in which curve 442 represents reflection ($S_{11}$), curve 444 represents transmission ($S_{21}$) of the ½$HEH_{11}$ mode to port 2, and 446 represents transmission ($S_{31}$) of the ½$HEE_{11}$ mode to port 3.

It is evident in plot 440 that better output isolation is achieved in the diplexer 400 as compared to the diplexer 300. In the lower passband (corresponding to transmission of the ½$HEH_{11}$ mode to port 2), about −25 dB transmission to port 3 is seen in plot 430 as compared to only about −75 dB in plot 440. Similarly in the upper passband (corresponding to transmission of the ½$HEH_{11}$ mode to port 3), about −15 dB transmission to port 2 is seen in plot 430 as compared to only about −50 dB in plot 440. The improved output mode isolation is due to the physical separation of the channels in different resonator cavities. Plots 430 and 440, it should be appreciated, also confirm that the dual-band is carried on separate resonant modes of the half-cut dielectric resonator 10.

It should be appreciated that a plurality of resonator diplexers can be combined to realize higher-order multiplexers. For example, a plurality of diplexers can be realized, according to the above-described embodiments, wherein the dual-band in each of the diplexers are defined for different centre frequencies to realize a multi-band defined by a plurality of centre frequencies. The input electromagnetic probe can then be coupled to each of the plurality of diplexers, in that way realizing a higher order multiplexer. A forked electromagnetic probe, for example, could be used to couple each of the diplexers to a common input. As before, in each of the plurality of diplexers, the input electromagnetic probe can be oriented to couple to both the ½$HEH_{11}$ mode and ½$HEE_{11}$ mode of a first resonator. In that way, each of the plurality of diplexers can carry a dual-band on the two resonant modes.

In the exemplary embodiments described herein thus far, constructed from the full cylindrical or half-cut dielectric resonator, spurious performance has not been discussed in any length. Spurious performance, it should be understood, relates to the frequency range of a dielectric resonator in which only the resonator operating mode(s) are present, and no unwanted higher or lower order resonance modes appear. Due to the relative orthogonality of the lower order resonant modes of the half-cut dielectric resonator, a simple modification to the basic half-cut offers significant improvements in spurious performance. Exemplary embodiments of modified half-cut dielectric resonators are discussed below.

Figure 14A:
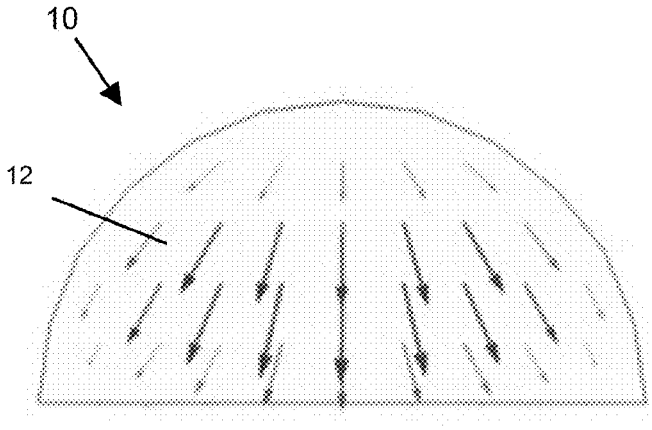
FIG. 14A is a top view of the electric field lines in the half-cut dielectric resonator of FIG. 1B for a first spurious resonant mode.
Figure 14B:
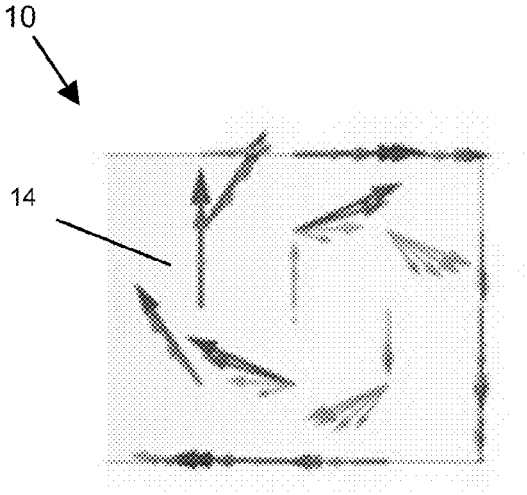
FIG. 14B is a front view of the electric field lines in the half-cut dielectric resonator of FIG. 1B for a first spurious resonant mode.
Figure 14C:
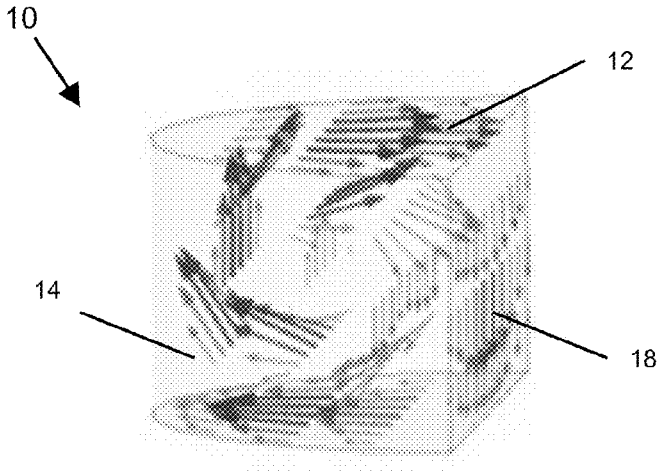
FIG. 14C is a perspective view of the electric field lines in the half-cut dielectric resonator of FIG. 1B for a first spurious resonant mode.

Reference is now made to FIGS. 14A-14C, which illustrate various views of the E field lines in the half-cut cylindrical dielectric resonator of FIG. 1B for a first spurious resonant mode. It is observed that the TEH mode of the full cylindrical dielectric resonator 1 (which is a lower order mode than either the $HEH_{11}$ and $HEE_{11}$ modes) does not correspondingly appear in the basic half-cut dielectric resonator 10 as a lower order resonance mode because the radial symmetry present in the full cylinder that expresses the TEH mode is not preserved after the cut. The ½$HEH_{11}$ and ½$HEE_{11}$ modes of the basic half-cut dielectric resonator 10, therefore, represent the first two eignenmodes of the structure. The mode charts 30 and 40 of FIGS. 4A and 4B confirm these observations. The first higher order resonance mode of the half-cut dielectric resonator 10, corresponding to the third eigenmode of the structure, is the component of the $HEE_{11}$ mode that was orthogonal to the symmetry plane 25 and lost due to the cut. Distorted by the boundary contours of the half-cut cylinder and forced to circulate in a shorter path after to the cut, this component of the $HEE_{11}$ mode in the full cylinder becomes a distinct mode in the half-cut cylinder. With the ½$HEH_{11}$ and ½$HEE_{11}$ modes providing the first two eigenmodes of the structure (their relative ordering depending on the sizing of D and L), this new mode constitutes the third eigenmode of the structure.

As shown in FIGS. 14A-14C, the E field lines of this third eigenmode circulate vertically and orthogonal to the rectangular surface 18 tracing out a path that is limited by the surface boundaries of the half-cut cylinder. The E field lines of this third eigenmode, it should be appreciated, are orthogonal to the E field lines in both the ½$HEH_{11}$ resonant mode (which circulate horizontally) and the ½$HEE_{11}$ resonant mode (which circulate vertically but tangential to the rectangular surface 18). On account of the relative orthogonality of the first three eigenmodes of the structure, selective cutting of the basic half-cut dielectric resonator 10 can create dielectric barriers that effectively terminate the E fields of the third eigenmode, but that have nearly no impact on the E fields of the first two eigenmodes. By suppressing the third eigenmode of the structure, the next higher order (i.e. the fourth) eigenmode becomes the first spurious mode. In this way the spurious free window of the filter is widened.

Reference is now made to FIGS. 15A-15D, which illustrate perspective views of exemplary slotted half-cut dielectric resonators according to aspects of embodiments of the present invention. Each slotted half-cut dielectric resonator illustrated is similar to the basic half-cut dielectric resonator 10, but further comprises at least one through-way slot extending between opposite surfaces of the half-cut dielectric resonator 10. For example, slotted half-cut dielectric resonator 510 shown in FIG. 15A comprises vertical through-way slot 515 extending between the parallel pair of semi-circular faces 512, while slotted half-cut dielectric resonator 610 shown in FIG. 15B comprises horizontal through-way slot 635 extending between the curved surface 14 and the rectangular surface 18. Preferably the through-way slot 515, 635 is located at or near the center of the opposite surfaces between which it extends. However, in some embodiments, the through-way slot 515, 635 may not be exactly centered and may be positioned away from the centre of the opposite surfaces between which it extends. The shape and cross-sectional area of the through-way slot are also both variable. In the particular case of a rectangular through-way slot, the cross-sectional length and width of the through-way slot are variable.

The number of through-way slots included in the slotted half-cut dielectric resonator and their relative orientations are also variable. For example, slotted half-cut dielectric resonator 710 shown FIG. 15C comprises vertical through-way slot 715 extending between the pair of semi-circular surfaces 712, as well as horizontal through-way slot 735 extending between the curved surface 714 and the rectangular surface 718. The through-way slots 715, 735 clearly intersect somewhere inside slotted half-cut dielectric resonator 710. Although not illustrated, in some embodiments, the slotted half-cut dielectric resonator comprises multiple parallel through-way slots. For example two or more parallel through-way slots may extend between semi-circular surfaces 712 or, alternatively, between the curved surface 714 and rectangular surface 718.

In some embodiments, surface slots may be used instead of through-way slots. For example, slotted half-cut dielectric resonator 810 shown in FIG. 15D comprises surface slot 845 cut into curved surface 814, but not extending all the way through to rectangular surface 818. Similarly, a surface slot may be cut into rectangular surface 818 (not extending all the way through to curved surface 814). In some embodiments, surface slots may be cut into each of curved surface 814 and rectangular surface 818, or alternatively into each of the parallel pair of semi-circular surfaces 812. Any combination of surface slots is possible. Thus, in some embodiments, surface slots may be cut into one or both of the pair of semi-circular surfaces 812 in addition, or as an alternative, to surface slots cut into the curved surface 814 and rectangular surface 818. These surface slots may cross, merely adjoin, or neither.

Figure 15A:
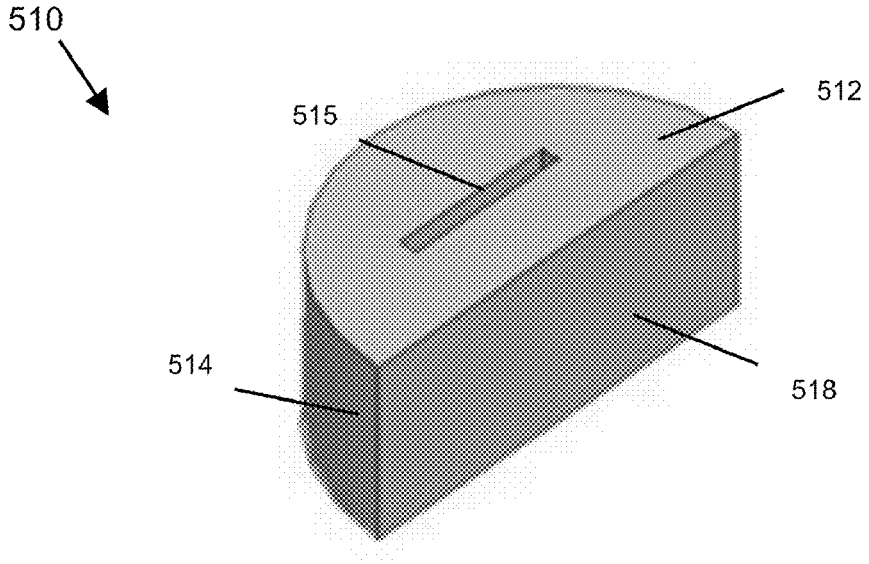
FIG. 15A is a perspective view of an exemplary slotted half-cut dielectric resonator.
Figure 15B:
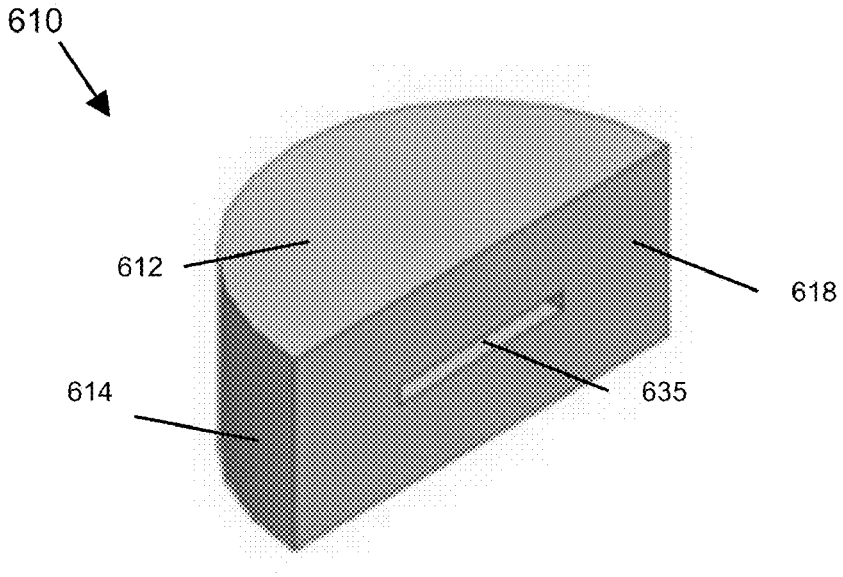
FIG. 15B is a perspective view of another exemplary slotted half-cut dielectric resonator.
Figure 15C:
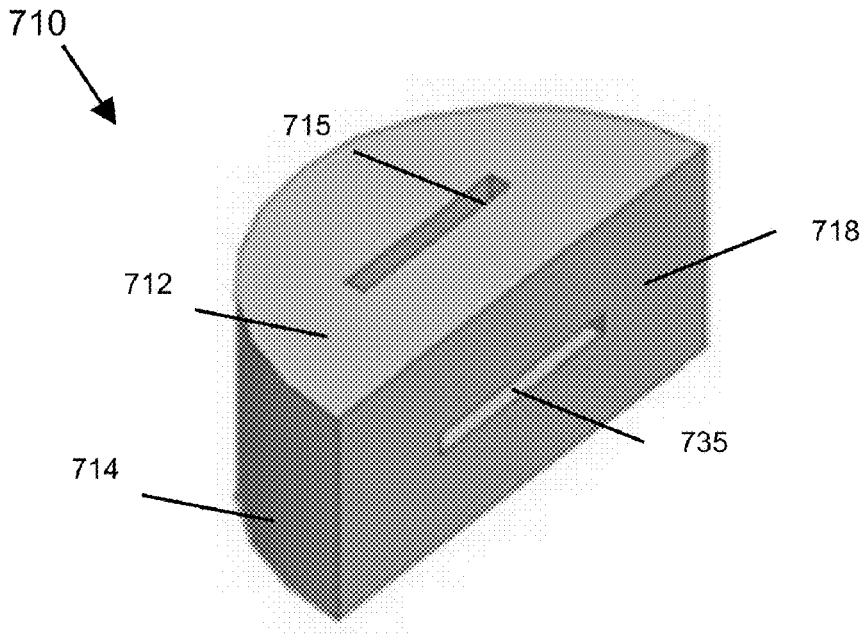
FIG. 15C is a perspective view of another exemplary slotted half-cut dielectric resonator.
Figure 15D:
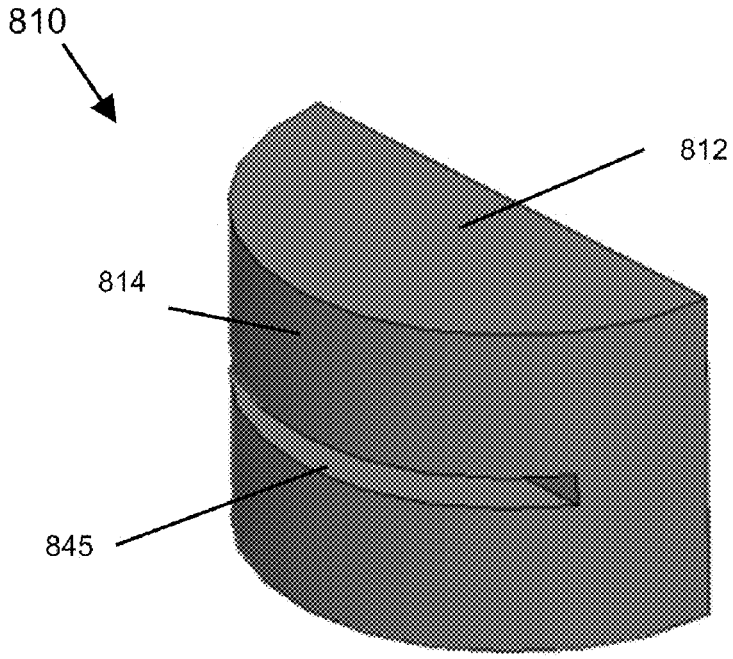
FIG. 15D is a perspective view of another exemplary slotted half-cut dielectric resonator.
Figure 16A:
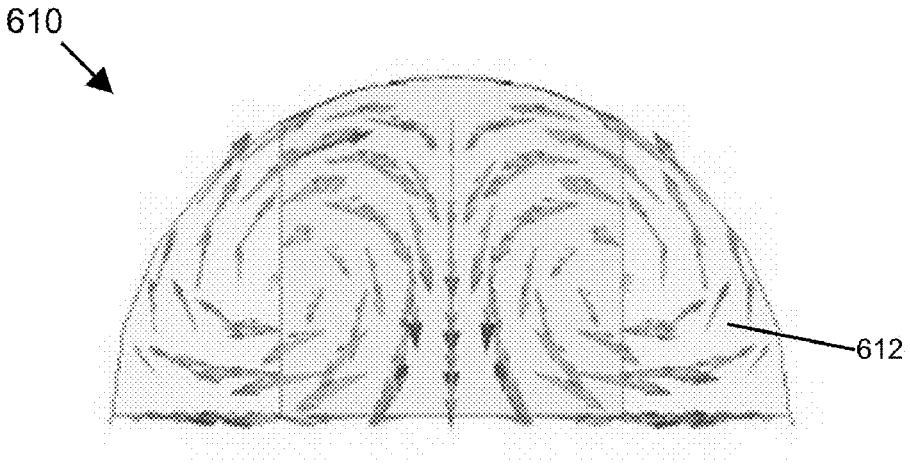
FIG. 16A is a top view of the E field lines in the slotted half-cut dielectric resonator of FIG. 15B for a first spurious mode.
Figure 16B:
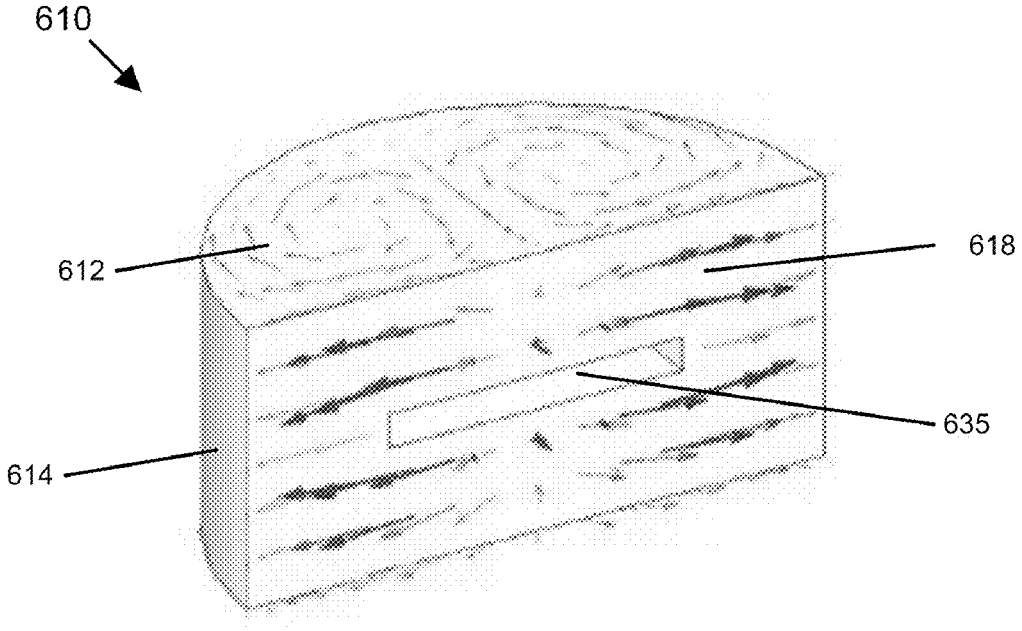
FIG. 16B is a perspective view of the E field lines in the slotted half-cut dielectric resonator of FIG. 15B for a first spurious mode.

Reference is now made to FIGS. 16A and 16B, which show top and perspective views of the E field lines in the slotted half-cut dielectric resonator of FIG. 15B for a first spurious mode, according to aspects of embodiments of the present invention. The E field lines illustrated in FIGS. 16A and 16B clearly differ from those in FIGS. 14A-14C because the horizontal through-way slot 635 cut into the half-cut dielectric resonator 610 terminates the E field lines of the third eigenmode. Although not expressly shown, the E field lines of the ½$HEH_{11}$ and ½$HEE_{11}$ modes are not appreciably affected by the horizontal through-way slot 635 because they are oriented more or less parallel to the cut. The respective resonant frequencies of the ½$HEH_{11}$ and ½$HEE_{11}$ modes are thus not appreciably affected either.

Accordingly, the E field lines illustrated in FIGS. 16A and 16B actually represent the fourth eigenmode of the half-cut cylinder and correspond to the component of the $HEH_{11}$ mode (as opposed to the $HEE_{11}$ mode) that was orthogonal to the symmetry plane 25 and was lost by the cut. Forced by the boundaries of the half-cylinder to circulate in a new path, that lost component of the $HEH_{11}$ mode becomes the fourth eigenmode of the structure. With its shorter circulation path, the fourth eigenmode has a higher resonant frequency than the third eigenmode. This fourth eigenmode of the half-cut cylinder becomes the first spurious mode when the third eigenmode of the structure is lost due to the cut. By leaving the first and second resonant modes largely unchanged and by substituting the fourth eigenmode for the third eigenmode as the first spurious mode of the resonator, the overall effect of cutting the horizontal through-way cut 635 is an increase the spurious free window of the resonator.

It will further be appreciated that the E field lines illustrated in FIGS. 16A and 16B are orthogonal to the vertical through-way slot 515 as well. Accordingly, supplementing the horizontal through-way slot 635 with an additional vertical through-way slot cut into the resonator 610 (thereby producing the resonator 710 having both a vertical through-way slot 715 and a horizontal through-way lot 735) will terminate the E field lines in the fourth eigenmode as well. An even wider spurious free window is thereby achieved. Table I below illustrates the increased spurious window due to inclusion of through-way slots for a dual-band filter with a 4 GHz lower band and a 4.4 GHz upper band.

TABLE I

SPURIOUS IMPROVEMENT COMPARISON

| Type | $f_{lower}$ (GHZ) | $f_{upper}$ (GHz) | $f_{spurious}$ (GHz) | $\Delta f_{lower}$ (MHz) | $\Delta f_{upper}$ (MHz) |
|---|---|---|---|---|---|
| Basic Half-cut | 3.96 | 4.38 | 4.56 | 600 | 180 |
| Vertical Through-way Slot | 3.96 | 4.38 | 4.77 | 810 | 390 |
| Horizontal Through-way Slot | 4.02 | 4.39 | 5.20 | 1180 | 810 |
| Dual Slotted | 3.98 | 4.39 | 5.33 | 1350 | 940 |

It can be seen that the dual-slotted resonator 710 (FIG. 15C) outperforms the single slotted resonators 510, 610 (FIGS. 15A and 15B). The dual-slotted resonator 710 provides a spurious free window of approximately 1.3 GHz for the lower band and 900 MHz for the upper band, as compared to 600 MHz and 200 MHz, respectively, for the basic half-cut dielectric resonator 10 with no through-way slots. The single slotted configurations, it will be appreciated, also compare favourably to the original half-cut resonator, but still do not provide as wide a spurious free widow as the dual slotted resonator 710 provides.

It should be appreciated that through-way slots cut into the full cylindrical dielectric resonator 1 would remove radial symmetry in the structure, and thus would potentially render the full cylindrical resonator unsuitable for quad-mode operation. For example, a vertical through-way slot, similar to though-way slot 515, cut along the cylindrical axis of the full cylinder would fix a symmetry plane 25 in the structure. One component from each of the $HEH_{11}$ and $HEE_{11}$ modes would align with the symmetry plane, while the corresponding orthogonal mode components would terminate at the cut. Clearly it would be possible to cut through-way slots into the full cylinder, though doing so would render the full cylinder unsuitable for some applications (i.e. quad-mode operation), while leaving it potentially still suitable for other applications (i.e. dual-mode operation in the two remaining aligned modes).

It should also be appreciated that the basic and slotted half-cut dielectric resonators can be used interchangeably in the exemplary dielectric filter and multiplexer realizations discussed herein. Accordingly, for a wider spurious free window, the dielectric resonator filter 200 (FIGS. 12A and 12B), as well as the dielectric resonator multiplexers 300 (FIG. 13A) and 400 (FIG. 13B) can be synthesized using slotted half-cut resonators, rather than the basic half-cut resonators as illustrated. The same design and synthesis processes could be followed without substantial modification. Aspects of some still further exemplary realizations of dielectric resonator filters and multiplexers will now be discussed.

Figure 17:
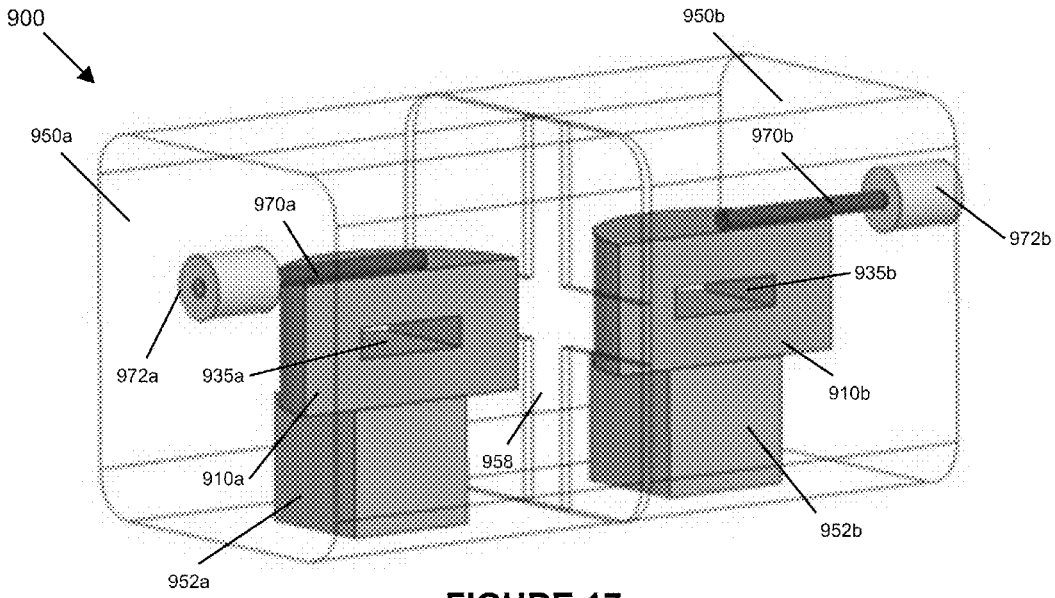
FIG. 17 is a perspective view of an exemplary 2-pole, dual-band dielectric resonator filter having improved spurious performance.

Reference is now made to FIG. 17, which shows a perspective view of an exemplary 2-pole, dual-band dielectric resonator filter having improved spurious performance, according to aspects of embodiments of the present invention. The 2-pole dual-band filter 900 is similar to, but different than, the 3-pole dual-band filter 200 illustrated in FIGS. 12A and 12B. For example, the respective filters have different orders and are synthesized using different resonators. The dual-band filter 900 in particular is synthesized using two slotted half-cut dielectric resonators 910*a*, 910*b* comprising horizontal through-way slots 935*a*, 935*b*, making it a 2-pole filter. No tuning screws are illustrated in FIG. 17 either, though tuning screws can be included if desired. The coupling scheme synthesized in dual-band filter 900 is otherwise analogous to the one synthesized in filter 200. Electromagnetic probe 970*a* couples both the ½$HEH_{11}$ and ½$HEE_{11}$ resonant modes of the resonator 910*a* to the external connector 972*a*, cross-shaped iris 958 couples both modes of resonator 710*a* to corresponding modes of resonator 910*b*, and electromagnetic probe 970*b* couples both the ½$HEH_{11}$ and ½$HEE_{11}$ modes of resonator 910*b* to the external connector 972*b*. No intra-cavity coupling screws are included. The electromagnetic probes 970*a*, 970 are oriented for positive mode coupling. This coupling scheme is the dual branch scheme illustrated in FIG. 9D.

Figures 18A, 18B, 18C:
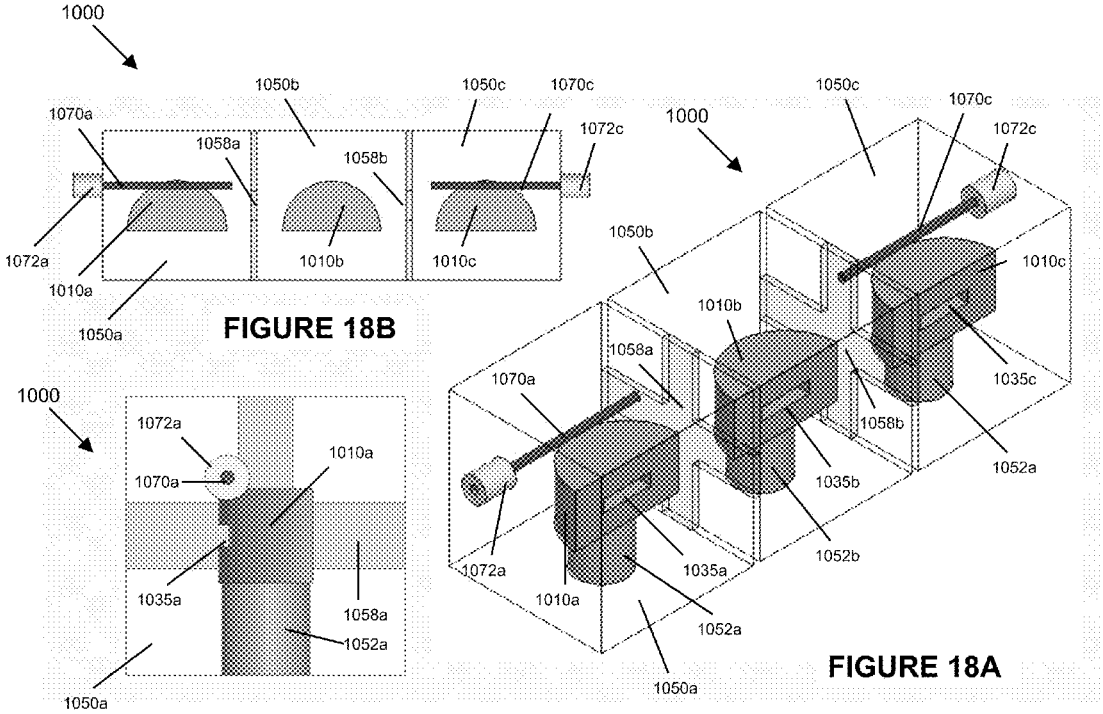
FIG. 18A is a perspective view of an exemplary 3-pole, dual-band dielectric resonator filter having an inter-band transmission zero.
FIG. 18B is a top view of the 3-pole, dual-band dielectric resonator filter of FIG. 18A.
FIG. 18C is a front view of the 3-pole, dual-band dielectric resonator filter of FIG. 18A.

Reference is now made to FIGS. 18A-18C, which illustrate various views of an exemplary 3-pole, dual-band dielectric resonator filter, according to aspects of embodiments of the present invention. The dual-band filter 1000 is similar to the 2-pole dual-band filter 900 illustrated in FIG. 17, but is a 3-pole dual-band filter. The dual-band filter 1000 is also similar to the dual-band filter 200 of FIGS. 12A and 12B, but comprises slotted half-cut dielectric resonators and differently positioned electromagnetic probes. Accordingly, half-cut dielectric resonators 1010*a*-1010*c* are enclosed in resonator cavities 1050*a*-1050*c* and also include horizontal through-way slots 1035*a*-1035*c*, respectively. Cross-shaped irises 1058*a*, 1058*b* provide inter-cavity coupling of both the ½$HEH_{11}$ and ½$HEE_{11}$ modes of resonators 1010*a*-1010*c*, as described previously, for carrying a dual-band. Support structures 1052*a*-1052*c* are used to mount resonators 1010*a*-1010*c* in planar fashion.

Electromagnetic probe 1070*a* couples both the ½$HEH_{11}$ and ½$HEE_{11}$ modes of resonator 1010*a* to external connector 1072*a*, while electromagnetic probe 1070*c* couples both the ½$HEH_{11}$ and ½$HEE_{11}$ modes of resonator 1010*c* to external connector 1072*c*. As mentioned, it can be seen that the dual-band filter 1000 differs from the dual-band filter 900 also in the location of the electromagnetic probes 1070*a*, 1070*b* relative to the half-cut dielectric resonators 1010*a*, 1010*c*. Electromagnetic probes 1070*a*, 1070*c* are located diagonally adjacent respective curved edges of the half-cut dielectric resonators 1010*a*, 1010*b* as opposed to diagonally adjacent respective straight edges. Placing the electromagnetic probes 1070*a*, 1070*c*.

When configured as shown in FIGS. 18A-18C, the 2-pole filter 1000 has a natural transmission zero located in between the two bands of the dual-band due to the odd order of the filter. In each resonator cavity 1050*a*-1050, the two resonant modes of the filter 1000 have a phase separation of approximately 180° for frequencies between the two bands. Thus, frequency signals between the two bands undergo one phase reversal for each cavity included in the filter. Because there are an odd number of cavities in the filter 1000, the total number of phase reversals is odd and the total phase shift is an odd multiple of 180° phase shifts. In this particular phase relation, the two frequency bands are subtractive at the output and thereby create a transmission zero.

It should be appreciated that the same result would not correspondingly hold for even order filters. In that case, the total number of phase reversals would be even and the total phase shift would be an even multiple of 180° phase shifts, corresponding to the even number of cavities in the filter. No inter-band transmission zero would occur because the two frequency bands will be in-phase and thus additive, not subtractive, at the output. Inter-band transmission zeros are still achievable in even order filters, however, as will be seen, by introducing an additional single phase reversal to provide an odd number of phase reversals overall.

Figure 18D:
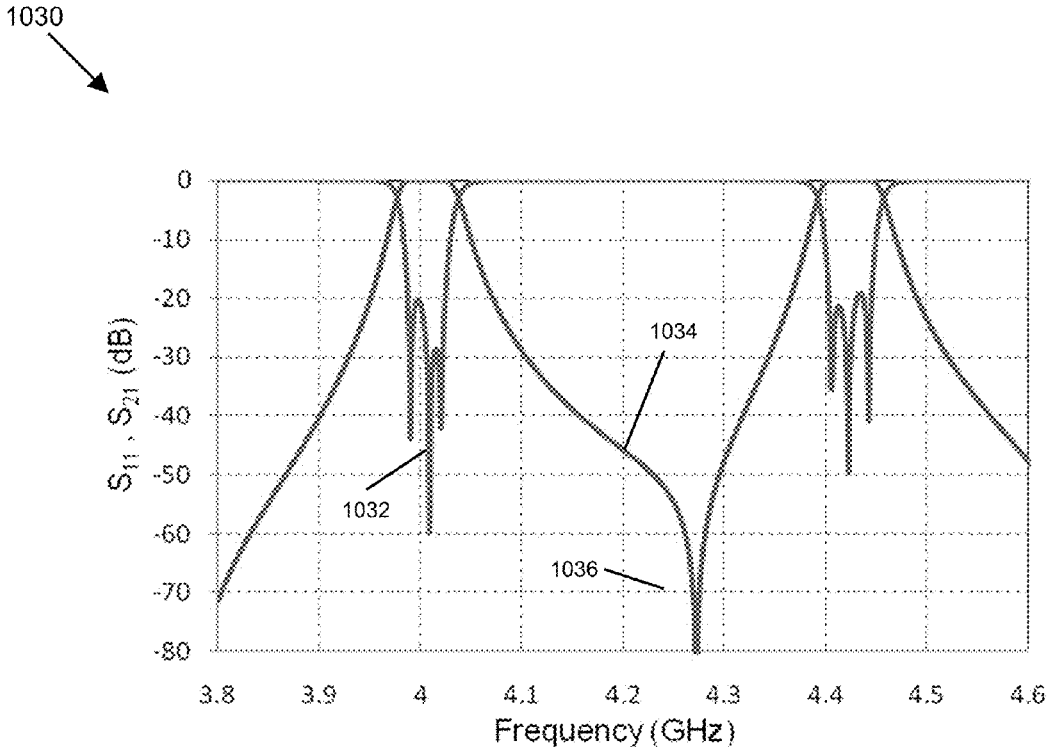
FIG. 18D is a plot of reflection and transmission versus frequency for the 3-pole, dual-band dielectric resonator filter of FIG. 18A.

Reference is now made to FIG. 18D, which shows a plot of reflection and transmission versus frequency for the 3-pole, dual-band dielectric resonator filter of FIGS. 18A-18C. Plot 1030 corresponds to simulated results for the dual-band filter 1000, in which curve 1032 represents reflection ($S_{11}$), curve 1034 represents transmission ($S_{21}$). It is evident that region 1036 of the curve 1034 corresponds to an inter-band transmission zero of the filter 1000.

Figure 19A:
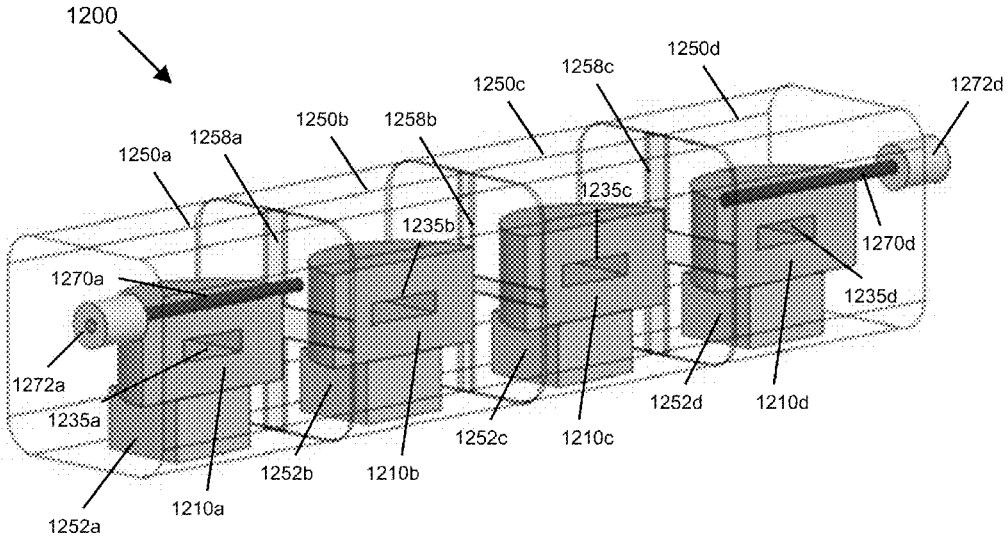
FIG. 19A is a perspective view of an exemplary 4-pole, dual-band dielectric resonator filter.
Figure 19B:
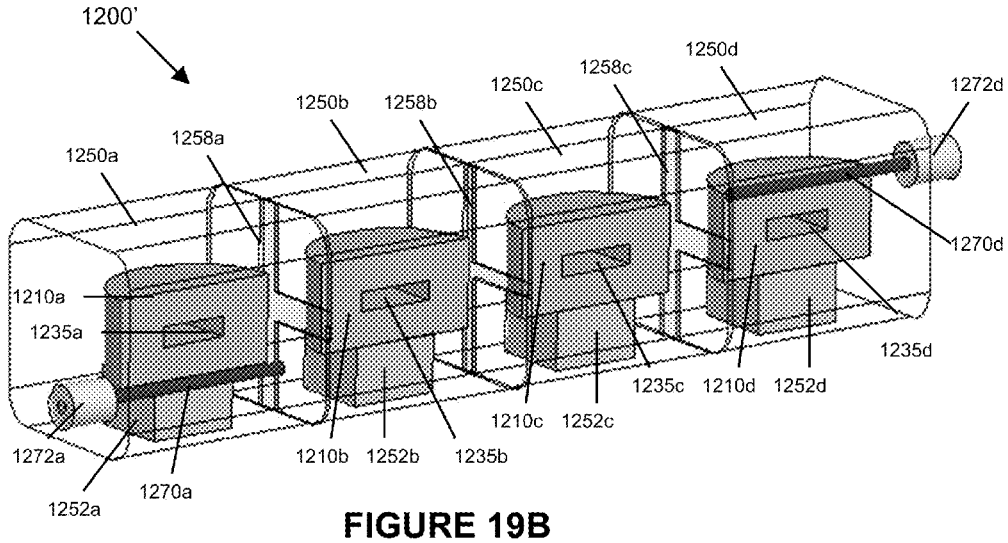
FIG. 19B is a perspective view of an exemplary 4-pole, dual-band dielectric resonator filter having an inter-band transmission zero.

Reference is now made to FIGS. 19A and 19B, which shows perspective views of exemplary 4-pole, dual-band dielectric resonator filters, according to aspects of embodiments of the present invention. The dual-band filter 1200 (FIG. 19A) is similar to the 2-pole dual-band filter 900 illustrated in FIG. 17, but is a 4-pole dual-band filter. Half-cut dielectric resonators 1010*a*-1010*d* are enclosed in resonator cavities 1050*a*-1050*d* and include horizontal through-way slots 1035*a*-1035*d*, respectively. Cross-shaped irises 1058*a*-1058*c* provide inter-cavity coupling of both the ½$HEH_{11}$ and ½$HEE_{11}$ modes of resonators 1010*a*-1010*d*, as described previously, for carrying a dual-band. Electromagnetic probe 1070*a* couples both the ½$HEH_{11}$ and ½$HEE_{11}$ modes of resonator 1010*a* to external connector 1072*a*, while electromagnetic probe 1070*d* couples both the ½$HEH_{11}$ and ½$HEE_{11}$ modes of resonator 1010*d* to external connector 1072*d*. Based on their location, electromagnetic probes 1070*a*, 1070*d* provide positive coupling. Mounting supports 1052*a*-1052*d* are used for planar mounting of the resonators 1010*a*-1010*d*.

With an even number of poles, the dual-band filter 1200 does not have an inter-band transmission zero. There is an overall even number of phase reversals for inter-band frequencies attributable to inter-cavity coupling, and thus the two modes are in-phase at the output. In contrast, the dual-band filter 1200' (FIG. 19B) has an inter-band transmission zero even though it is an even order filter. As can be seen, the locations of electromagnetic probes 1270*a*, 1270*d* do not match. Electromagnetic probe 1270*a* provides negative coupling on the input, while electromagnetic probe 1270*d* provides positive coupling on the output. Even though there is an even number of phase reversal due to inter-cavity coupling (i.e. because there are an even number of cavities), the polarity reversal in the output coupling achieves an overall out-of-phase relation on the output. Consequently a transmission zero is achieved. It should be noted that this technique can also be used to remove the naturally occurring inter-band transmission zero in odd order filters by converting the natural out-out-phase relation of the two resonant modes into the non-transmission zero producing in-phase relation naturally seen in even order filters.

Figure 19C:
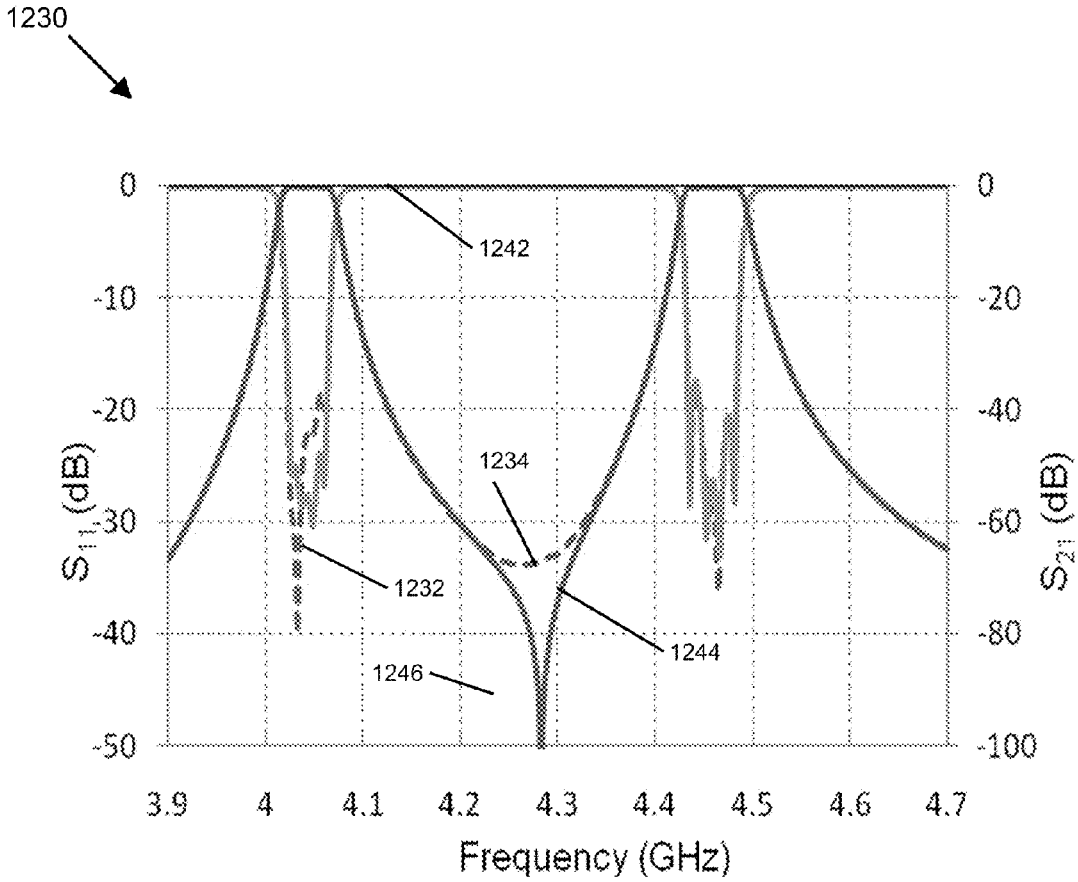
FIG. 19C is a plot of reflection and transmission versus frequency for the 4-pole, dual-band dielectric resonator filters of FIGS. 19A and 19B.

Reference is now made to FIG. 19C, which shows plots of reflection and transmission versus frequency for the 4-pole, dual-band dielectric resonator filters of FIGS. 19A and 19B. Curve 1232 represents reflection ($S_{11}$) and curve 1234 represents transmission ($S_{21}$) for the filter 1200 of FIG. 19A, while curve 1242 represents reflection ($S_{11}$) and curve 1244 represents transmission ($S_{21}$) for the filter 1200' of FIG. 19B. It is evident that region 1246 of the curve 1244 corresponds to an inter-band transmission zero of the filter 1200', which does not correspondingly appear in the curve 1234. The frequency characteristics of the two filters 1200, 1200' are otherwise commensurate.

Figure 20A:
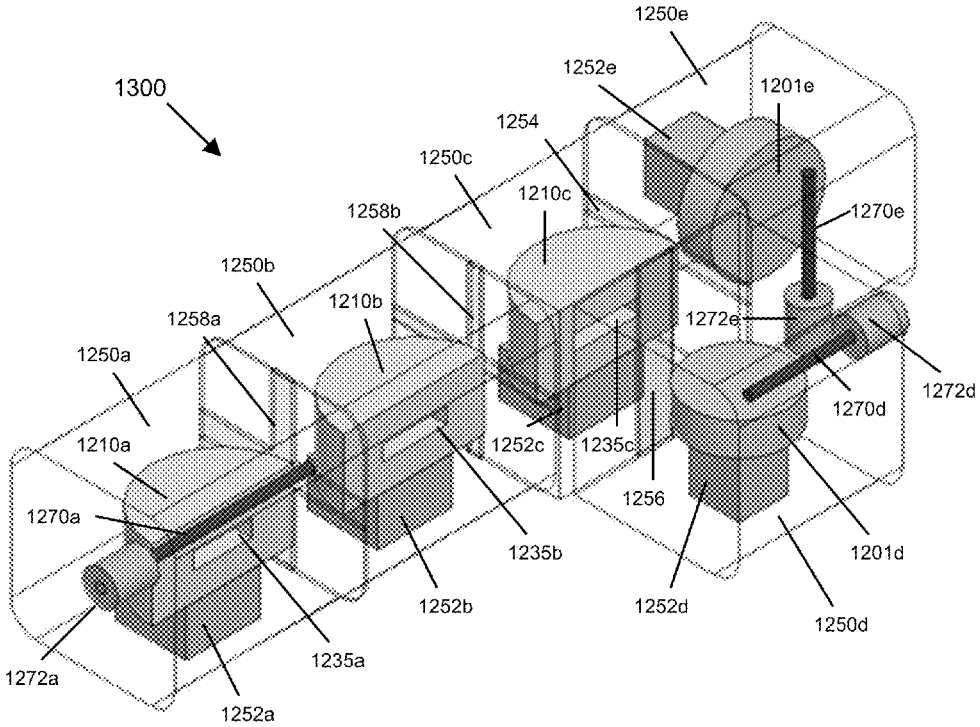
FIG. 20A is a perspective view of an exemplary 4-pole, dielectric resonator diplexer with improved output port isolation
Figure 20B:
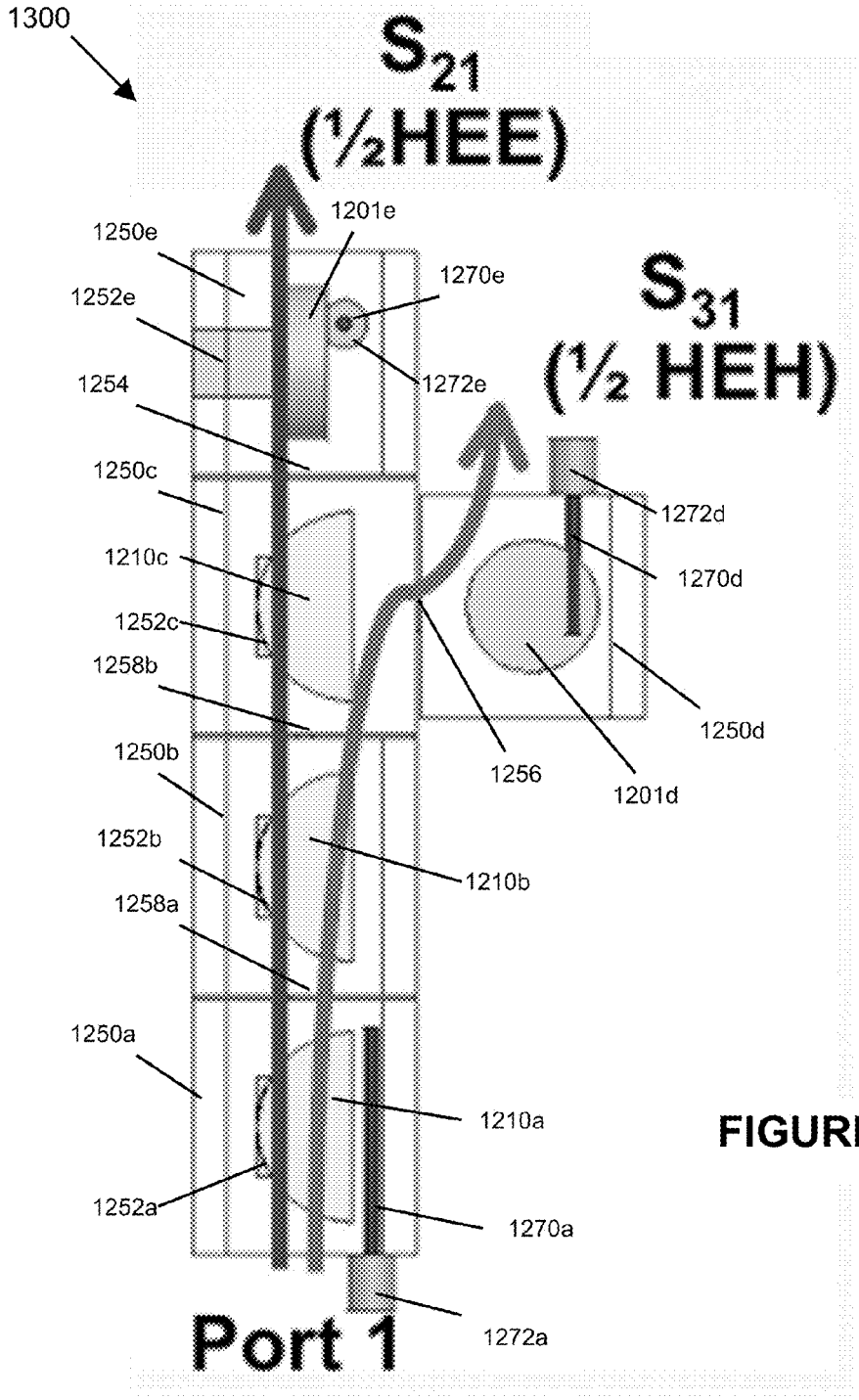
FIG. 20B is a top view of the 4-pole, dielectric resonator diplexer of FIG. 20A.

Reference is now made to FIGS. 20A and 20B, which show perspective and top views of an exemplary 4-pole dielectric resonator diplexer with improved spurious performance and output mode isolation, according to aspects of embodiments of the present invention. The dielectric resonator diplexer 1300 shown in FIGS. 20A and 20B is similar to the dielectric resonator diplexer 400 shown in FIG. 13B, except is of a different order and provides improved output mode isolating by coupling full cylindrical resonators 1201*d*, 1201*e* operating in single TEH modes to external connectors 1272*d*, 1272*e*. The half-cut dielectric electric resonators 1235*a*-

1235*c* also include horizontal through-way slots 1235*a*-1235*c*. The principles of operation are otherwise as described herein.

Resonator cavities 1250*a*-1250*c* enclosing resonators 1210*a*-1210*c* are configured to carry a dual-band. Electromagnetic probe couples external connector 1272*a* to both the ½$HEH_{11}$ and ½$HEE_{11}$ modes of resonator 1210*a*. Cross-shaped irises 1258*a*, 1258*b* couple to dual band to resonator 1210*c* intermediately through resonator 1210*b*. Vertical iris 1256 defined in one wall of resonator cavity 1250*c* guides the ½$HEH_{11}$ mode into resonator cavity 1250*d* for coupling to the external connector 1272*d*. Similarly, horizontal iris 1254 defined in another wall of resonator cavity 1250*c* guides the ½$HEE_{11}$ mode into resonator cavity 1250*e* for coupling to the external connector 1272*e*. Electromagnetic probes 1270*d*, 1270*e* are oriented to couple the TEH resonant modes of the full cylindrical resonators 1201*d*, 1201*e*, though it should be appreciated that they may be oriented otherwise to couple other resonant modes, if desired. For example, electromagnetic probes 1201*d*, 1201*e* could be located to couple either the HEH or HEE modes of resonators 1201*d*, 1201*e*.

It should also be appreciated that full cylindrical resonator 1201*e* is mounted to a side wall, rather than the floor, of resonator cavity 1250*e* using mounting support 1252*e* in order to couple the ½$HEE_{11}$ mode of resonator 1210*c* to the TEH mode of resonator 1201*e*. In contrast, full cylindrical resonator 1201*d* is mounted to the floor of resonator cavity 1250*d* using mounting support 1252*d* in order to couple the ½$HEH_{11}$ mode of resonator 1210*c* to the TEH mode of resonator 1201*d*. These relative orientations of resonators 1201*d*, 1201*e* are determined by the relative polarizations of the coupled modes. If a different mode of the resonators 1201*d*, 1201*e* were to be coupled (for example the HEH or HEE modes), different orientations of the resonators 1201*d*, 1201*e* could be used.

Figure 21:
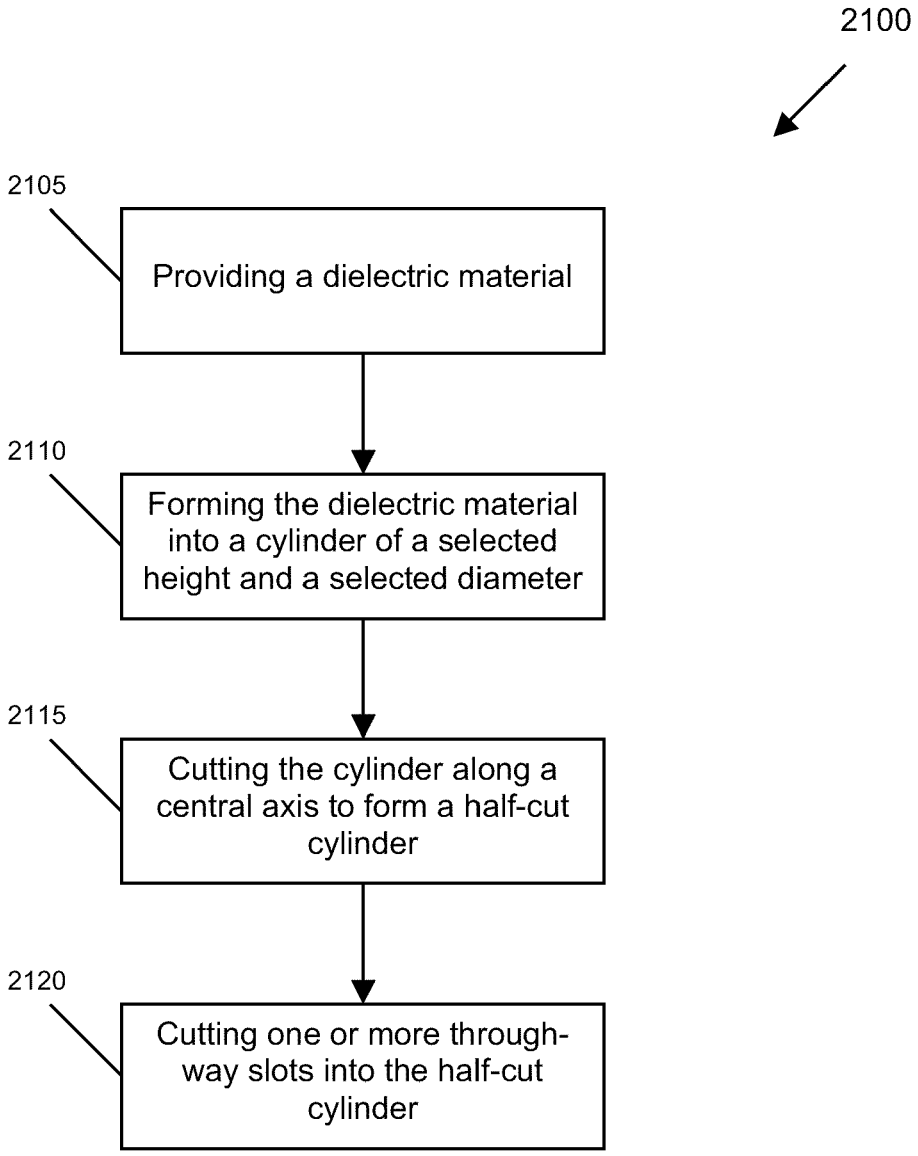
FIG. 21 is a flow chart of the steps of a method of manufacturing a half-cut cylindrical dielectric resonator; and, FIG. 22 is a perspective view of an exemplary rectangular dielectric resonator.

Reference is now made to FIG. 21, which shows a flow chart of a method of manufacturing a full cylindrical or half-cut cylindrical dielectric resonator, according to aspects of embodiments of the present invention. The method 2100 may be used to manufacture any of the full cylindrical dielectric resonator 1, the basic half-cut dielectric resonator 10 and the various slotted half-cut dielectric resonators 510, 610, 710, 910. Accordingly, some of the steps of method 2100 are optional.

Method 2100 begins at step 2105, which comprises providing a block of a suitable high-permittivity dielectric material. In some embodiments, the dielectric constant of the material lies in the range $20<\epsilon_r<100$, though in other embodiments the dielectric constant may be higher or lower. The block of dielectric material should have a volume at least that of the dielectric resonator to be manufactured.

Step 2110 comprises forming the dielectric material into a cylinder of a selected diameter D and a selected length L. The selected values of D and L may depend on the filter application to which the resonator will be put. For example, if the final resonator will have a full cylindrical shape, D and L may be selected so that it will be suitable for operation in a quad-mode. In this case, D and L may be selected so that the dual $HEH_{11}$ and $HEE_{11}$ of the full cylindrical dielectric resonator all resonate at a common resonant frequency, and the method 2100 ends after step 2110.

Alternatively, the final resonator may have a half-cut cylindrical form and D and L may be selected so that it will be suitable for operation in a dual-mode. In that case, D and L may be selected so that both ½$HEH_{11}$ and ½$HEE_{11}$ modes of the half-cut dielectric resonator resonate at a common resonant frequency. Alternatively, the final resonator may have a half-cut cylindrical form and D and L may be selected so that the half-cut dielectric resonator will be suitable for operation in a dual-band. In that case, D and L may be selected so that the ½$HEH_{11}$ mode resonates at first resonant frequency and the ½$HEE_{11}$ mode resonates at a second frequency different from the first resonant frequency. In these two alternatives, the method 2100 proceeds to step 2115.

Step 2115 comprises cutting the full cylindrical dielectric resonator lengthwise along a central axis to produce a half-cut dielectric resonator. The half-cut dielectric resonator will be of the diameter D and length L selected in previous step 2110, which may make the resonator suitable for operation in either a dual-mode or a dual-band. If no through-way slots are to be cut, method 2100 ends after step 2115. Alternatively, method 2100 proceeds to step 2120, which comprises cutting one or more through-way slots in the basic half-cut dielectric resonator filter.

Steps 2105, 2110 and 2120 may be performed using any suitable technique for cutting dielectric material. In some embodiments, steps 2105, 2110 and 2120 are performed using watercutting, which provides a highly accurate and cost-effective solution. As a result, no special molding or firing is required. Different cutting techniques however may be used in other embodiments. It should be appreciated, moreover, that modifications to method 2100 are possible, and that other methods of manufacturing a half-cut dielectric resonator exist and are within the scope of the disclosure. For example, half-cut dielectric resonators, and even slotted half-cut dielectric resonators, can be directly molded from a suitable high-permittivity dielectric substrate. Cutting a full cylinder into a half-cut cylinder, however, has the advantage of being both highly accurate and cost-effective.

Figure 22:
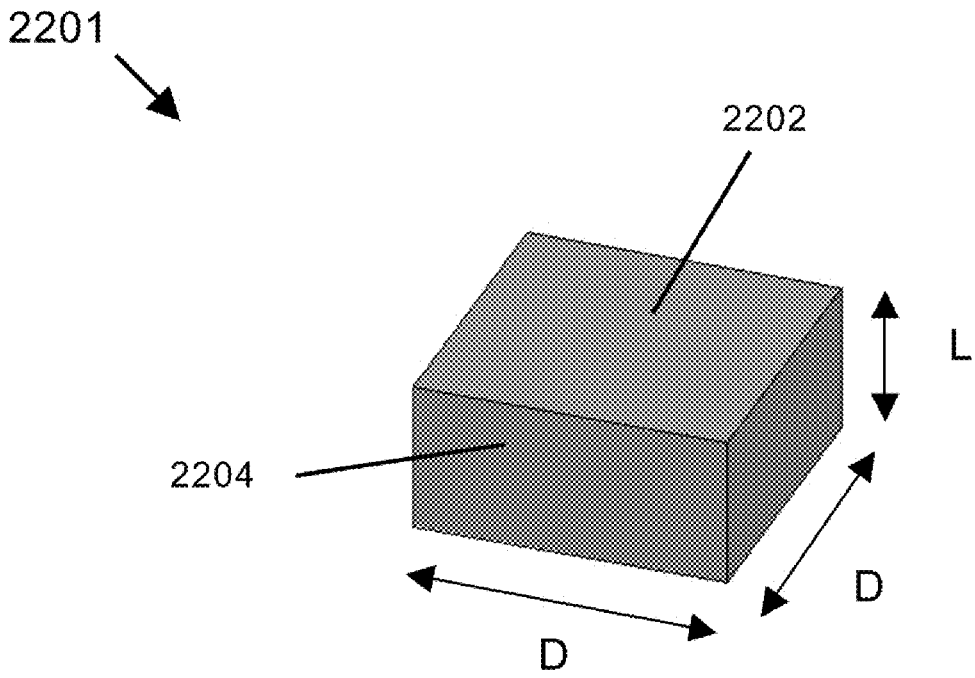

Reference is now made to FIG. 22, which is perspective views of an exemplary rectangular dielectric resonator, respectively, according to aspects of embodiments of the present invention. The rectangular dielectric resonator 2201 shown in FIG. 22 comprises a generally rectangular shape of length L and cross-sectional area D×D formed in a unitary piece of suitable high-permittivity dielectric substrate. Accordingly, the rectangular dielectric resonator 2201 comprises parallel square surfaces 2202 connected by four rectangular surfaces 2204. It may also be formed in a high-permittivity dielectric substrate.

It is evident that the rectangular dielectric resonator 2201, like the full cylindrical dielectric resonator 1, has 90 degree radial symmetry. Thus, like the full cylindrical dielectric resonator 1, the rectangular dielectric resonator 2201 can be sized for operation in a quad mode, wherein each of the four modes resonates at a common resonant frequency. Further, the rectangular dielectric resonator 2201 can also be sized for operation in a dual band, wherein each of two dual modes resonate at separate frequencies, one dual mode resonating a first resonant frequency and the other dual mode resonant at a second resonant frequency different from the first resonant frequency. One dual degenerate mode in the rectangular dielectric resonator 2201 will circulate parallel to the square surfaces 2202 (similar to the HEH mode in the full cylinder), and another dual degenerate mode will circulate orthogonal to the square surfaces (similar to the HEE mode in the full cylinder). Thus, again the D/L ratio can be sized so that the circulating paths of the E fields in these two dual modes are equal, in which case the modes will resonate at the same frequency. Alternatively, the D/L ratio can be sized for operation in a dual-band.

It should be appreciated that the above-described embodiments of coupling schemes (input-output, intra-cavity, inter-cavity), as well as filter/multiplexer realizations, though expressly described with reference to the full and half-cut cylindrical dielectric resonators, equally can be realized using rectangular dielectric resonators. Thus, filters and multiplexers realized using rectangular resonators are within the scope of the invention as well. It should further be appreciated that through-way slots may also similarly be cut into the rectangular dielectric resonators.

Numerous specific details are set forth to provide a thorough understanding of the exemplary embodiments described herein. However, it will be appreciated by those of ordinary skill in the art that the exemplary embodiments described herein may be practiced in some instances without certain of these specific details. In other instances, well-known methods, procedures and components have not been described in detail so as not to obscure other aspects of the embodiments described herein. It will also be appreciated that some features and/or functions of the described exemplary embodiments are amenable to modification without departing from the principles of operation of the described exemplary embodiments. As the description provided herein is merely illustrative of the invention, other variants and modifications may still be within the invention as defined in the claims appended hereto. This description is not to be considered in any way as limiting the scope of the exemplary embodiments described herein.

The invention claimed is:

1. A dielectric resonator assembly for use in a dielectric resonator filter or a dielectric resonator multiplexer, the dielectric resonator assembly comprising:

a) a dielectric resonator;

b) the dielectric resonator formed in a unitary piece of high-permittivity dielectric substrate into a half-cut cylinder of a selected height and a selected diameter, the half-cut cylinder defined by a parallel pair of semi-circular surfaces, a curved surface extending along respective curved edges of the pair of semi-circular surfaces, and a rectangular surface subtending the curved surface, wherein a first dimension of the rectangular surface corresponds to the selected height and a second dimension of the rectangular surface corresponds to the selected diameter;

wherein the dielectric resonator resonates in a plurality of resonance modes comprising a ½HEH11 mode and a ½HEE11 mode and, at the selected height and the selected diameter, the dielectric resonator resonates in one of a dual mode or a dual band so that each of the ½HEH11 mode and the ½HEE11 mode are operating modes of the dielectric resonator assembly.

2. The dielectric resonator assembly of claim 1, wherein at the selected height and the selected diameter, the dielectric resonator resonates in the dual mode, each of two modes in the dual mode resonating at a common resonant frequency, wherein one of the two modes is the ½HEH11 mode and the other of the two modes is the ½HEE11 mode.

3. The dielectric resonator assembly of claim 1, wherein at the selected height and the selected diameter, the dielectric resonator resonates in the dual band, one of two bands in the dual band corresponding to resonance in the ½HEH11 mode at a first resonant frequency, the other of two bands corresponding to resonance in the ½HEE11 mode at a second resonant frequency different from the first resonant frequency, wherein each of the ½HEH11 mode and the ½HEE11 mode are single modes.

4. The dielectric resonator assembly of claim 1, further comprising a metallic enclosure defining a cavity, and a mounting support formed in a unitary piece of low-permittivity dielectric substrate, wherein the dielectric resonator is mounted on the mounting support within the cavity.

5. The dielectric resonator assembly of claim 1, wherein the dielectric resonator further comprises at least one through-way slot extending between opposite surfaces of the dielectric resonator to improve a spurious free window of the dielectric resonator assembly.

6. A dielectric resonator filter comprising:

a) at least one dielectric resonator assembly comprising a dielectric resonator formed in a unitary piece of high-permittivity dielectric substrate into a half-cut cylinder of a selected height and a selected diameter, the half-cut cylinder defined by a parallel pair of semi-circular surfaces, a curved surface extending along respective curved edges of the pair of semi-circular surfaces, and a rectangular surface subtending the curved surface, wherein a first dimension of the rectangular surface corresponds to the selected height and a second dimension of the rectangular surface corresponds to the selected diameter;

wherein the dielectric resonator in each at least one dielectric resonator assembly resonates in a plurality of resonance modes comprising a ½HEH11 mode and a ½HEE11 mode and, at the selected height and the selected diameter, the dielectric resonator in each at least one dielectric resonator assembly resonates in one of a dual mode or a dual band so that each of the ½HEH11 mode and the ½HEE11 mode are operating modes of each at least one dielectric resonator assembly.

7. The dielectric resonator filter of claim 6, wherein the dielectric resonator filter is at least a 2N-pole filter comprising at least N dielectric resonator assemblies, the dielectric resonator in each of N dielectric resonator assemblies formed into a half-cut cylinder and, at the selected height and the selected diameter, each of the N dielectric resonator assemblies resonates in the dual mode, each of two modes in the dual mode resonating at a common resonant frequency, wherein the two modes in the dual mode are the ½HEH11 mode and the ½HEE11 mode.

8. The dielectric resonator filter of claim 6, wherein the dielectric resonator filter is a dual band filter with at least N-poles in each band, the dielectric resonator filter comprising at least N dielectric resonator assemblies, the dielectric resonator in each of N dielectric resonator assemblies formed into a half-cut cylinder and, at the selected height and the selected diameter, each of the N dielectric resonator assemblies resonates in the dual band, one of two bands in the dual band corresponding to resonance in the ½HEH11 mode at a first resonant frequency, the other of two bands corresponding to resonance in the ½HEE11 at a second resonant frequency different from the first resonant frequency.

9. The dielectric resonator filter of claim 6, wherein each of the at least one dielectric resonator assembly further comprises a metallic enclosure defining a cavity, and a mounting support formed from a unitary piece of low-permittivity dielectric substrate, wherein the dielectric resonator is mounted on the mounting support within the cavity.

10. The dielectric resonator filter of claim 9, wherein, for each of the at least one dielectric resonator assembly, at least one iris is defined in the metallic enclosure for coupling resonant modes of adjacent dielectric resonant assemblies.

11. The dielectric resonator filter of claim 9, wherein at least one dielectric resonator assembly further comprises at least one rod protruding interiorly into the cavity oriented to couple resonant modes of that dielectric resonator assembly.

12. The dielectric resonator filter of claim 9, further comprising at least one electromagnetic probe configured to couple at least one external connector to at least one resonant mode of the at least one dielectric resonator assembly.

13. A dielectric resonator multiplexer comprising:

a) at least one dielectric resonator assembly comprising a dielectric resonator formed in a unitary piece of high-permittivity dielectric substrate into a half-cut cylinder of a selected height and a selected diameter, the half-cut cylinder defined by a parallel pair of semi-circular surfaces, a curved surface extending along respective curved edges of the pair of semi-circular surfaces, and a rectangular surface subtending the curved surface, wherein a first dimension of the rectangular surface corresponds to the selected height and a second dimension of the rectangular surface corresponds to the selected diameter;

wherein the dielectric resonator in each at least one dielectric resonator assembly resonates in a plurality of resonance modes comprising a ½HEH11 mode and a ½HEE11 mode and, at the selected height and the selected diameter, the dielectric resonator in each at least one dielectric resonator assembly resonates in a dual band so that each of the ½HEH11 mode and the ½HEE11 mode are operating modes of each at least one dielectric resonator assembly.

14. The dielectric resonator multiplexer of claim 13, wherein the dielectric resonator multiplexer is a two channel multiplexer with at least N-poles in each channel, the dielectric resonator multiplexer comprising at least N dielectric resonator assemblies, the dielectric resonator in each of N dielectric resonator assemblies formed into a half-cut cylinder and, at the selected height and the selected diameter, each of the N dielectric resonator assemblies resonates in the dual band, one of two bands in the dual band corresponding to resonance in the ½HEH11 mode at a first resonant frequency, the other of the two bands corresponding to resonance in the ½HEE11 mode at a second resonant frequency different from the first resonant frequency.

15. The dielectric resonator multiplexer of claim 13, wherein each of the at least one dielectric resonator assembly further comprises a metallic enclosure defining a cavity, and a mounting support formed from a unitary piece of low-permittivity dielectric substrate, wherein the dielectric resonator is mounted on the mounting support within the cavity.

16. The dielectric resonator multiplexer of claim 15, wherein, for each of the at least one dielectric resonator assembly, at least one iris is defined in the metallic enclosure for coupling resonant modes of adjacent dielectric resonant assemblies.

17. The dielectric resonator multiplexer of claim 15, further comprising a first electromagnetic probe configured to couple a first external connector to each of the ½HEH11 mode and the ½HEE11 mode of a first dielectric resonator assembly, one resonant mode from each of a first band and a second band of a dual band, and further comprising a second electromagnetic probe configured to couple a second external connector to one of the ½HEH11 mode and the ½HEE11 mode of the first dielectric resonator assembly or a second dielectric resonator assembly, and further comprising a third electromagnetic probe configured to couple a third external connector to the other of the ½HEH11 mode and the ½HEE11 mode of one of the first dielectric resonator assembly, the second dielectric resonator assembly and a third dielectric resonator assembly.

18. The dielectric resonator multiplexer of claim 13, wherein the dielectric resonator multiplexer is a multi-channel multiplexer comprising a plurality of 2-channel multiplexers with at least N-poles in each channel, each 2-channel dielectric resonator multiplexer comprising at least N dielectric resonator assemblies, the dielectric resonator in each of N dielectric resonator assemblies formed into a half-cut cylinder and, at the selected height and the selected diameter, each of the N dielectric resonator assemblies resonates in a dual band, one of two bands in the dual band corresponding to resonance in the ½HEH11 mode at a first resonant frequency, the other of the two bands corresponding to resonance in the ½HEE11 mode at a second resonant frequency different from the first resonant frequency.

19. A method of manufacturing a dielectric resonator assembly for use in one of a dielectric resonator filter and a dielectric resonator multiplexer, the method comprising:

providing a dielectric material; and forming the dielectric material into a half-cut cylinder of a selected height and a selected diameter;

wherein the dielectric resonator resonates in a plurality of resonance modes comprising a ½HEH11 mode and a ½HEE11 mode and, at the selected height and the selected diameter, the dielectric resonator resonates in one of a dual mode or a dual band so that each of the ½HEH11 mode and the ½HEE11 mode are operating modes of the dielectric resonator assembly.

20. The method of claim 19, wherein forming the dielectric material into the half-cut cylinder comprises forming the dielectric material into a full cylinder and cutting the full cylinder along an axis.

21. The method of claim 20, further comprising cutting at least one through-way slot into the half-cut cylinder.

22. The dielectric resonator assembly of claim 4, wherein at least one iris is defined in the metallic enclosure for coupling at least one of the ½HEH11 mode and the ½HEE11 mode to a corresponding mode of an adjacent dielectric resonant assembly.

23. The dielectric resonator assembly of claim 1, further comprising at least one coupling element configured to couple the ½HEH11 mode and the ½HEE11 mode.

24. The dielectric resonator assembly of claim 1, further comprising at least one coupling element configured to couple at least one external connector and at least one of the ½HEH11 mode and the ½HEE11 mode.

25. The dielectric resonator filter of claim 6, wherein at least one dielectric resonator assembly further comprises at least one coupling element supported in that dielectric resonator assembly and adapted to couple the ½HEH11 mode and the ½HEE11 mode of that dielectric resonator assembly.

26. The dielectric resonator filter of claim 6, wherein at least one dielectric resonator assembly further comprises at least one coupling element supported in that dielectric resonator assembly and configured to couple at least one external connector and at least one of the ½HEH11 mode and the ½HEE11 mode of that dielectric resonator assembly.

* * * * *